US011047590B2

(12) United States Patent
Yamada et al.

(10) Patent No.: US 11,047,590 B2
(45) Date of Patent: Jun. 29, 2021

(54) AIR CONDITIONER

(71) Applicant: DAIKIN INDUSTRIES, LTD., Osaka (JP)

(72) Inventors: Takuro Yamada, Osaka (JP); Yuusuke Nakagawa, Osaka (JP); Masahiro Honda, Osaka (JP); Yuusuke Oka, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 90 days.

(21) Appl. No.: 16/338,246

(22) PCT Filed: Sep. 26, 2017

(86) PCT No.: PCT/JP2017/034761
§ 371 (c)(1),
(2) Date: Mar. 29, 2019

(87) PCT Pub. No.: WO2018/062188
PCT Pub. Date: Apr. 5, 2018

(65) Prior Publication Data

US 2019/0234643 A1 Aug. 1, 2019

(30) Foreign Application Priority Data

Sep. 30, 2016 (JP) ..... JP2016-192557

(51) Int. Cl.
*F24F 11/84* (2018.01)
*F25B 1/10* (2006.01)
(Continued)

(52) U.S. Cl.
CPC ..... *F24F 11/84* (2018.01); *F25B 1/10* (2013.01); *F25B 5/02* (2013.01); *F25B 31/008* (2013.01);
(Continued)

(58) Field of Classification Search
CPC ..... F24F 11/84; F25B 1/10; F25B 5/02; F25B 13/00; F25B 31/008; F25B 41/003;
(Continued)

(56) References Cited

U.S. PATENT DOCUMENTS 5,873,255 A 2/1999 Madigan
2010/0192607 A1 8/2010 Unezaki et al.
(Continued)

FOREIGN PATENT DOCUMENTS

EP 1662213 A1 5/2006
JP 2006-112708 A 4/2006
(Continued)

OTHER PUBLICATIONS

International Search Report issued in PCT/JP2017/034761 (PCT/ISA/210), dated Dec. 26, 2017.

*Primary Examiner* — Marc E Norman
(74) *Attorney, Agent, or Firm* — Birch, Stewart, Kolasch & Birch, LLP

(57) ABSTRACT

An air conditioner, in which a liquid-pressure adjustment expansion valve that decompresses a refrigerant so that the refrigerant flowing through a liquid-refrigerant connection pipe is in a gas-liquid two-phase state is provided in an outdoor liquid-refrigerant pipe that connects a liquid-side end of an outdoor heat exchanger to the liquid-refrigerant connection pipe, properly transports the refrigerant in a two-phase state while suppressing an increase in a discharge temperature of a compressor. A liquid injection pipe that branches part of a refrigerant flowing through an outdoor liquid-refrigerant pipe and feeds the branched refrigerant to a compressor is connected to a portion of the outdoor liquid-refrigerant pipe on a side of an outdoor heat exchanger with respect to a liquid-pressure adjustment expansion valve.

22 Claims, 22 Drawing Sheets

(51) Int. Cl.

| | |
|---|---|
| ***F25B 5/02*** | (2006.01) |
| ***F25B 31/00*** | (2006.01) |
| ***F25B 41/20*** | (2021.01) |
| ***F25B 41/40*** | (2021.01) |
| *F25B 43/00* | (2006.01) |
| *F25B 13/00* | (2006.01) |

(52) U.S. Cl.
CPC ..... *F25B 41/20* (2021.01); *F25B 41/40* (2021.01); *F25B 13/00* (2013.01); *F25B 43/006* (2013.01); *F25B 2313/0233* (2013.01); *F25B 2400/13* (2013.01); *F25B 2600/2513* (2013.01)

(58) Field of Classification Search
CPC .... F25B 41/04; F25B 43/006; F25B 2400/13; F25B 2600/2513
See application file for complete search history.

(56) References Cited

U.S. PATENT DOCUMENTS

2010/0275626 A1* 11/2010 Nishimura ..... F25B 49/005 62/149
2011/0000234 A1* 1/2011 Nishimura ..... F25B 49/005 62/77
2011/0000240 A1* 1/2011 Yamada ..... F25B 49/005 62/208
2014/0083123 A1 3/2014 Yamashita et al.
2014/0182329 A1 7/2014 Yamashita et al.
2015/0033780 A1* 2/2015 Hatomura ..... F25B 41/043 62/208
2015/0128629 A1* 5/2015 Kawano ..... F25B 9/002 62/160
2015/0211772 A1* 7/2015 Shimazu ..... F25B 41/043 62/196.4
2015/0316275 A1 11/2015 Yamashita et al.
2015/0338121 A1 11/2015 Yamashita
2016/0146496 A1 5/2016 Yamashita
2018/0372379 A1* 12/2018 Kamitani ..... F25B 1/005

FOREIGN PATENT DOCUMENTS

JP 2010-2112 A 1/2010
JP 2016-121812 A 7/2016
WO WO 2010/117973 A2 10/2010
WO WO 2013/001572 A1 1/2013
WO WO 2014/128830 A1 8/2014
WO WO 2014/141375 A1 9/2014
WO WO 2015/029160 A1 3/2015

* cited by examiner

AIR CONDITIONER

TECHNICAL FIELD

The present invention relates to air conditioners. The present invention more particularly relates to an air conditioner including an outdoor unit having a compressor and an outdoor heat exchanger, a plurality of indoor units having an indoor heat exchanger, and a liquid-refrigerant connection pipe that connects the outdoor unit to the plurality of indoor units, in which a liquid-pressure adjustment expansion valve that decompresses a refrigerant so that the refrigerant flowing through the liquid-refrigerant connection pipe is in a gas-liquid two-phase state is provided in an outdoor liquid-refrigerant pipe that connects a liquid-side end of the outdoor heat exchanger to the liquid-refrigerant connection pipe.

BACKGROUND ART

An air conditioner of related art includes an outdoor unit having a compressor and an outdoor heat exchanger, a plurality of indoor units having an indoor heat exchanger, and a liquid-refrigerant connection pipe that connects the outdoor unit to the plurality of indoor units, and performs an operation of sending a refrigerant, which has been discharged from the compressor, to the outdoor heat exchanger, the liquid-refrigerant connection pipe, and the indoor heat exchanger in that order. An example of such an air conditioner may be one, as disclosed in PTL 1 (International Publication No. 2015/029160), in which a liquid-pressure adjustment expansion valve that decompresses the refrigerant so that the refrigerant flowing through the liquid-refrigerant connection pipe is in a gas-liquid two-phase state is provided in an outdoor liquid-refrigerant pipe that connects a liquid-side end of the outdoor heat exchanger to the liquid-refrigerant connection pipe. That is, when the air conditioner performs the operation of sending the refrigerant, which has been discharged from the compressor, to the outdoor heat exchanger, the liquid-refrigerant connection pipe, and the indoor heat exchanger in that order, the air conditioner transports the refrigerant in the two-phase state by sending the refrigerant in the gas-liquid two-phase state to the liquid-refrigerant connection pipe and feeding the refrigerant from the outdoor unit to the indoor units through the decompression using the liquid-pressure adjustment expansion valve.

SUMMARY OF THE INVENTION

In the air conditioner of PTL 1, if the discharge temperature of the compressor excessively increases, for example, the opening degree of an indoor expansion valve that is provided in each indoor unit may be temporarily increased for protective control to decrease the discharge temperature.

However, with the temporary increase in the opening degree of the indoor expansion valve, the state of the refrigerant flowing through the liquid-refrigerant connection pipe may vary, and a desirable gas-liquid two-phase state may not be obtained, possibly causing a trouble in transporting the refrigerant in the two-phase state using the liquid-pressure adjustment expansion valve.

The present invention aims at an air conditioner including an outdoor unit having a compressor and an outdoor heat exchanger, a plurality of indoor units having an indoor heat exchanger, and a liquid-refrigerant connection pipe that connects both the units to each other, in which a liquid-pressure adjustment expansion valve that decompresses a refrigerant so that the refrigerant flowing through the liquid-refrigerant connection pipe is in a gas-liquid two-phase state is provided in an outdoor liquid-refrigerant pipe that connects a liquid-side end of the outdoor heat exchanger to the liquid-refrigerant connection pipe. An object of the present invention is that the air conditioner properly transports the refrigerant in a two-phase state while suppressing an increase in a discharge temperature of the compressor.

An air conditioner according to a first aspect of the present invention is an air conditioner including an outdoor unit having a compressor and an outdoor heat exchanger, a plurality of indoor units having an indoor heat exchanger, and a liquid-refrigerant connection pipe that connects the outdoor unit to the plurality of indoor units, the air conditioner being configured to perform an operation of sending a refrigerant, which has been discharged from the compressor, to the outdoor heat exchanger, the liquid-refrigerant connection pipe, and the indoor heat exchanger in that order. A liquid-pressure adjustment expansion valve that decompresses the refrigerant so that the refrigerant flowing through the liquid-refrigerant connection pipe is in a gas-liquid two-phase state is provided in an outdoor liquid-refrigerant pipe that connects a liquid-side end of the outdoor heat exchanger to the liquid-refrigerant connection pipe. A liquid injection pipe that branches part of the refrigerant flowing through the outdoor liquid-refrigerant pipe and feeds the branched refrigerant to the compressor is connected to a portion of the outdoor liquid-refrigerant pipe on a side of the outdoor heat exchanger with respect to the liquid-pressure adjustment expansion valve.

In the configuration in which the refrigerant is transported in the two-phase state by sending the refrigerant in the gas-liquid two-phase state to the liquid-refrigerant connection pipe and feeding the refrigerant from the outdoor unit to the indoor units using the liquid-pressure adjustment expansion valve, as described above, the liquid injection pipe is further provided in the portion of the outdoor liquid-refrigerant pipe on the side of the outdoor heat exchanger with respect to the liquid-pressure adjustment expansion valve to branch part of the refrigerant flowing through the outdoor liquid-refrigerant pipe and feed the refrigerant to the compressor. Since the liquid injection pipe is provided, the refrigerant can be fed to the compressor while a variation in the temperature of the refrigerant flowing through the outdoor liquid-refrigerant pipe is suppressed. Thus, an increase in the discharge temperature of the compressor can be suppressed while a variation in the state of the refrigerant flowing through the liquid-refrigerant connection pipe after the refrigerant has been decompressed by the liquid-pressure adjustment expansion valve is suppressed. Thus, the refrigerant flowing through the liquid-refrigerant connection pipe can be reliably maintained in a desirable gas-liquid two-phase state while an increase in the discharge temperature of the compressor is suppressed.

That is, in the configuration having the liquid-pressure adjustment expansion valve, since the liquid injection pipe is provided, the refrigerant can be properly transported in the two-phase state while an increase in the discharge temperature of the compressor is suppressed.

An air conditioner according to a second aspect of the present invention is the air conditioner according to the first aspect of the present invention, in which the liquid injection pipe is connected to a suction refrigerant pipe through which the refrigerant to be sucked into the compressor flows.

In this case, as described above, since the refrigerant branched from the outdoor liquid-refrigerant pipe can be fed to the suction side of the compressor, the temperature of the refrigerant to be sucked into the compressor can be decreased.

An air conditioner according to a third aspect of the present invention is the air conditioner according to the second aspect of the present invention, in which an accumulator that temporarily stores the refrigerant is provided in the suction refrigerant pipe; and the liquid injection pipe is connected to a portion of the suction refrigerant pipe on an outlet side of the accumulator.

In this case, as described above, since the liquid injection pipe is connected to the outlet side of the accumulator, the refrigerant flowing through the liquid injection pipe can be joined to the refrigerant to be sucked into the compressor without via the accumulator. Thus, the effect of decreasing the temperature of the refrigerant to be sucked into the compressor can be increased as compared with a case where the liquid injection pipe is connected to an inlet side of the accumulator.

An air conditioner according to a fourth aspect of the present invention is the air conditioner according to the second aspect of the present invention, in which the liquid injection pipe is bifurcated; and the liquid injection pipe is connected to both a portion of the suction refrigerant pipe on an inlet side of the accumulator and a portion of the suction refrigerant pipe on an outlet side of the accumulator.

In this case, as described above, since the liquid injection pipe is connected to both the inlet side and the outlet side of the accumulator, the refrigerant flowing through the liquid injection pipe may be fed to the outlet side of the accumulator to increase the effect of decreasing the temperature of the refrigerant to be sucked into the compressor, and the refrigerant flowing through the liquid injection pipe may be fed to the inlet side of the accumulator to reduce the liquid so that the pressure of the refrigerant discharged from the compressor does not exceed a predetermined discharge pressure threshold.

An air conditioner according to a fifth aspect of the present invention is the air conditioner according to the first aspect of the present invention, in which the liquid injection pipe is connected to an intermediate portion of a compression stroke of the compressor.

In this case, as described above, since the refrigerant branched from the outdoor liquid-refrigerant pipe can be fed to the intermediate portion of the compression stroke of the compressor, the temperature of the refrigerant compressed to an intermediate pressure in the compressor can be decreased.

An air conditioner according to a sixth aspect of the present invention is the air conditioner according to the fifth aspect of the present invention, in which an accumulator that temporarily stores the refrigerant is provided in the suction refrigerant pipe through which the refrigerant to be sucked into the compressor flows; the liquid injection pipe is bifurcated; and the liquid injection pipe is connected to both a portion of the suction refrigerant pipe on an inlet side of the accumulator and the intermediate portion of the compression stroke of the compressor.

In this case, as described above, since the liquid injection pipe is connected to both the inlet side of the accumulator and the intermediate portion of the compression stroke of the compressor, the refrigerant flowing through the liquid injection pipe may be fed to the intermediate portion of the compression stroke of the compressor to decrease the temperature of the refrigerant compressed to the intermediate pressure in the compressor, and the refrigerant flowing through the liquid injection pipe may be fed to the inlet side of the accumulator to reduce the liquid so that the pressure of the refrigerant discharged from the compressor does not exceed the predetermined discharge pressure threshold.

An air conditioner according to a seventh aspect of the present invention is the air conditioner according to the first aspect of the present invention, in which a refrigerant return pipe that branches part of the refrigerant flowing through the outdoor liquid-refrigerant pipe and feeds the branched refrigerant to the compressor is connected to the outdoor liquid-refrigerant pipe, and a refrigerant cooler that cools the refrigerant flowing through a portion of the outdoor liquid-refrigerant pipe on the side of the outdoor heat exchanger with respect to the liquid-pressure adjustment expansion valve using the refrigerant flowing through the refrigerant return pipe is provided in the outdoor liquid-refrigerant pipe.

In this configuration in which the refrigerant is transported in the two-phase state by sending the refrigerant in the gas-liquid two-phase state to the liquid-refrigerant connection pipe and feeding the refrigerant from the outdoor unit to the indoor units using the liquid-pressure adjustment expansion valve, as described above, the refrigerant cooler is further provided that cools the refrigerant flowing through the portion of the outdoor liquid-refrigerant pipe on the side of the outdoor heat exchanger with respect to the liquid-pressure adjustment expansion valve using the refrigerant return pipe and the refrigerant flowing through the refrigerant return pipe.

If the liquid injection pipe is not provided and the refrigerant return pipe and the refrigerant cooler are provided, the refrigerant flowing through the refrigerant return pipe cools the refrigerant flowing through the refrigerant cooler and then is fed to the compressor, and hence an increase in the discharge temperature of the compressor can be suppressed. However, since the refrigerant flowing through the refrigerant return pipe is fed to the compressor after cooling the refrigerant flowing through the outdoor liquid-refrigerant pipe in the refrigerant cooler, the temperature of the refrigerant flowing through the outdoor liquid-refrigerant pipe after the refrigerant has passed through the refrigerant cooler varies depending on the flow rate of the refrigerant flowing through the refrigerant return pipe. Consequently, the state of the refrigerant flowing through the liquid-refrigerant connection pipe after the refrigerant has been decompressed by the liquid-pressure adjustment expansion valve also varies. For example, if the flow rate of the refrigerant flowing through the refrigerant return pipe excessively increases, an increase in the discharge temperature of the compressor can be suppressed to a certain extent; however, the temperature of the refrigerant flowing through the outdoor liquid-refrigerant pipe after the refrigerant has passed through the refrigerant cooler excessively decreases. Consequently, the refrigerant flowing through the liquid-refrigerant connection pipe after the refrigerant has been decompressed by the liquid-pressure adjustment expansion valve is in a gas-liquid two-phase state containing more liquid component.

That is, in the configuration having the liquid-pressure adjustment expansion valve, merely providing the refrigerant return pipe and the refrigerant cooler may not maintain a desirable gas-liquid two-phase state. It is difficult to properly transport the refrigerant in the two-phase state while an increase in the discharge temperature of the compressor is suppressed.

Owing to this, the liquid injection pipe is provided in addition to the refrigerant return pipe and the refrigerant cooler. Since the liquid injection pipe is provided, the refrigerant can be fed to the compressor while a variation in the temperature of the refrigerant flowing through the outdoor liquid-refrigerant pipe is suppressed. Thus, an increase in the discharge temperature of the compressor can be suppressed without increasing the flow rate of the refrigerant flowing through the refrigerant return pipe. If the flow rate of the refrigerant flowing through the refrigerant return pipe is not excessively large, the temperature of the refrigerant flowing through the outdoor liquid-refrigerant pipe after the refrigerant has passed through the refrigerant cooler does not excessively decrease. Consequently, the refrigerant flowing through the liquid-refrigerant connection pipe after the refrigerant is decompressed by the liquid-pressure adjustment expansion valve does not become the refrigerant in the gas-liquid two-phase state containing more liquid component. Thus, the refrigerant flowing through the liquid-refrigerant connection pipe can be maintained in a desirable gas-liquid two-phase state while an increase in the discharge temperature of the compressor is suppressed.

That is, in the configuration having the liquid-pressure adjustment expansion valve, since the liquid injection pipe is provided in addition to the refrigerant return pipe and the refrigerant cooler, the refrigerant can be properly transported in the two-phase state while an increase in the discharge temperature of the compressor is suppressed.

An air conditioner according to an eighth aspect of the present invention is the air conditioner according to the seventh aspect of the present invention, in which the liquid injection pipe and/or the refrigerant return pipe is connected to a suction refrigerant pipe through which the refrigerant to be sucked into the compressor flows.

In this case, as described above, since the refrigerant branched from the outdoor liquid-refrigerant pipe can be fed to the suction side of the compressor, the temperature of the refrigerant to be sucked into the compressor can be decreased.

An air conditioner according to a ninth aspect of the present invention is the air conditioner according to the eighth aspect of the present invention, in which an accumulator that temporarily stores the refrigerant is provided in the suction refrigerant pipe; and the liquid injection pipe and/or the refrigerant return pipe is connected to a portion of the suction refrigerant pipe on an outlet side of the accumulator.

In this case, as described above, since the liquid injection pipe and/or the refrigerant return pipe is connected to the outlet side of the accumulator, the refrigerant flowing through the liquid injection pipe and/or the refrigerant return pipe can be joined to the refrigerant to be sucked into the compressor without via the accumulator. Thus, the effect of decreasing the temperature of the refrigerant to be sucked into the compressor can be increased as compared with a case where the liquid injection pipe and/or the refrigerant return pipe is connected to an inlet side of the accumulator.

An air conditioner according to a tenth aspect of the present invention is the air conditioner according to the eighth aspect of the present invention, in which the liquid injection pipe and/or the refrigerant return pipe is connected to a portion of the suction refrigerant pipe on an inlet side of the accumulator.

In this case, as described above, since the liquid injection pipe and/or the refrigerant return pipe is connected to the inlet side of the accumulator, the refrigerant flowing through the liquid injection pipe and/or the refrigerant return pipe can be joined to the refrigerant to be sucked into the compressor via the accumulator. Thus, for example, occurrence of liquid compression in the compressor can be prevented as compared with a case where the liquid injection pipe and/or the refrigerant return pipe is connected to an outlet side of the accumulator.

An air conditioner according to an eleventh aspect of the present invention is the air conditioner according to the eighth aspect of the present invention, in which the liquid injection pipe or the refrigerant return pipe is bifurcated; and the liquid injection pipe or the refrigerant return pipe is connected to both a portion of the suction refrigerant pipe on an inlet side of the accumulator and a portion of the suction refrigerant pipe on an outlet side of the accumulator.

In this case, as described above, since the liquid injection pipe or the refrigerant return pipe is connected to both the inlet side and the outlet side of the accumulator, the refrigerant flowing through the liquid injection pipe or the refrigerant return pipe may be fed to the outlet side of the accumulator to increase the effect of decreasing the temperature of the refrigerant to be sucked into the compressor, and the refrigerant flowing through the liquid injection pipe or the refrigerant return pipe may be fed to the inlet side of the accumulator to reduce the liquid so that the pressure of the refrigerant discharged from the compressor does not exceed a predetermined discharge pressure threshold.

An air conditioner according to a twelfth aspect of the present invention is the air conditioner according to the seventh aspect of the present invention, in which the liquid injection pipe and/or the refrigerant return pipe is connected to an intermediate portion of a compression stroke of the compressor.

In this case, as described above, since the refrigerant branched from the outdoor liquid-refrigerant pipe can be fed to the intermediate portion of the compression stroke of the compressor, the temperature of the refrigerant compressed to an intermediate pressure in the compressor can be decreased.

An air conditioner according to a thirteenth aspect of the present invention is the air conditioner according to the twelfth aspect of the present invention, in which an accumulator that temporarily stores the refrigerant is provided in a suction refrigerant pipe through which the refrigerant to be sucked into the compressor flows; the liquid injection pipe or the refrigerant return pipe is bifurcated; and the liquid injection pipe or the refrigerant return pipe is connected to both a portion of the suction refrigerant pipe on an inlet side of the accumulator and the intermediate portion of the compression stroke of the compressor.

In this case, as described above, since the liquid injection pipe or the refrigerant return pipe is connected to both the inlet side of the accumulator and the intermediate portion of the compression stroke of the compressor, the refrigerant flowing through the liquid injection pipe or the refrigerant return pipe may be fed to the intermediate portion of the compression stroke of the compressor to decrease the temperature of the refrigerant compressed to the intermediate pressure in the compressor, and the refrigerant flowing through the liquid injection pipe or the refrigerant return pipe may be fed to the inlet side of the accumulator to reduce the liquid so that the pressure of the refrigerant discharged from the compressor does not exceed a predetermined discharge pressure threshold.

An air conditioner according to a fourteenth aspect of the present invention is the air conditioner according to any one of the first to sixth aspects of the present invention, in which a liquid-injection expansion valve that decompresses the refrigerant branched from the outdoor liquid-refrigerant pipe is provided in the liquid injection pipe. A controller that controls a component of the outdoor unit and the indoor units controls an opening degree of the liquid-injection expansion valve so that a temperature of the refrigerant discharged from the compressor does not exceed a predetermined discharge temperature threshold.

In this case, as described above, since the flow rate of the refrigerant that is fed from the outdoor liquid-refrigerant pipe to the compressor can be adjusted through the liquid injection pipe by controlling the opening degree of the liquid-injection expansion valve provided in the liquid injection pipe, an increase in the temperature of the refrigerant discharged from the compressor (a discharge temperature of the compressor) can be reliably suppressed.

An air conditioner according to a fifteenth aspect of the present invention is the air conditioner according to the fourth or sixth aspect of the present invention, in which a liquid relief valve that feeds the refrigerant branched from the outdoor liquid-refrigerant pipe to the accumulator is provided in a portion of the liquid injection pipe that is connected to the portion of the suction refrigerant pipe on the inlet side of the accumulator. A controller that controls a component of the outdoor unit and the indoor units controls the liquid relief valve so that a pressure of the refrigerant discharged from the compressor does not exceed a predetermined discharge pressure threshold.

In this case, as described above, since the refrigerant can be fed from the outdoor liquid-refrigerant pipe to the accumulator via the liquid injection pipe by controlling the liquid relief valve provided in the portion of the liquid injection pipe connected to the inlet side of the accumulator, an increase in the pressure of the refrigerant discharged from the compressor (a discharge pressure of the compressor) can be suppressed.

An air conditioner according to a sixteenth aspect of the present invention is the air conditioner according to any one of the seventh to thirteenth aspects of the present invention, in which a liquid-injection expansion valve that decompresses the refrigerant branched from the outdoor liquid-refrigerant pipe is provided in the liquid injection pipe, and a refrigerant-return expansion valve that decompresses the refrigerant branched from the outdoor liquid-refrigerant pipe is provided in the refrigerant return pipe. A controller that controls a component of the outdoor unit and the indoor units controls an opening degree of the liquid-injection expansion valve so that a temperature of the refrigerant discharged from the compressor does not exceed a predetermined discharge temperature threshold and controls an opening degree of the refrigerant-return expansion valve so that a temperature of the refrigerant in a portion of the outdoor liquid-refrigerant pipe between the refrigerant cooler and the liquid-pressure adjustment expansion valve becomes a target liquid-pipe temperature.

In this case, as described above, since the flow rate of the refrigerant that is fed from the outdoor liquid-refrigerant pipe to the compressor can be adjusted through the liquid injection pipe by controlling the opening degree of the liquid-injection expansion valve provided in the liquid injection pipe, an increase in the temperature of the refrigerant discharged from the compressor (a discharge temperature of the compressor) can be reliably suppressed. In addition, since the flow rate of the refrigerant that exchanges heat with the refrigerant flowing through the outdoor liquid-refrigerant pipe in the refrigerant cooler can be adjusted by controlling the opening degree of the refrigerant-return expansion valve provided in the refrigerant return pipe, the temperature of the refrigerant in the portion of the outdoor liquid-refrigerant pipe between the refrigerant cooler and the liquid-pressure adjustment expansion valve (a liquid-pipe temperature) can be constant at a target liquid-pipe temperature. Since the liquid-pipe temperature is constant, the refrigerant flowing through the liquid-refrigerant connection pipe after the refrigerant has been decompressed by the liquid-pressure adjustment expansion valve can be reliably maintained in a desirable gas-liquid two-phase state. When the refrigerant is transported in the two-phase state using the liquid-pressure adjustment expansion valve, the refrigerant return pipe and the refrigerant cooler are used to maintain the liquid-pipe temperature to be constant, and the liquid injection pipe is used to suppress an increase in the discharge temperature of the compressor.

An air conditioner according to a seventeenth aspect of the present invention is the air conditioner according to the eleventh or thirteenth aspect of the present invention, in which a liquid relief valve that feeds the refrigerant branched from the outdoor liquid-refrigerant pipe to the accumulator is provided in a portion of the liquid injection pipe or the refrigerant return pipe that is connected to the portion of the suction refrigerant pipe on the inlet side of the accumulator. A controller that controls a component of the outdoor unit and the indoor units controls the liquid relief valve so that a pressure of the refrigerant discharged from the compressor does not exceed a predetermined discharge pressure threshold.

In this case, as described above, since the refrigerant can be fed from the outdoor liquid-refrigerant pipe to the accumulator via the liquid injection pipe or the refrigerant return pipe by controlling the liquid relief valve provided in the portion of the liquid injection pipe or the refrigerant return pipe connected to the inlet side of the accumulator, an increase in the pressure of the refrigerant discharged from the compressor (a discharge pressure of the compressor) can be suppressed.

An air conditioner according to an eighteenth aspect of the present invention is the air conditioner according to any one of the fourteenth to seventeenth aspect of the present invention, in which the control unit controls an opening degree of the liquid-pressure adjustment expansion valve so that a degree of subcooling of the refrigerant at the liquid-side end of the outdoor heat exchanger becomes a target degree of subcooling, to cause the liquid-pressure adjustment expansion valve to decompress the refrigerant flowing through the liquid-refrigerant connection pipe to be in the gas-liquid two-phase state.

In this case, as described above, since the opening degree of the liquid-pressure adjustment expansion valve is controlled so that the degree of subcooling of the refrigerant at the liquid-side end of the outdoor heat exchanger becomes the target degree of subcooling, the holding refrigerant amount of the outdoor heat exchanger can be easily maintained in a desirable state, and consequently, the refrigerant flowing through the liquid-refrigerant connection pipe after the refrigerant has been decompressed by the liquid-pressure adjustment expansion valve can be easily maintained in a desirable gas-liquid two-phase state.

DESCRIPTION OF EMBODIMENTS

Air conditioners according to embodiments of the present invention are described below with reference to the drawings. Note that specific configurations of the air conditioners according to embodiments of the present invention are not limited to those described in the following embodiments and modifications thereof, and may be changed within the scope of the present invention.

(1) First Embodiment

<Configuration>

Figure 1:
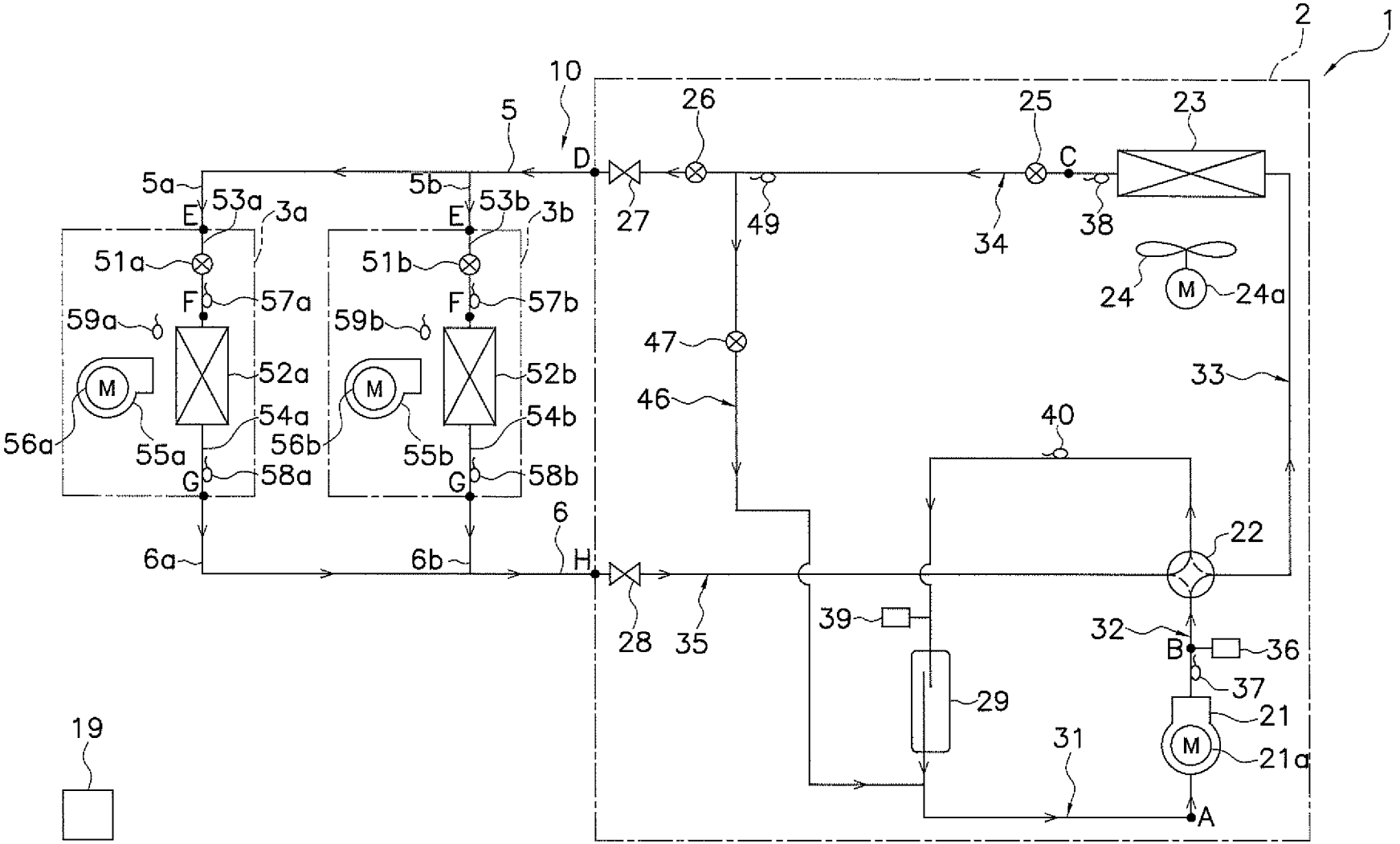
FIG. 1 is a schematic configuration diagram of an air conditioner according to a first embodiment of the present invention.

FIG. 1 is a schematic configuration diagram of an air conditioner 1 according to a first embodiment of the present invention. The air conditioner 1 is an apparatus that performs cooling and heating in a room of a building or the like through a vapor compression refrigeration cycle. The air conditioner 1 mainly includes an outdoor unit 2, a plurality of (in this case, two) indoor units 3*a* and 3*b* that are mutually connected in parallel, a liquid-refrigerant connection pipe 5 and a gas-refrigerant connection pipe 6 that connect the outdoor unit 2 to the indoor units 3*a* and 3*b*, and a control unit 19 that controls components of the outdoor unit 2 and the indoor units 3*a* and 3*b*. A vapor compression refrigerant circuit 10 of the air conditioner 1 is defined by connecting the outdoor unit 2 to the plurality of indoor units 3*a* and 3*b* via the liquid-refrigerant connection pipe 5 and the gas-refrigerant connection pipe 6. The refrigerant circuit 10 is filled with a refrigerant such as R32.

—Connection Pipes—

The liquid-refrigerant connection pipe 5 mainly includes a joint pipe portion extending from the outdoor unit 2 and branch pipe portions 5*a* and 5*b* that are a plurality of (in this case, two) branched pipe portions branched before the indoor units 3*a* and 3*b*. The gas-refrigerant connection pipe 6 mainly includes a joint pipe portion extending from the outdoor unit 2 and branch pipe portions 6*a* and 6*b* that are a plurality of (in this case, two) branched pipe portions branched before the indoor units 3*a* and 3*b*.

—Indoor Units—

The indoor units 3*a* and 3*b* are installed in rooms of the building or the like. The indoor units 3*a* and 3*b* are connected to the outdoor unit 2 via the liquid-refrigerant connection pipe 5 and the gas-refrigerant connection pipe 6 and constitute part of the refrigerant circuit 10 as described above.

Configurations of the indoor units 3*a* and 3*b* are described next. Since the configurations of the indoor units 3*a* and 3*b* are similar to each other, the configuration of the indoor unit 3*a* is described here. For the configuration of the indoor unit 3*b*, a letter "b" is applied to each component of the indoor unit 3*b* instead of a letter "a" indicative of each component of the indoor unit 3*a*, and the description of each component of the indoor unit 3*b* is omitted.

The indoor unit 3*a* mainly includes an indoor expansion valve 51*a* and an indoor heat exchanger 52*a*. The indoor unit 3*a* also includes an indoor liquid-refrigerant pipe 53*a* that connects a liquid-side end of the indoor heat exchanger 52*a* to the liquid-refrigerant connection pipe 5, and an indoor gas-refrigerant pipe 54*a* that connects a gas-side end of the indoor heat exchanger 52*a* to the gas-refrigerant connection pipe 6.

The indoor expansion valve 51*a* is an electrically powered expansion valve that adjusts the flow rate of the refrigerant flowing in the indoor heat exchanger 52*a* while decompressing the refrigerant, and is provided in the indoor liquid-refrigerant pipe 53*a*.

The indoor heat exchanger 52*a* is a heat exchanger that functions as an evaporator of the refrigerant to cool indoor air, or that functions as a radiator of the refrigerant to heat the indoor air. The indoor unit 3*a* includes an indoor fan 55*a* that sucks the indoor air into the indoor unit 3*a*, that allows the indoor heat exchanger 52*a* to exchange heat with the refrigerant, and then that supplies the indoor air as supply air into the room. That is, the indoor unit 3*a* includes the indoor fan 55*a* as a fan that supplies the indoor air, which serves as a cooling source or a heating source of the refrigerant flowing in the indoor heat exchanger 52*a*, to the indoor heat exchanger 52*a*. The indoor fan 55*a* is driven by an indoor fan motor 56*a*.

The indoor unit 3*a* is provided with various sensors. More specifically, the indoor unit 3*a* is provided with an indoor heat-exchanger liquid-side sensor 57*a* that detects a temperature Trl of the refrigerant at the liquid-side end of the indoor heat exchanger 52*a*, an indoor heat-exchanger gas-side sensor 58*a* that detects a temperature Trg of the refrigerant at the gas-side end of the indoor heat exchanger 52*a*, and an indoor air sensor 59*a* that detects a temperature Tra of the indoor air which is sucked into the indoor unit 3*a*.

—Outdoor Unit—

The outdoor unit 2 is installed outside the rooms of the building or the like. The outdoor unit 2 is connected to the indoor units 3*a* and 3*b* via the liquid-refrigerant connection pipe 5 and the gas-refrigerant connection pipe 6 and constitutes part of the refrigerant circuit 10 as described above.

A configuration of the outdoor unit 2 is described next.

The outdoor unit 2 mainly includes a compressor 21 and an outdoor heat exchanger 23. The outdoor unit 2 also includes a switching mechanism 22 that switches between a radiation operation state in which the outdoor heat exchanger 23 functions as a radiator of the refrigerant and an evaporation operation state in which the outdoor heat exchanger 23 functions as an evaporator of the refrigerant. The switching mechanism 22 and a suction side of the compressor 21 are connected by a suction refrigerant pipe 31. The suction refrigerant pipe 31 is provided with an accumulator 29 that temporarily stores the refrigerant to be sucked into the compressor 21. A discharge side of the compressor 21 and the switching mechanism 22 are connected by a discharge refrigerant pipe 32. The switching mechanism 22 and a gas-side end of the outdoor heat exchanger 23 are connected by a first outdoor gas-refrigerant pipe 33. A liquid-side end of the outdoor heat exchanger 23 and the liquid-refrigerant connection pipe 5 are connected by an outdoor liquid-refrigerant pipe 34. A liquid-side shutoff valve 27 is provided at a connection portion between the outdoor liquid-refrigerant pipe 34 and the liquid-refrigerant connection pipe 5. The switching mechanism 22 and the gas-refrigerant connection pipe 6 are connected by a second outdoor gas-refrigerant pipe 35. A gas-side shutoff valve 28 is provided at a connection portion between the second outdoor gas-refrigerant pipe 35 and the gas-refrigerant connection pipe 6. The liquid-side shutoff valve 27 and the gas-side shutoff valve 28 are valves that are manually opened and closed.

The compressor 21 is a device that compresses a refrigerant. For example, a closed-structure compressor in which a rotary or scroll positive-displacement compression element (not illustrated) is rotationally driven by a compressor motor 21*a* is used.

The switching mechanism 22 is a device capable of switching the flow of the refrigerant in the refrigerant circuit 10 to connect the discharge side of the compressor 21 and the gas side of the outdoor heat exchanger 23 (see solid lines of the switching mechanism 22 in FIG. 1) when the outdoor heat exchanger 23 functions as a radiator of the refrigerant (referred to as "outdoor radiation state" hereinafter) and to connect the suction side of the compressor 21 and the gas side of the outdoor heat exchanger 23 (see broken lines of the switching mechanism 22 in FIG. 1) when the outdoor heat exchanger 23 functions as an evaporator of the refrigerant (referred to as "outdoor evaporation state" hereinafter). The switching mechanism 22 is, for example, a four-way switching valve.

The outdoor heat exchanger 23 is a heat exchanger that functions as a radiator of the refrigerant or an evaporator of the refrigerant. The outdoor unit 2 includes an outdoor fan 24 that sucks outdoor air into the outdoor unit 2, that allows the outdoor air to exchange heat with the refrigerant in the outdoor heat exchanger 23, and then that discharges the outdoor air to the outside. That is, the outdoor unit 2 includes the outdoor fan 24 as a fan that supplies the outdoor air, which serves as a cooling source or a heating source of the refrigerant flowing in the outdoor heat exchanger 23, to the outdoor heat exchanger 23. The outdoor fan 24 is driven by an outdoor fan motor 24*a*.

Focusing only on the compressor 21, the outdoor heat exchanger 23, the liquid-refrigerant connection pipe 5, and the indoor heat exchangers 52*a* and 52*b*, the air conditioner 1 performs an operation (cooling operation) of sending the refrigerant, which has been discharged from the compressor 21, to the outdoor heat exchanger 23, the liquid-refrigerant connection pipe 5, and the indoor heat exchangers 52*a* and 52*b* in that order. Focusing only on the compressor 21, the gas-refrigerant connection pipe 6, the indoor heat exchangers 52*a* and 52*b*, the liquid-refrigerant connection pipe 5, and the outdoor heat exchanger 23, the air conditioner 1 performs an operation (heating operation) of sending the refrigerant, which has been discharged from the compressor 21, to the gas-refrigerant connection pipe 6, the indoor heat exchangers 52*a* and 52*b*, the liquid-refrigerant connection pipe 5, and the outdoor heat exchanger 23 in that order. The switching mechanism 22 is switched to the outdoor radiation state during cooling operation, and the switching mechanism 22 is switched to the outdoor evaporation state during heating operation.

The outdoor liquid-refrigerant pipe 34 is provided with an outdoor expansion valve 25 and a liquid-pressure adjustment expansion valve 26. The outdoor expansion valve 25 is an electrically powered expansion valve that decompresses the refrigerant during heating operation, and is provided in a portion of the outdoor liquid-refrigerant pipe 34 close to the liquid-side end of the outdoor heat exchanger 23. The liquid-pressure adjustment expansion valve 26 is an electrically powered expansion valve that decompresses the refrigerant so that the refrigerant flowing through the liquid-refrigerant connection pipe 5 is in a gas-liquid two-phase state during cooling operation, and is provided in a portion of the outdoor liquid-refrigerant pipe 34 close to the liquid-refrigerant connection pipe 5. That is, the liquid-pressure adjustment expansion valve 26 is provided in a portion of the outdoor liquid-refrigerant pipe 34 close to the liquid-refrigerant connection pipe 5 with respect to the outdoor expansion valve 25.

During cooling operation, the air conditioner 1 transports the refrigerant in the two-phase state by sending the refrigerant in the gas-liquid two-phase state to the liquid-refrigerant connection pipe 5 and feeding the refrigerant from the outdoor unit 2 to the indoor units 3*a* and 3*b* using the liquid-pressure adjustment expansion valve 26.

In addition, a liquid injection pipe 46 that branches part of the refrigerant flowing through the outdoor liquid-refrigerant pipe 34 and feeds the branched refrigerant to the compressor 21 is connected to the outdoor liquid-refrigerant pipe 34. The liquid injection pipe 46 is connected to a portion of the outdoor liquid-refrigerant pipe 34 on the side of the outdoor heat exchanger 23 with respect to the liquid-pressure adjustment expansion valve 26. More specifically, the liquid injection pipe 46 is connected to a portion of the outdoor liquid-refrigerant pipe 34 between the outdoor expansion valve 25 and the liquid-pressure adjustment expansion valve 26. The liquid injection pipe 46 is connected to the suction refrigerant pipe 31 through which the refrigerant to be sucked into the compressor 21 flows. The liquid injection pipe 46 is connected to a portion of the suction refrigerant pipe 31 on an outlet side of the accumulator 29. The liquid injection pipe 46 is provided with a liquid-injection expansion valve 47 that decompresses the refrigerant branched from the outdoor liquid-refrigerant pipe 34. The liquid-injection expansion valve 47 is an electrically powered expansion valve.

The outdoor unit 2 is provided with various sensors. More specifically, the outdoor unit 2 is provided with a discharge pressure sensor 36 that detects a pressure (discharge pressure Pd) of the refrigerant discharged from the compressor 21, a discharge temperature sensor 37 that detects a temperature (discharge temperature Td) of the refrigerant discharged from the compressor 21, a suction pressure sensor 39 that detects a pressure (suction pressure Ps) of the refrigerant to be sucked into the compressor 21, and a suction temperature sensor 40 that detects a temperature (suction temperature Ts) of the refrigerant to be sucked into the compressor 21. In addition, the outdoor unit 2 is provided with an outdoor heat-exchanger liquid-side sensor 38 that detects a temperature Tol (outdoor heat-exchanger outlet temperature Tol) of the refrigerant at the liquid-side end of the outdoor heat exchanger 23, and a liquid-pipe temperature sensor 49 that detects a temperature (liquid-pipe temperature Tlp) of the refrigerant in a portion of the outdoor liquid-refrigerant pipe 34 between the outdoor expansion valve 25 and the liquid-pressure adjustment expansion valve 26.

—Control Unit—

The control unit 19 is connected to control boards or the like (not illustrated) that are provided in the outdoor unit 2 and the indoor units 3*a* and 3*b* for communication. In FIG. 1, the control unit 19 is illustrated at a position separated from the outdoor unit 2 and the indoor units 3*a* and 3*b* for the convenience of illustration. The control unit 19 controls the various components 21, 22, 24, 25, 26, 47, 51*a*, 51*b*, 55*a*, and 55*b* of the air conditioner 1 (in this case, the outdoor unit 2 and the indoor units 3*a* and 3*b*) on the basis of detection signals or the like of the above-described various sensors 36, 37, 38, 39, 40, 49, 57*a*, 57*b*, 58*a*, 58*b*, 59*a*, and 59*b*. That is, the control unit 19 controls the entire operation of the air conditioner 1.

<Operations and Features of Air Conditioner>

Figure 2:
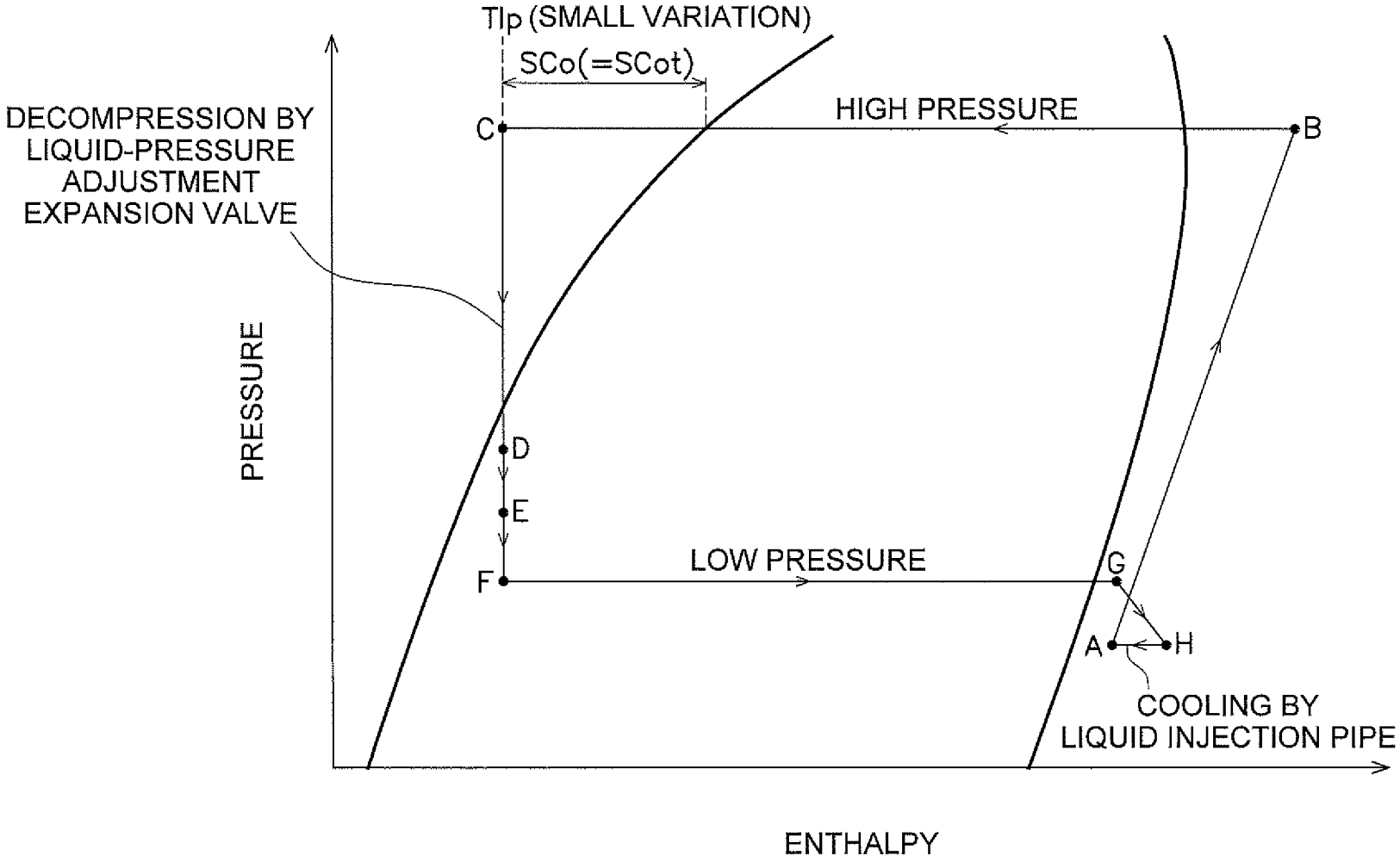
FIG. 2 is a pressure-enthalpy chart showing a refrigeration cycle during cooling operation in the air conditioner according to the first embodiment of the present invention.

Operations and features of the air conditioner 1 are described next with reference to FIGS. 1 and 2. FIG. 2 is a pressure-enthalpy chart showing a refrigeration cycle during cooling operation in the air conditioner 1 according to the first embodiment of the present invention.

The air conditioner 1 performs cooling operation and heating operation as described above. During cooling operation, the refrigerant is transported in the two-phase state by sending the refrigerant in the gas-liquid two-phase state to the liquid-refrigerant connection pipe 5 and feeding the refrigerant from the outdoor unit 2 to the indoor units 3*a* and 3*b* using the liquid-pressure adjustment expansion valve 26 provided in the outdoor liquid-refrigerant pipe 34. Further, during cooling operation, an operation is performed to feed the refrigerant to the compressor 21 while suppressing a variation in the temperature (liquid-pipe temperature Tlp) of the refrigerant flowing through the outdoor liquid-refrigerant pipe 34 using the liquid injection pipe 46 that branches part of the refrigerant flowing through the outdoor liquid-refrigerant pipe 34 from the portion of the outdoor liquid-refrigerant pipe 34 on the side of the outdoor heat exchanger 23 with respect to the liquid-pressure adjustment expansion valve 26 and feeds the branched refrigerant to the compressor 21. Note that the control unit 19 that controls the components of the air conditioner 1 performs the operations of the air conditioner 1 which will be described below.

—Cooling Operation—

For cooling operation, for example, when all the indoor units 3*a* and 3*b* perform cooling operation (that is, operation in which all the indoor heat exchangers 52*a* and 52*b* function as evaporators of the refrigerant and the outdoor heat exchanger 23 functions as a radiator of the refrigerant), the switching mechanism 22 is switched to the outdoor radiation state (the state indicated by solid lines of the switching mechanism 22 in FIG. 1), and the compressor 21, the outdoor fan 24, and the indoor fans 55*a* and 55*b* are driven.

Then, the refrigerant at a high pressure discharged from the compressor 21 is fed to the outdoor heat exchanger 23 via the switching mechanism 22 (see point B in FIGS. 1 and 2). The refrigerant fed to the outdoor heat exchanger 23 exchanges heat with the outdoor air supplied by the outdoor fan 24, and hence is cooled and condensed in the outdoor heat exchanger 23 that functions as the radiator of the refrigerant (see point C in FIGS. 1 and 2). The refrigerant flows out from the outdoor unit 2 via the outdoor expansion valve 25, the liquid-pressure adjustment expansion valve 26, and the liquid-side shutoff valve 27 (see point D in FIGS. 1 and 2).

The refrigerant flowing out from the outdoor unit 2 is branched and fed to the indoor units 3*a* and 3*b* via the liquid-refrigerant connection pipe 5 (see point E in FIGS. 1 and 2). The refrigerants fed to the indoor units 3*a* and 3*b* are decompressed to a low pressure by the indoor expansion valves 51*a* and 51*b* and then are fed to the indoor heat exchangers 52*a* and 52*b* (see point F in FIGS. 1 and 2). The refrigerants fed to the indoor heat exchangers 52*a* and 52*b* exchange heat with the indoor air supplied from the inside of the rooms by the indoor fans 55*a* and 55*b*, and hence are heated and evaporated in the indoor heat exchangers 52*a* and 52*b* that function as the evaporators of the refrigerant (see point G in FIGS. 1 and 2). The refrigerants flow out from the indoor units 3*a* and 3*b*. In contrast, the indoor air cooled in the indoor heat exchangers 52*a* and 52*b* is fed into the rooms, and thus the rooms are cooled.

The refrigerants flowing out from the indoor units 3*a* and 3*b* are joined and fed to the outdoor unit 2 via the gas-refrigerant connection pipe 6 (see point H in FIGS. 1 and 2). The refrigerant fed to the outdoor unit 2 is sucked into the compressor 21 via the gas-side shutoff valve 28, the switching mechanism 22, and the accumulator 29 (see point A in FIGS. 1 and 2).

During the above-described cooling operation, the refrigerant is transported in the two-phase state by sending the refrigerant in the gas-liquid two-phase state to the liquid-refrigerant connection pipe 5 and feeding the refrigerant from the outdoor unit 2 to the indoor units 3*a* and 3*b* using the liquid-pressure adjustment expansion valve 26. In addition, as described below, when the refrigerant is to be transported in the two-phase state, the refrigerant is properly transported in the two-phase state while suppressing an increase in the discharge temperature Td of the compressor 21 using the liquid injection pipe 46.

First, the control unit 19 controls the liquid-pressure adjustment expansion valve 26 to decompress the refrigerant so that the refrigerant flowing through the liquid-refrigerant connection pipe 5 is in the gas-liquid two-phase state (see points C and D in FIGS. 1 and 2). The refrigerant decompressed by the liquid-pressure adjustment expansion valve 26 is a refrigerant at an intermediate pressure that is lower than the pressure of a refrigerant at a high pressure and is higher than the pressure of a refrigerant at a low pressure (see point D in FIGS. 1 and 2). The control unit 19 controls the opening degree of the liquid-pressure adjustment expansion valve 26 so that a degree of subcooling SCo of the refrigerant at the liquid-side end of the outdoor heat exchanger 23 becomes a target degree of subcooling SCot. More specifically, the control unit 19 obtains the degree of subcooling SCo of the refrigerant at the liquid-side end of the outdoor heat exchanger 23 from the outdoor heat-exchanger outlet temperature Tol. The control unit 19 obtains the degree of subcooling SCo of the refrigerant at the liquid-side end of the outdoor heat exchanger 23 by subtracting the outdoor heat-exchanger outlet temperature Tol from a temperature Toc of the refrigerant obtained by converting the discharge pressure Pd into a saturation temperature. The control unit 19 performs control to increase the opening degree of the liquid-pressure adjustment expansion valve 26 if the degree of subcooling SCo is larger than the target degree of subcooling SCot, and performs control to decrease the opening degree of the liquid-pressure adjustment expansion valve 26 if the degree of subcooling SCo is smaller than the target degree of subcooling SCot. Note that, in this case, the control unit 19 performs control to fix the opening degree of the outdoor expansion valve 25 in a full-open state.

With this control, the state of the refrigerant flowing through the liquid-refrigerant connection pipe 5 becomes the gas-liquid two-phase state. The liquid-refrigerant connection pipe 5 is not filled with the refrigerant in a liquid state unlike a case where the refrigerant flowing through the liquid-refrigerant connection pipe 5 is in a liquid state. The amount of the refrigerant existing in the liquid-refrigerant connection pipe 5 can be decreased by that amount.

In addition, the control unit 19 branches part of the refrigerant flowing through the outdoor liquid-refrigerant pipe 34 to suppress an increase in the discharge temperature Td of the compressor 21 and feeds the branched refrigerant to the compressor 21 (in this case, the suction refrigerant pipe 31 connected to the suction side of the compressor 21). The control unit 19 controls the opening degree of the liquid-injection expansion valve 47 so that the discharge temperature Td of the compressor 21 does not exceed a predetermined discharge temperature threshold Tdx (for example, upper-limit discharge temperature). More specifically, when the discharge temperature Td has increased above the discharge temperature threshold Tdx, the control unit 19 performs control to increase the opening degree of the liquid-injection expansion valve 47 until the discharge temperature Td becomes the discharge temperature threshold Tdx or lower.

With this control, the refrigerants fed from the indoor units 3*a* and 3*b* to the outdoor unit 2 (point H in FIGS. 1 and 2) are joined to the refrigerant to be fed to the compressor 21 via the liquid injection pipe 46 and is cooled (see points H and A in FIGS. 1 and 2). Thus, an increase in the discharge temperature Td of the compressor 21 can be suppressed by that cooled amount (see point B in FIGS. 1 and 2).

—Heating Operation—

For heating operation, for example, when all the indoor units 3*a* and 3*b* perform heating operation (that is, operation in which all the indoor heat exchangers 52*a* and 52*b* function as radiators of the refrigerant and the outdoor heat exchanger 23 functions as an evaporator of the refrigerant), the switching mechanism 22 is switched to the outdoor evaporation state (the state indicated by broken lines of the switching mechanism 22 in FIG. 1), and the compressor 21, the outdoor fan 24, and the indoor fans 55*a* and 55*b* are driven.

The refrigerant at a high pressure discharged from the compressor 21 flows out from the outdoor unit 2 via the switching mechanism 22 and the gas-side shutoff valve 28.

The refrigerant flowing out from the outdoor unit 2 is branched and fed to the indoor units 3*a* and 3*b* via the gas-refrigerant connection pipe 6. The refrigerants fed to the indoor units 3*a* and 3*b* are fed to the indoor heat exchangers 52*a* and 52*b*. The refrigerants at a high pressure fed to the indoor heat exchangers 52*a* and 52*b* exchange heat with the indoor air supplied from the inside of the rooms by the indoor fans 55*a* and 55*b*, and hence are cooled and condensed in the indoor heat exchangers 52*a* and 52*b* that function as the radiators of the refrigerant. The refrigerants flow out from the indoor units 3*a* and 3*b* via the indoor expansion valves 51*a* and 51*b*. In contrast, the indoor air heated in the indoor heat exchangers 52*a* and 52*b* is fed into the rooms, and thus the rooms are heated.

The refrigerants flowing out from the indoor units 3*a* and 3*b* are joined and fed to the outdoor unit 2 via the liquid-refrigerant connection pipe 5. The refrigerant fed to the outdoor unit 2 is fed to the outdoor expansion valve 25 via the liquid-side shutoff valve 27 and the liquid-pressure adjustment expansion valve 26. The refrigerant fed to the outdoor expansion valve 25 is decompressed to a low pressure by the outdoor expansion valve 25 and then is fed to the outdoor heat exchanger 23. The refrigerant fed to the outdoor heat exchanger 23 exchanges heat with the outdoor air supplied by the outdoor fan 24, and hence is heated and evaporated. The refrigerant is sucked into the compressor 21 via the switching mechanism 22 and the accumulator 29.

In this case, the control unit 19 performs control to fix the opening degree of the liquid-pressure adjustment expansion valve 26 in a full-open state. With this control, the opening degree of the liquid-injection expansion valve 47 is in a full-closed state so as not to send the refrigerant to the liquid injection pipe 46.

—Features—

In the configuration in which the refrigerant is transported in the two-phase state by sending the refrigerant in the gas-liquid two-phase state to the liquid-refrigerant connection pipe 5 and feeding the refrigerant from the outdoor unit 2 to the indoor units 3*a* and 3*b* using the liquid-pressure adjustment expansion valve 26, as described above, the liquid injection pipe 46 is further provided in the portion of the outdoor liquid-refrigerant pipe 34 on the side of the outdoor heat exchanger 23 with respect to the liquid-pressure adjustment expansion valve 26 to branch part of the refrigerant flowing through the outdoor liquid-refrigerant pipe 34 and feed the refrigerant to the compressor 21. Since the liquid injection pipe 46 is provided, the refrigerant can be fed to the compressor 21 (see point C in FIG. 2) while a variation in the temperature (liquid-pipe temperature Tlp) of the refrigerant flowing through the outdoor liquid-refrigerant pipe 34 is suppressed. Thus, an increase in the discharge temperature Td of the compressor 21 can be suppressed (see point B in FIG. 2) while a variation in the state of the refrigerant flowing through the liquid-refrigerant connection pipe 5 after the refrigerant has been decompressed by the liquid-pressure adjustment expansion valve 26 is suppressed (see point D in FIG. 2). Thus, the refrigerant flowing through the liquid-refrigerant connection pipe 5 can be reliably maintained in a desirable gas-liquid two-phase state while an increase in the discharge temperature Td of the compressor 21 is suppressed.

That is, in the configuration having the liquid-pressure adjustment expansion valve 26, since the liquid injection pipe 46 is provided, the refrigerant can be properly transported in the two-phase state while an increase in the discharge temperature Td of the compressor 21 is suppressed.

In addition, the control unit 19 controls the opening degree of the liquid-pressure adjustment expansion valve 26 so that the degree of subcooling SCo of the refrigerant at the liquid-side end of the outdoor heat exchanger 23 becomes the target degree of subcooling SCot, and thus the refrigerant flowing through the liquid-refrigerant connection pipe 5 is decompressed using the liquid-pressure adjustment expansion valve 26 to be in the gas-liquid two-phase state. With such control, the holding refrigerant amount of the outdoor heat exchanger 23 can be easily maintained in a desirable state (see point C in FIG. 2), and consequently, the refrigerant flowing through the liquid-refrigerant connection pipe 5 after the refrigerant has been decompressed by the liquid-pressure adjustment expansion valve 26 can be easily maintained in a desirable gas-liquid two-phase state (see point D in FIG. 2).

In addition, the liquid-injection expansion valve 47 that decompresses the refrigerant branched from the outdoor liquid-refrigerant pipe 34 is provided in the liquid injection pipe 46. The control unit 19 controls the opening degree of the liquid-injection expansion valve 47 so that the discharge temperature Td of the compressor 21 does not exceed the predetermined discharge temperature threshold Tdx (for example, upper-limit discharge temperature). Since the flow rate of the refrigerant that is fed from the outdoor liquid-refrigerant pipe 34 to the compressor 21 can be adjusted through the liquid injection pipe 46, an increase in the discharge temperature Td of the compressor 21 can be reliably suppressed (see point B in FIG. 2).

In addition, the liquid injection pipe 46 is connected to the suction refrigerant pipe 31 through which the refrigerant to be sucked into the compressor 21 flows. Thus, since the refrigerant branched from the outdoor liquid-refrigerant pipe 34 can be fed to the suction side of the compressor 21, the temperature of the refrigerant to be sucked into the compressor 21 can be decreased (see points H and A in FIG. 2). In this case, the liquid injection pipe 46 is connected to the portion of the suction refrigerant pipe 31 on the outlet side of the accumulator 29, and hence the refrigerant flowing through the liquid injection pipe 46 can be joined to the refrigerant to be sucked into the compressor 21 without via the accumulator 29. Thus, the effect of decreasing the temperature of the refrigerant to be sucked into the compressor 21 can be increased as compared with a case where the liquid injection pipe 46 is connected to an inlet side of the accumulator 29.

<First Modification>

In the air conditioner 1 of the above-described first embodiment (see FIG. 1), the liquid injection pipe 46 is connected to the portion of the suction refrigerant pipe 31 on the outlet side of the accumulator 29, and hence the effect of decreasing the temperature of the refrigerant to be sucked into the compressor 21 is increased. However, the connection position of the liquid injection pipe 46 to the suction refrigerant pipe 31 is not limited thereto.

Figure 3:
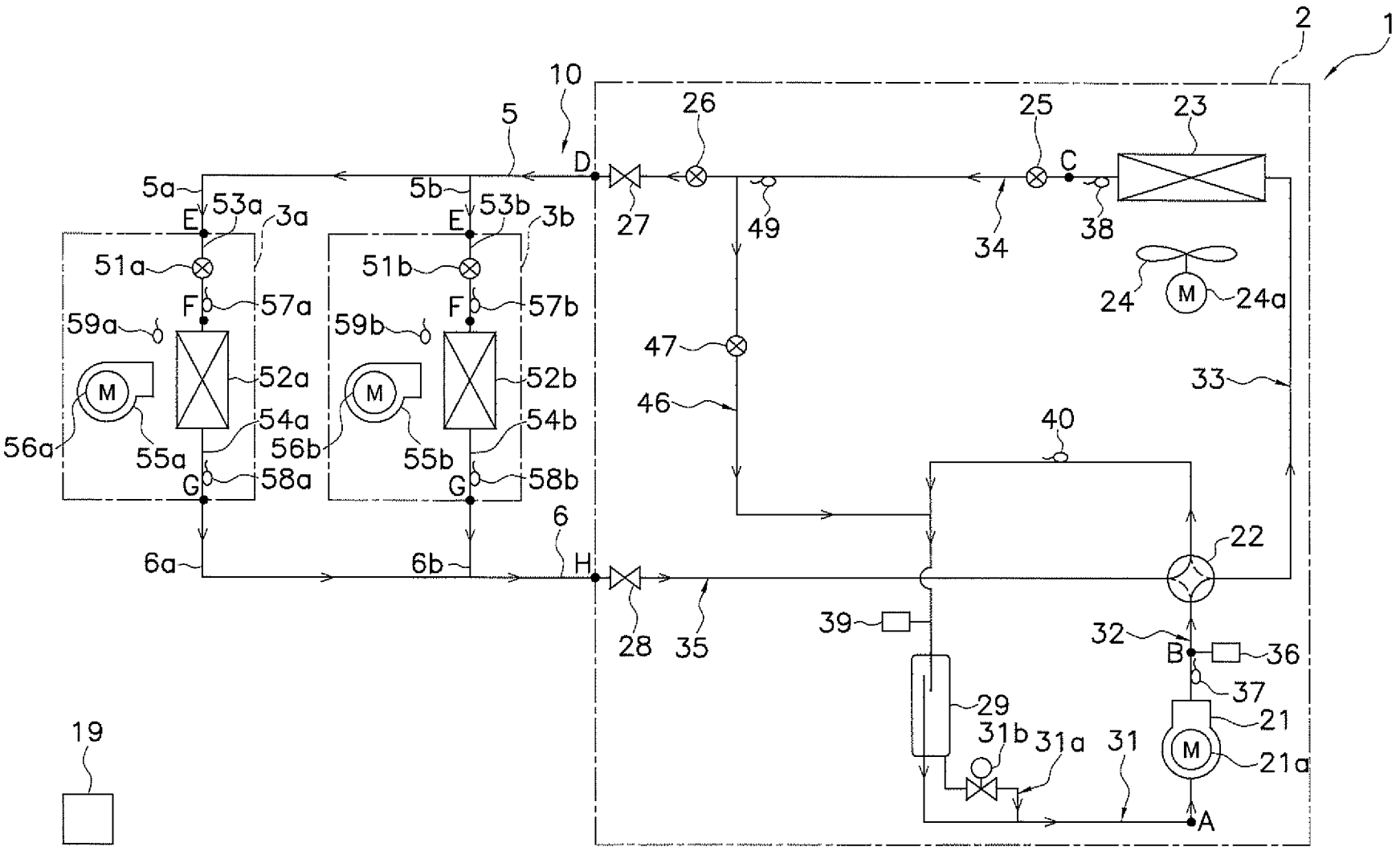
FIG. 3 is a schematic configuration diagram of an air conditioner according to a first modification of the first embodiment of the present invention.

As illustrated in FIG. 3, the liquid injection pipe 46 is connected to a portion of the suction refrigerant pipe 31 on the inlet side of the accumulator 29, and hence the refrigerant flowing through the liquid injection pipe 46 can be joined to the refrigerant to be sucked into the compressor 21 via the accumulator 29. Thus, for example, occurrence of liquid compression in the compressor 21 can be prevented as compared with a case where the liquid injection pipe 46 is connected to the outlet side of the accumulator 29. In this configuration, a return liquid pipe 31*a* that feeds the refrigerant from a bottom portion of the accumulator 29 to a portion of the suction refrigerant pipe 31 on the outlet side of the accumulator 29 may be provided, and the control unit 19 may control a return liquid valve 31*b* provided in the return liquid pipe 31*a* to return the liquid refrigerant stored in the accumulator 29 to the compressor 21.

<Second Modification>

In the air conditioner 1 of the first embodiment and the first modification (see FIGS. 1 and 3), the liquid injection pipe 46 is connected to the portion of the suction refrigerant pipe 31 on the inlet side of the accumulator 29 or the portion of the suction refrigerant pipe 31 on the outlet side of the accumulator 29. However, the connection position of the liquid injection pipe 46 to the suction refrigerant pipe 31 is not limited thereto.

Figure 4:
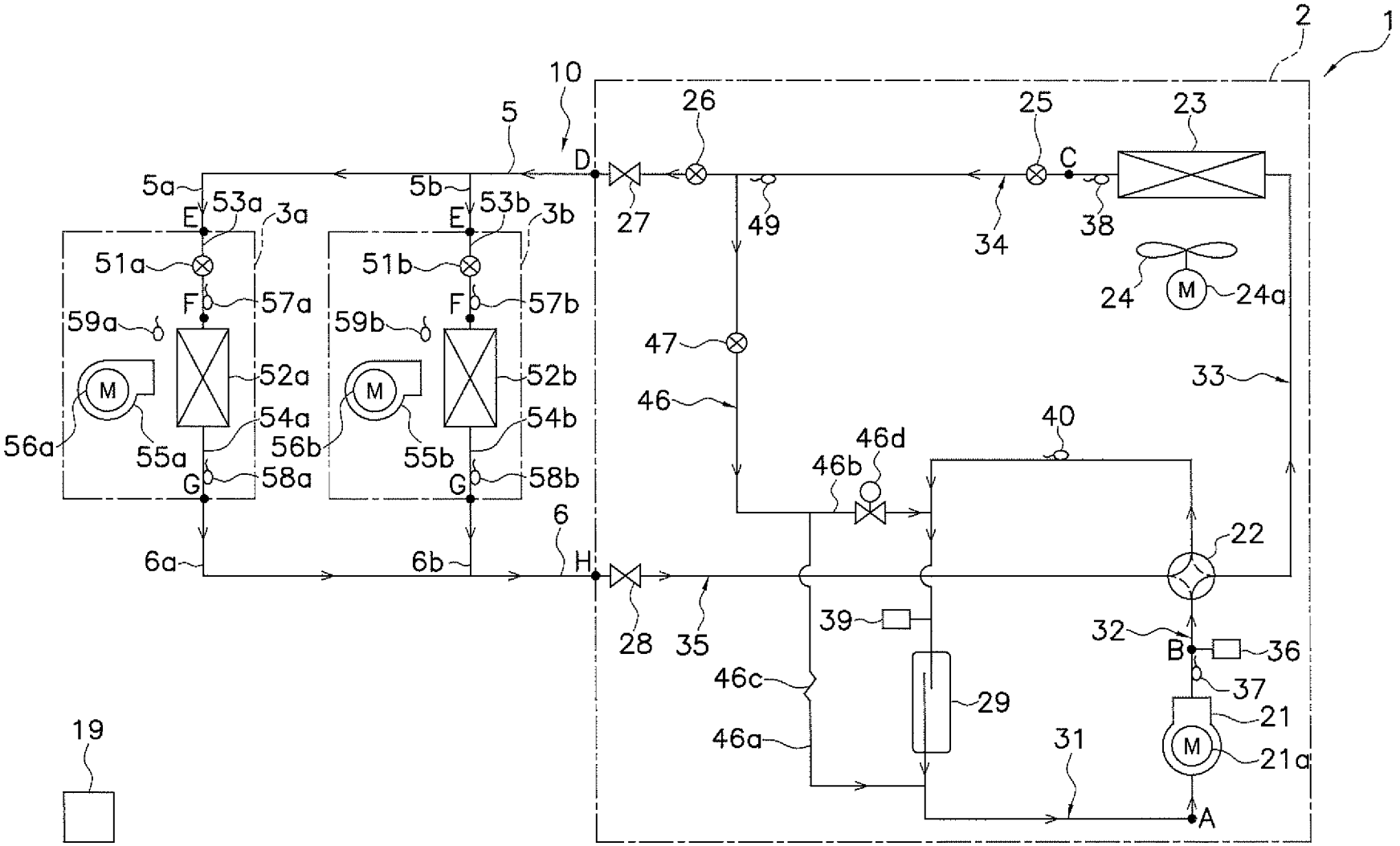
FIG. 4 is a schematic configuration diagram of an air conditioner according to a second modification of the first embodiment of the present invention.

As illustrated in FIG. 4, the liquid injection pipe 46 is bifurcated and connected to both a portion of the suction refrigerant pipe 31 on the inlet side of the accumulator 29 and a portion of the suction refrigerant pipe 31 on the outlet side of the accumulator 29. One of the branched pipes of the liquid injection pipe 46 connected to the portion on the outlet side of the accumulator 29 is referred to as the first liquid injection pipe 46*a*, and the other of the branched pipes of the liquid injection pipe 46 connected to the portion on the inlet side of the accumulator 29 is referred to as the second liquid injection pipe 46*b*. Since the liquid injection pipe 46 is connected to both the inlet side and the outlet side of the accumulator 29, the refrigerant flowing through the liquid injection pipe 46 may be fed to the outlet side of the accumulator 29 to increase the effect of decreasing the temperature of the refrigerant to be sucked into the compressor 21, and the refrigerant flowing through the liquid injection pipe 46 may be fed to the inlet side of the accumulator 29, for example, to prevent occurrence of liquid compression in the compressor 21.

In addition, by using the configuration in which the liquid injection pipe 46 in FIG. 4 is bifurcated and connected to both the portions of the suction refrigerant pipe 31 on the inlet side of the accumulator 29 and on the outlet side of the accumulator 29, an increase in the discharge pressure Pd of the compressor 21 can be suppressed. More specifically, a liquid relief valve 46*d* is provided in the second liquid injection pipe 46*b* of the liquid injection pipe 46 connected to the portion on the inlet side of the accumulator 29. The liquid relief valve 46*d* is controlled so that the discharge pressure Pd of the compressor 21 does not exceed a predetermined discharge pressure threshold Pdx (for example, upper-limit discharge pressure). More specifically, when the discharge pressure Pd has increased above the discharge pressure threshold Pdx, the control unit 19 performs control to open the liquid relief valve 46*d* until the discharge pressure Pd becomes the discharge pressure threshold Pdx or lower. Thus, the liquid refrigerant existing in the outdoor heat exchanger 23 can be fed to and retracted in the accumulator 29 via the liquid injection pipe 46. Consequently, an increase in the discharge pressure Pd can be suppressed. Since the refrigerant can be fed from the outdoor liquid-refrigerant pipe 34 to the accumulator 29 via the liquid injection pipe 46 by controlling the liquid relief valve 46*d* provided in the second liquid injection pipe 46*b* of the liquid injection pipe 46 connected to the portion on the inlet side of the accumulator 29, an increase in the discharge pressure Pd of the compressor 21 can be suppressed. In this configuration, a capillary tube 46*c* serving as a flow resistance is provided in the first liquid injection pipe 46*a* so as to send the refrigerant to the second liquid injection pipe 46*b* more during the liquid relief control.

<Third Modification>

In the air conditioner 1 of the first embodiment (see FIG. 1), since the liquid injection pipe 46 is connected to the suction refrigerant pipe 31, the refrigerant branched from the outdoor liquid-refrigerant pipe 34 is fed to the suction side of the compressor 21 to decrease the temperature of the refrigerant to be sucked into the compressor 21 (see points H and A in FIG. 2) and thus suppress an increase in the discharge temperature Td of the compressor 21. However, the feeding destination of the refrigerant flowing through the liquid injection pipe 46 to the compressor 21 is not limited thereto.

Figure 5:
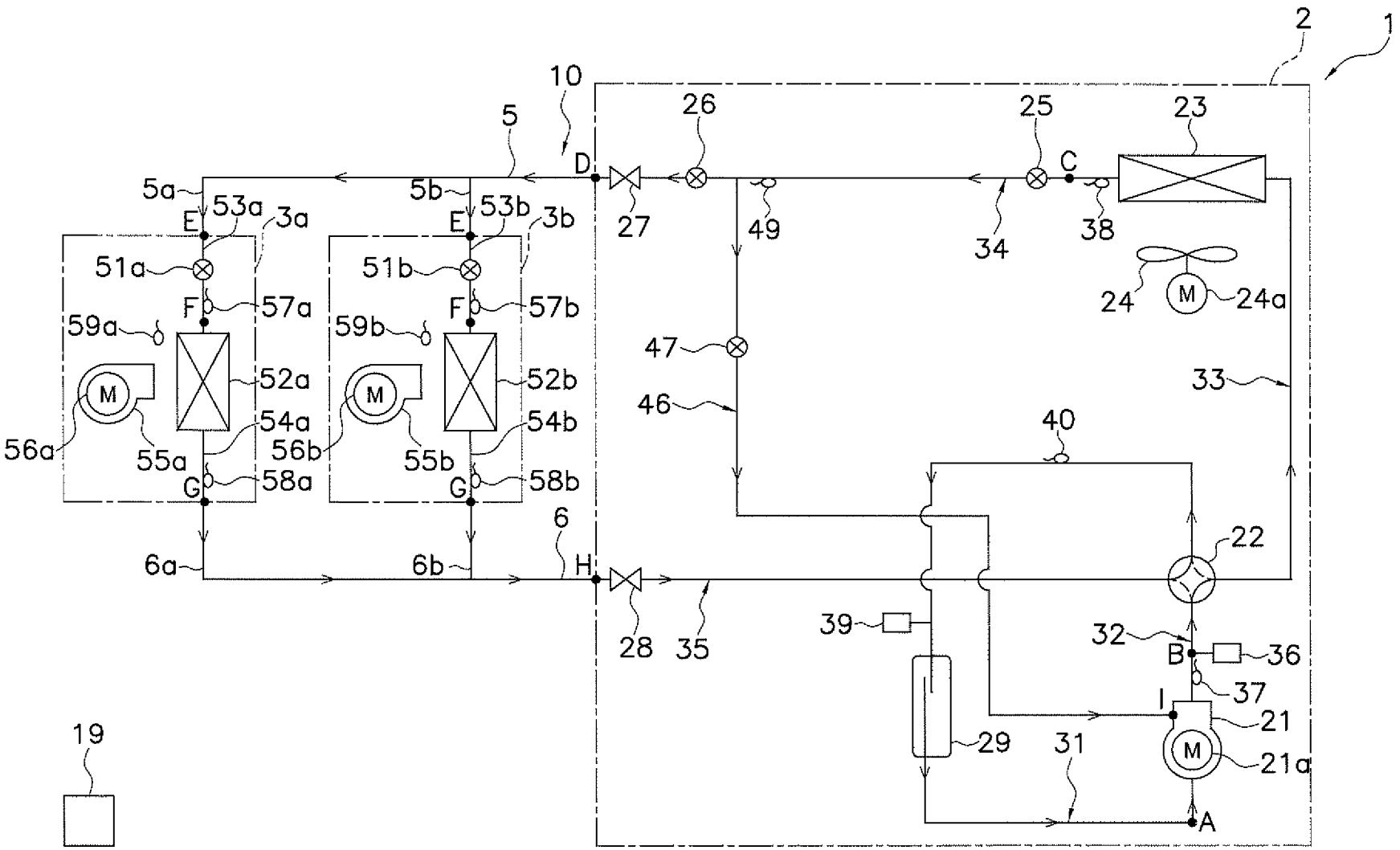
FIG. 5 is a schematic configuration diagram of an air conditioner according to a third modification of the first embodiment of the present invention.

As illustrated in FIG. 5, the liquid injection pipe 46 may be connected to an intermediate portion of a compression stroke of the compressor 21.

Figure 6:
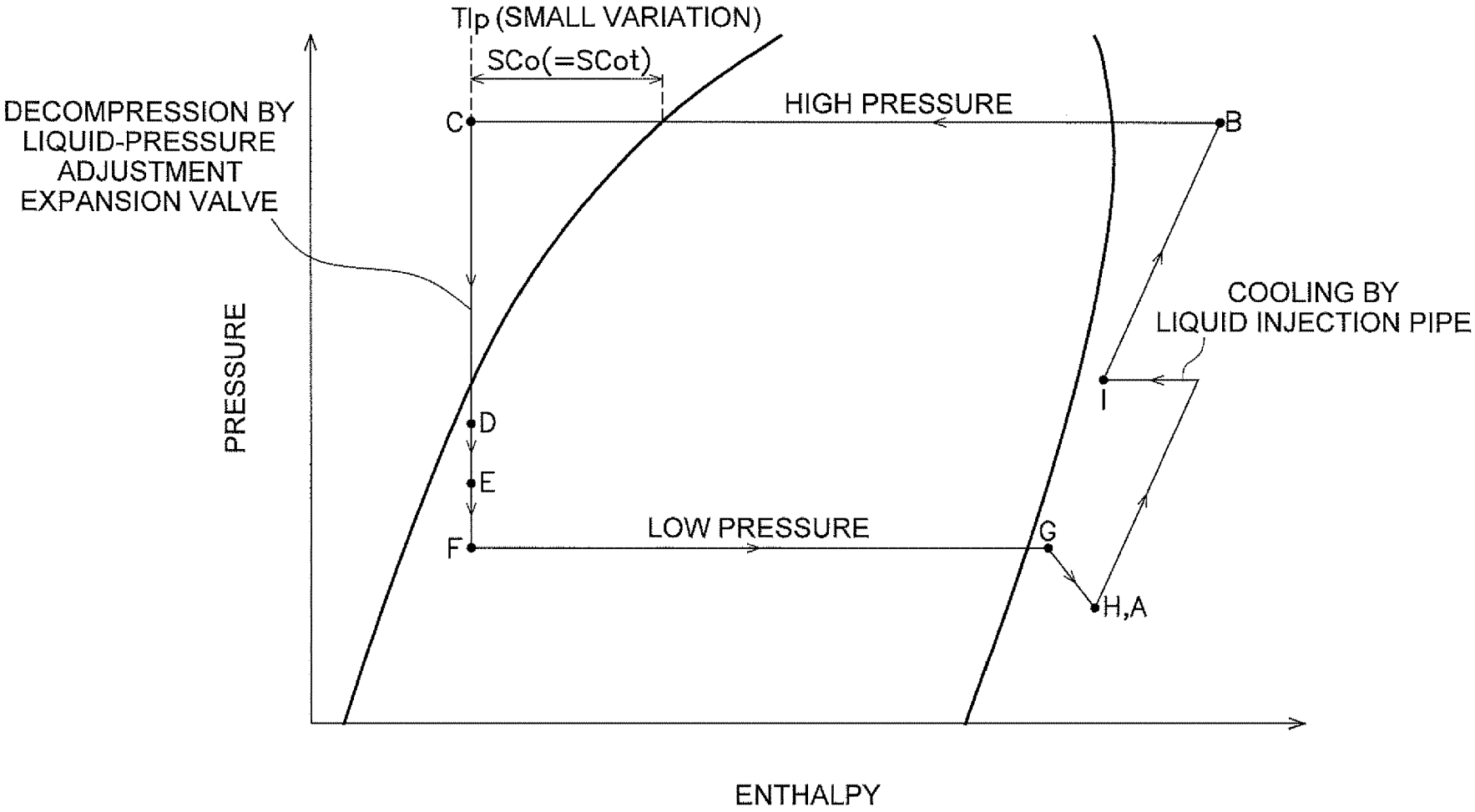
FIG. 6 is a pressure-enthalpy chart showing a refrigeration cycle during cooling operation in the air conditioner according to the third modification of the first embodiment of the present invention.

With the configuration, unlike the first embodiment (see points H and A in FIG. 2), as illustrated in FIGS. 5 and 6, an increase in the discharge temperature Td of the compressor 21 can be suppressed by feeding the refrigerant, which has been branched from the outdoor liquid-refrigerant pipe 34 to the liquid injection pipe 46, to the intermediate portion of the compression stroke of the compressor 21 and decreasing the temperature of the refrigerant, which has been compressed to an intermediate pressure in the compressor 21 (see point I in FIG. 6). Even in this case, the control and so forth on the liquid-pressure adjustment expansion valve 26 for transporting the refrigerant in the two-phase state is similar to that of the first embodiment, and hence the description is omitted here.

<Fourth Modification>

Figure 7:
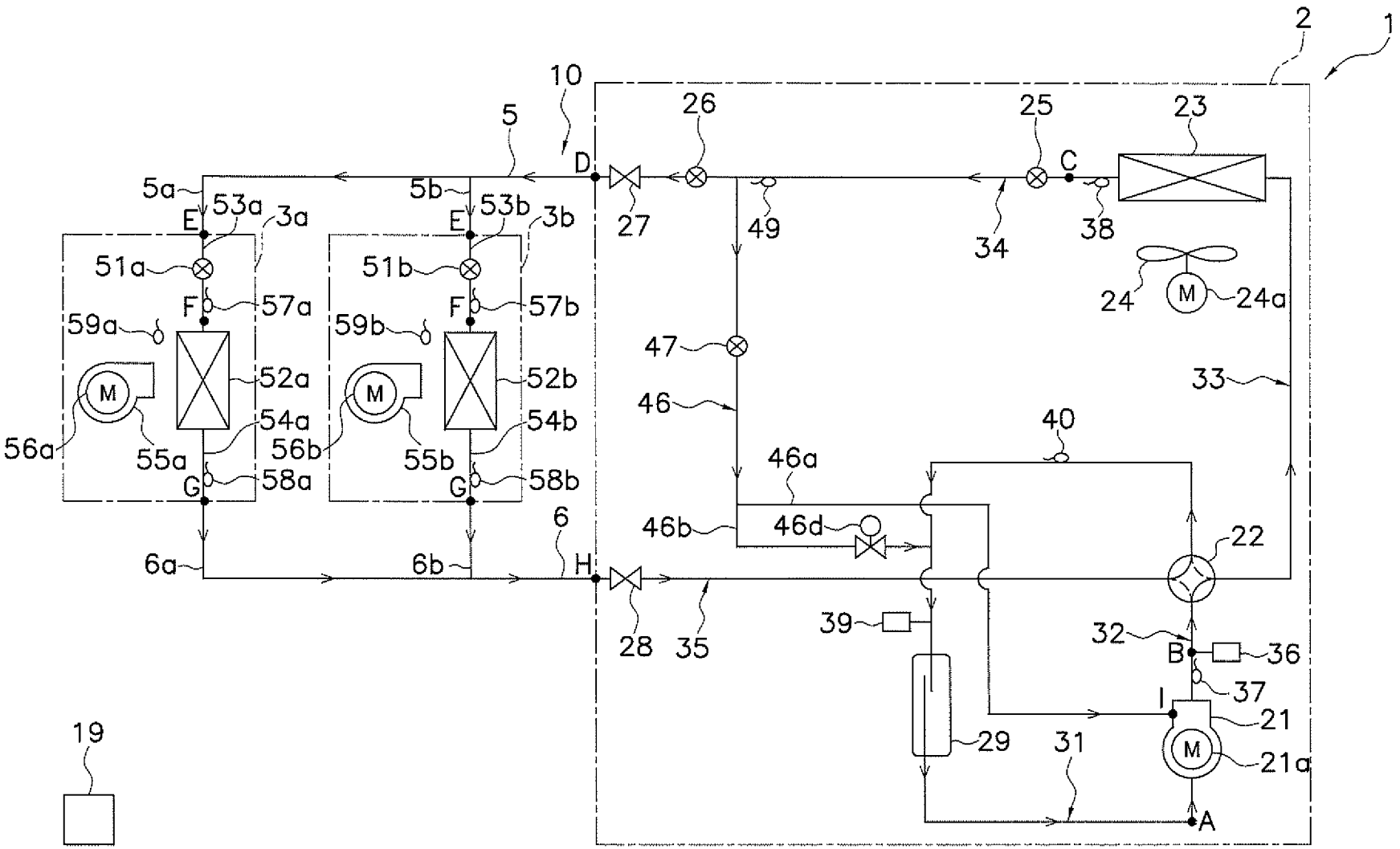
FIG. 7 is a schematic configuration diagram of an air conditioner according to a fourth modification of the first embodiment of the present invention.

Also in the air conditioner 1 of the third modification (see FIG. 5) of the first embodiment, similarly to the second modification (see FIG. 4), as illustrated in FIG. 7, the liquid injection pipe 46 may be bifurcated and connected to both a portion of the suction refrigerant pipe 31 on the inlet side of the accumulator 29 and an intermediate portion of the compression stroke of the compressor 21. One of the branched pipes of the liquid injection pipe 46 connected to the intermediate portion of the compression stroke of the compressor 21 is referred to as the first liquid injection pipe 46*a*, and the other of the branched pipes of the liquid injection pipe 46 connected to the portion on the inlet side of the accumulator 29 is referred to as the second liquid injection pipe 46*b*. Since the liquid injection pipe 46 is connected to both the portion of the suction refrigerant pipe 31 on the inlet side of the accumulator 29 and the intermediate portion of the compression stroke of the compressor 21, the refrigerant flowing through the liquid injection pipe 46 can be fed to the intermediate portion of the compression stroke of the compressor 21 to decrease the temperature of the refrigerant compressed to the intermediate pressure in the compressor 21, and the refrigerant flowing through the liquid injection pipe 46 can be fed to the inlet side of the accumulator 29, for example, to prevent occurrence of liquid compression in the compressor 21.

In addition, by using the configuration in which the liquid injection pipe 46 in FIG. 7 is bifurcated and connected to both the portion of the suction refrigerant pipe 31 on the inlet side of the accumulator 29 and the intermediate portion of the compression stroke of the compressor 21, an increase in the discharge pressure Pd of the compressor 21 can be suppressed. More specifically, a liquid relief valve 46*d* is provided in the second liquid injection pipe 46*b* of the liquid injection pipe 46 connected to the portion on the inlet side of the accumulator 29. The liquid relief valve 46*d* is controlled so that the discharge pressure Pd of the compressor 21 does not exceed a predetermined discharge pressure threshold Pdx (for example, upper-limit discharge pressure). More specifically, when the discharge pressure Pd has increased above the discharge pressure threshold Pdx, the control unit 19 performs control to open the liquid relief valve 46*d* until the discharge pressure Pd becomes the discharge pressure threshold Pdx or lower. Thus, the liquid refrigerant existing in the outdoor heat exchanger 23 can be fed to and retracted in the accumulator 29 via the liquid injection pipe 46. Consequently, an increase in the discharge pressure Pd can be suppressed. Since the refrigerant can be fed from the outdoor liquid-refrigerant pipe 34 to the accumulator 29 via the liquid injection pipe 46 by controlling the liquid relief valve 46*d* provided in the second liquid injection pipe 46*b* of the liquid injection pipe 46 connected to the portion on the inlet side of the accumulator 29, an increase in the discharge pressure Pd of the compressor 21 can be suppressed.

(2) Second Embodiment

<Configuration>

Figure 8:
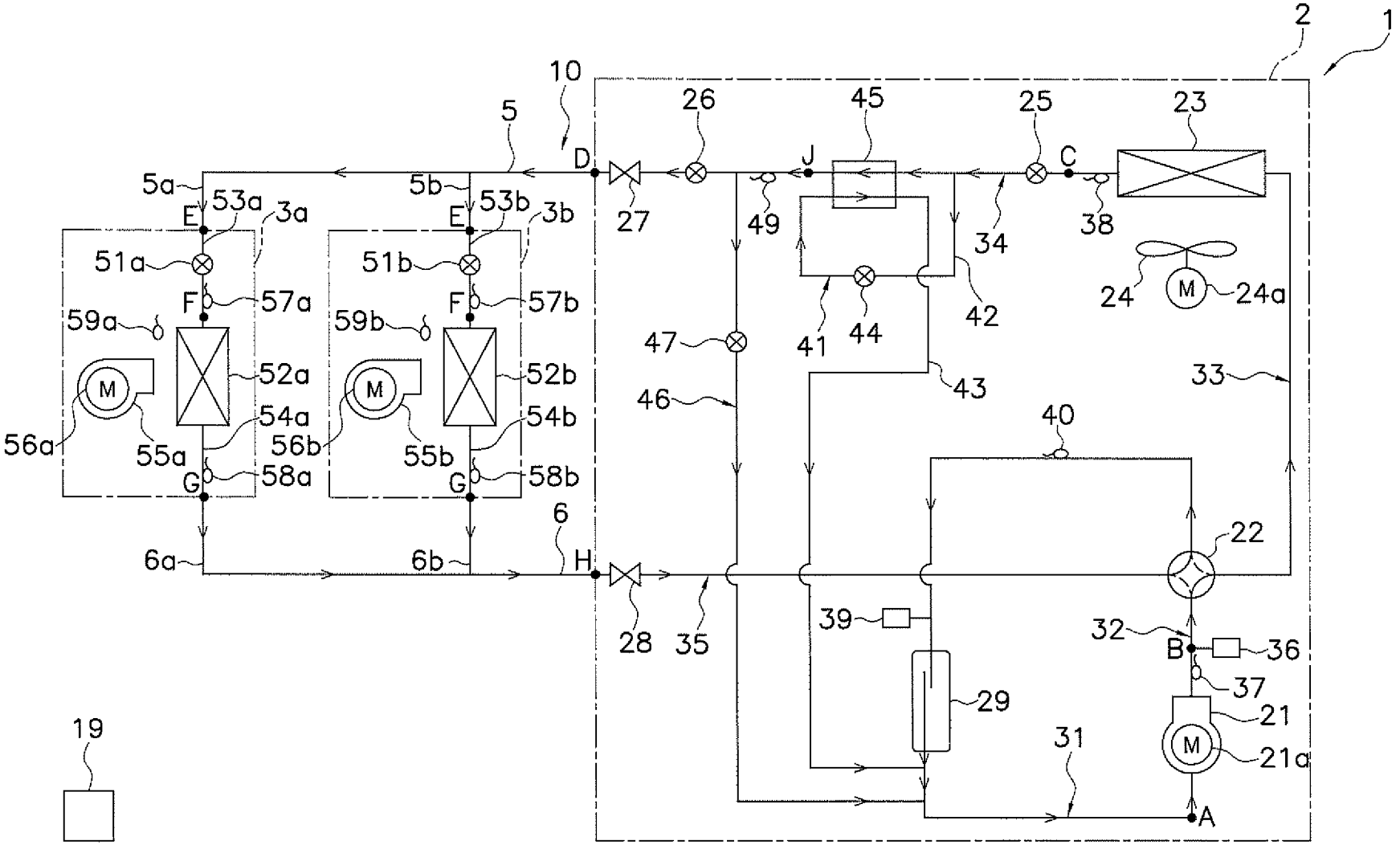
FIG. 8 is a schematic configuration diagram of an air conditioner according to a second embodiment of the present invention.

FIG. 8 is a schematic configuration diagram of an air conditioner 1 according to a second embodiment of the present invention. The air conditioner 1 is an apparatus that performs cooling and heating in a room of a building or the like through a vapor compression refrigeration cycle. The air conditioner 1 mainly includes an outdoor unit 2, a plurality of (in this case, two) indoor units 3*a* and 3*b* that are mutually connected in parallel, a liquid-refrigerant connection pipe 5 and a gas-refrigerant connection pipe 6 that connect the outdoor unit 2 to the indoor units 3*a* and 3*b*, and a control unit 19 that controls components of the outdoor unit 2 and the indoor units 3*a* and 3*b*. A vapor compression refrigerant circuit 10 of the air conditioner 1 is defined by connecting the outdoor unit 2 to the plurality of indoor units 3*a* and 3*b* via the liquid-refrigerant connection pipe 5 and the gas-refrigerant connection pipe 6. The refrigerant circuit 10 is filled with a refrigerant such as R32.

—Connection Pipes—

The liquid-refrigerant connection pipe 5 mainly includes a joint pipe portion extending from the outdoor unit 2 and branch pipe portions 5*a* and 5*b* that are a plurality of (in this case, two) branched pipe portions branched before the indoor units 3*a* and 3*b*. The gas-refrigerant connection pipe 6 mainly includes a joint pipe portion extending from the outdoor unit 2 and branch pipe portions 6*a* and 6*b* that are a plurality of (in this case, two) branched pipe portions branched before the indoor units 3*a* and 3*b*.

—Indoor Units—

The indoor units 3*a* and 3*b* are installed in rooms of the building or the like. The indoor units 3*a* and 3*b* are connected to the outdoor unit 2 via the liquid-refrigerant connection pipe 5 and the gas-refrigerant connection pipe 6 and constitute part of the refrigerant circuit 10 as described above.

The configurations of the indoor units 3*a* and 3*b* are similar to the configurations of the indoor units 3*a* and 3*b* of the first embodiment, and the description is omitted here.

—Outdoor Unit—

The outdoor unit 2 is installed outside the rooms of the building or the like. The outdoor unit 2 is connected to the indoor units 3*a* and 3*b* via the liquid-refrigerant connection pipe 5 and the gas-refrigerant connection pipe 6 and constitutes part of the refrigerant circuit 10 as described above.

The configuration of the outdoor unit 2 differs from the configuration of the outdoor unit 2 of the first embodiment only in that a refrigerant return pipe 41 and a refrigerant cooler 45 are provided. Thus, the configurations of the refrigerant return pipe 41 and the refrigerant cooler 45 are mainly described.

The refrigerant return pipe 41 is connected to the outdoor liquid-refrigerant pipe 34. The refrigerant cooler 45 is provided in the outdoor liquid-refrigerant pipe 34. The refrigerant return pipe 41 is a refrigerant pipe that branches part of the refrigerant flowing through the outdoor liquid-refrigerant pipe 34 and feeds the branched refrigerant to the compressor 21. The refrigerant cooler 45 is a heat exchanger that cools the refrigerant flowing through a portion of the outdoor liquid-refrigerant pipe 34 on the side of the outdoor heat exchanger 23 with respect to the liquid-pressure adjustment expansion valve 26 using the refrigerant flowing through the refrigerant return pipe 41. The outdoor expansion valve 25 is provided in a portion of the outdoor liquid-refrigerant pipe 34 on the side of the outdoor heat exchanger 23 with respect to the refrigerant cooler 45. The liquid-pressure adjustment expansion valve 26 is provided in a portion of the outdoor liquid-refrigerant pipe 34 on the side of the liquid-refrigerant connection pipe 5 with respect to the portion to which the refrigerant cooler 45 is connected (in this case, a portion between the refrigerant cooler 45 and the liquid-side shutoff valve 27). In addition, the liquid injection pipe 46 is connected to a portion of the outdoor liquid-refrigerant pipe 34 between the refrigerant cooler 45 and the liquid-pressure adjustment expansion valve 26.

The refrigerant return pipe 41 is a refrigerant pipe that feeds the refrigerant branched from the outdoor liquid-refrigerant pipe 34 to the suction side of the compressor 21. The refrigerant return pipe 41 mainly has a refrigerant-return inlet pipe 42 and a refrigerant-return outlet pipe 43. The refrigerant-return inlet pipe 42 is a refrigerant pipe that branches the refrigerant flowing through the outdoor liquid-refrigerant pipe 34 from a portion between the liquid-side end of the outdoor heat exchanger 23 and the liquid-pressure adjustment expansion valve 26 (in this case, a portion between the outdoor expansion valve 25 and the refrigerant cooler 45) and feeds the branched refrigerant to the inlet of the refrigerant cooler 45 on the side of the refrigerant return pipe 41. The refrigerant-return inlet pipe 42 is provided with a refrigerant-return expansion valve 44 that adjusts the flow rate of the refrigerant flowing through the refrigerant cooler 45 while decompressing the refrigerant flowing through the refrigerant return pipe 41. The refrigerant-return expansion valve 44 is an electrically powered expansion valve. The refrigerant-return outlet pipe 43 is a refrigerant pipe that feeds the refrigerant from the outlet of the refrigerant cooler 45 on the side of the refrigerant return pipe 41 to the suction refrigerant pipe 31. The refrigerant-return outlet pipe 43 of the refrigerant return pipe 41 is connected to a portion of the suction refrigerant pipe 31 on the outlet side of the accumulator 29. The refrigerant cooler 45 cools the refrigerant flowing through the outdoor liquid-refrigerant pipe 34 using the refrigerant flowing through the refrigerant return pipe 41. During cooling operation, the refrigerant cooler 45 is a heat exchanger of a type in which the refrigerant flowing through the refrigerant return pipe 41 and the refrigerant flowing through the outdoor liquid-refrigerant pipe 34 form counter-current flows.

In addition, the liquid-pipe temperature sensor 49 is provided in a portion of the outdoor liquid-refrigerant pipe 34 between the outlet of the refrigerant cooler 45 and the portion to which the liquid injection pipe 46 is connected so as to detect the temperature of the refrigerant at the outlet of the refrigerant cooler 45 as the liquid-pipe temperature Tlp.

—Control Unit—

The control unit 19 is connected to control boards or the like (not illustrated) that are provided in the outdoor unit 2 and the indoor units 3*a* and 3*b* for communication. In FIG. 8, the control unit 19 is illustrated at a position separated from the outdoor unit 2 and the indoor units 3*a* and 3*b* for the convenience of illustration. The control unit 19 controls the various components 21, 22, 24, 25, 26, 41, 47, 51*a*, 51*b*, 55*a*, and 55*b* of the air conditioner 1 (in this case, the outdoor unit 2 and the indoor units 3*a* and 3*b*) on the basis of detection signals or the like of the above-described various sensors 36, 37, 38, 39, 40, 49, 57*a*, 57*b*, 58*a*, 58*b*, 59*a*, and 59*b*. That is, the control unit 19 controls the entire operation of the air conditioner 1.

<Operations and Features of Air Conditioner>

Figure 9:
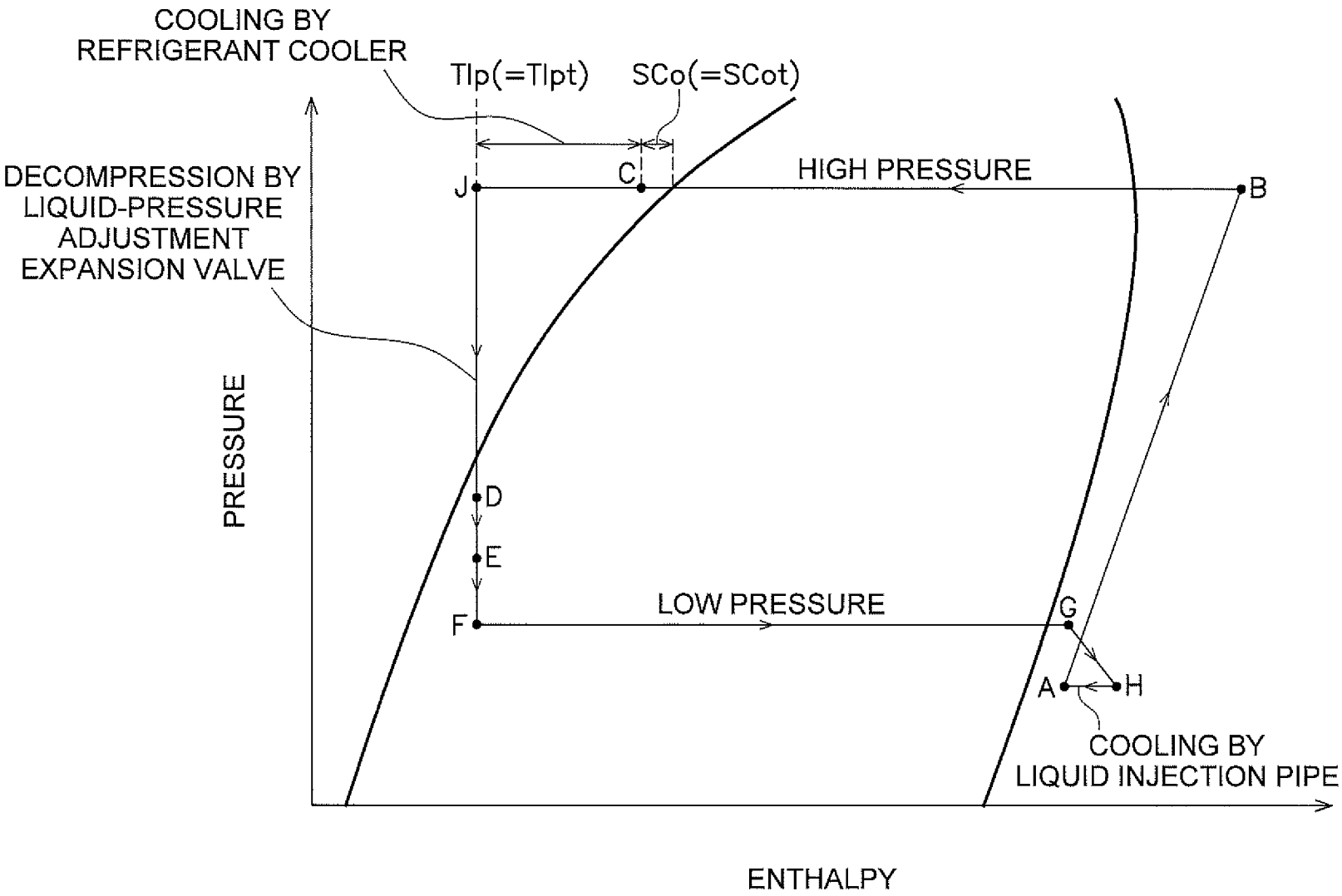
FIG. 9 is a pressure-enthalpy chart showing a refrigeration cycle during cooling operation in the air conditioner according to the second embodiment of the present invention.

Operations and features of the air conditioner 1 are described next with reference to FIGS. 8 and 9. FIG. 9 is a pressure-enthalpy chart showing a refrigeration cycle during cooling operation in the air conditioner 1 according to the second embodiment of the present invention.

The air conditioner 1 performs cooling operation and heating operation as described above. During cooling operation, the refrigerant is transported in the two-phase state by sending the refrigerant in the gas-liquid two-phase state to the liquid-refrigerant connection pipe 5 and feeding the refrigerant from the outdoor unit 2 to the indoor units 3*a* and 3*b* using the liquid-pressure adjustment expansion valve 26 provided in the outdoor liquid-refrigerant pipe 34. Furthermore, during cooling operation, an operation is performed to cool the refrigerant in the portion of the outdoor liquid-refrigerant pipe 34 between the refrigerant cooler 45 and the liquid-pressure adjustment expansion valve 26 using the refrigerant return pipe 41 that branches part of the refrigerant flowing through the outdoor liquid-refrigerant pipe 34 and feeds the branched refrigerant to the compressor 21, and the refrigerant cooler 45 that cools the refrigerant flowing through the portion of the outdoor liquid-refrigerant pipe 34 on the side of the outdoor heat exchanger 23 with respect to the liquid-pressure adjustment expansion valve 26 with the refrigerant flowing through the refrigerant return pipe 41. Further, during cooling operation, an operation is performed to feed the refrigerant to the compressor 21 while suppressing a variation in the temperature (liquid-pipe temperature Tlp) of the refrigerant flowing through the outdoor liquid-refrigerant pipe 34 using the liquid injection pipe 46 that branches part of the refrigerant flowing through the outdoor liquid-refrigerant pipe 34 from the portion of the outdoor liquid-refrigerant pipe 34 on the side of the outdoor heat exchanger 23 with respect to the liquid-pressure adjustment expansion valve 26 and feeds the branched refrigerant to the compressor 21. Note that the control unit 19 that controls the components of the air conditioner 1 performs the operations of the air conditioner 1 which will be described below.

—Cooling Operation—

For cooling operation, for example, when all the indoor units 3*a* and 3*b* perform cooling operation (that is, operation in which all the indoor heat exchangers 52*a* and 52*b* function as evaporators of the refrigerant and the outdoor heat exchanger 23 functions as a radiator of the refrigerant), the switching mechanism 22 is switched to the outdoor radiation state (the state indicated by solid lines of the switching mechanism 22 in FIG. 8), and the compressor 21, the outdoor fan 24, and the indoor fans 55*a* and 55*b* are driven.

Then, the refrigerant at a high pressure discharged from the compressor 21 is fed to the outdoor heat exchanger 23 via the switching mechanism 22 (see point B in FIGS. 8 and 9). The refrigerant fed to the outdoor heat exchanger 23 exchanges heat with the outdoor air supplied by the outdoor fan 24, and hence is cooled and condensed in the outdoor heat exchanger 23 that functions as the radiator of the refrigerant (see point C in FIGS. 8 and 9). The refrigerant flows out from the outdoor unit 2 via the outdoor expansion valve 25, the refrigerant cooler 45, the liquid-pressure adjustment expansion valve 26, and the liquid-side shutoff valve 27 (see point D in FIGS. 8 and 9).

The refrigerant flowing out from the outdoor unit 2 is branched and fed to the indoor units 3*a* and 3*b* via the liquid-refrigerant connection pipe 5 (see point E in FIGS. 8 and 9). The refrigerants fed to the indoor units 3*a* and 3*b* are decompressed to a low pressure by the indoor expansion valves 51*a* and 51*b* and then are fed to the indoor heat exchangers 52*a* and 52*b* (see point F in FIGS. 8 and 9). The refrigerants fed to the indoor heat exchangers 52*a* and 52*b* exchange heat with the indoor air supplied from the inside of the rooms by the indoor fans 55*a* and 55*b*, and hence are heated and evaporated in the indoor heat exchangers 52*a* and 52*b* that function as the evaporators of the refrigerant (see point G in FIGS. 8 and 9). The refrigerants flow out from the indoor units 3*a* and 3*b*. In contrast, the indoor air cooled in the indoor heat exchangers 52*a* and 52*b* is fed into the rooms, and thus the rooms are cooled.

The refrigerants flowing out from the indoor units 3*a* and 3*b* are joined and fed to the outdoor unit 2 via the gas-refrigerant connection pipe 6 (see point H in FIGS. 8 and 9). The refrigerant fed to the outdoor unit 2 is sucked into the compressor 21 via the gas-side shutoff valve 28, the switching mechanism 22, and the accumulator 29 (see point A in FIGS. 8 and 9).

During the above-described cooling operation, the refrigerant is transported in the two-phase state by sending the refrigerant in the gas-liquid two-phase state to the liquid-refrigerant connection pipe 5 and feeding the refrigerant from the outdoor unit 2 to the indoor units 3*a* and 3*b* using the liquid-pressure adjustment expansion valve 26. In addition, as described below, when the refrigerant is to be transported in the two-phase state, the refrigerant flowing through the outdoor liquid-refrigerant pipe 34 is cooled using the refrigerant return pipe 41 and the refrigerant cooler 45, and the refrigerant is properly transported in the two-phase state while suppressing an increase in the discharge temperature Td of the compressor 21 using the liquid injection pipe 46.

First, the control unit 19 controls the liquid-pressure adjustment expansion valve 26 to decompress the refrigerant so that the refrigerant flowing through the liquid-refrigerant connection pipe 5 is in the gas-liquid two-phase state (see points J and D in FIGS. 8 and 9). The refrigerant decompressed by the liquid-pressure adjustment expansion valve 26 is a refrigerant at an intermediate pressure that is lower than the pressure of a refrigerant at a high pressure and is higher than the pressure of a refrigerant at a low pressure (see point D in FIGS. 8 and 9). The control unit 19 controls the opening degree of the liquid-pressure adjustment expansion valve 26 so that the degree of subcooling SCo of the refrigerant at the liquid-side end of the outdoor heat exchanger 23 becomes the target degree of subcooling SCot. More specifically, the control unit 19 obtains the degree of subcooling SCo of the refrigerant at the liquid-side end of the outdoor heat exchanger 23 from the outdoor heat-exchanger outlet temperature Tol. The control unit 19 obtains the degree of subcooling SCo of the refrigerant at the liquid-side end of the outdoor heat exchanger 23 by subtracting the outdoor heat-exchanger outlet temperature Tol from the temperature Toc of the refrigerant obtained by converting the discharge pressure Pd into a saturation temperature. The control unit 19 performs control to increase the opening degree of the liquid-pressure adjustment expansion valve 26 if the degree of subcooling SCo is larger than the target degree of subcooling SCot, and performs control to decrease the opening degree of the liquid-pressure adjustment expansion valve 26 if the degree of subcooling SCo is smaller than the target degree of subcooling SCot. Note that, in this case, the control unit 19 performs control to fix the opening degree of the outdoor expansion valve 25 in a full-open state.

With this control, the state of the refrigerant flowing through the liquid-refrigerant connection pipe 5 becomes the gas-liquid two-phase state. The refrigerant connection pipe 5 is not filled with the refrigerant in a liquid state unlike a case where the refrigerant flowing through the liquid-refrigerant connection pipe 5 is in a liquid state. The amount of the refrigerant existing in the liquid-refrigerant connection pipe 5 can be decreased by that amount.

Furthermore, the control unit 19 controls the temperature of the refrigerant (liquid-pipe temperature Tlp) in the portion of the outdoor liquid-refrigerant pipe 34 between the refrigerant cooler 45 and the liquid-pressure adjustment expansion valve 26 to be constant by cooling the refrigerant flowing through the portion of the outdoor liquid-refrigerant pipe 34 on the side of the outdoor heat exchanger 23 with respect to the liquid-pressure adjustment expansion valve 26 by the refrigerant cooler 45 using the refrigerant flowing through the refrigerant return pipe 41. The control unit 19 controls the opening degree of the refrigerant-return expansion valve 44 so that the temperature of the refrigerant (liquid-pipe temperature Tlp) in the portion of the outdoor liquid-refrigerant pipe 34 between the refrigerant cooler 45 and the liquid-pressure adjustment expansion valve 26 becomes a target liquid-pipe temperature Tlpt. More specifically, the control unit 19 performs control to increase the opening degree of the refrigerant-return expansion valve 44 if the liquid-pipe temperature Tlp is higher than the target liquid-pipe temperature Tlpt, and performs control to decrease the opening degree of the refrigerant-return expansion valve 44 if the liquid-pipe temperature Tlp is lower than the target liquid-pipe temperature Tlpt.

With this control, the temperature of the refrigerant (liquid-pipe temperature Tlp) in the portion of the outdoor liquid-refrigerant pipe 34 between the refrigerant cooler 45 and the liquid-pressure adjustment expansion valve 26 can be maintained to be constant at the target liquid-pipe temperature Tlpt (see point J in FIGS. 8 and 9).

Furthermore, the control unit 19 branches part of the refrigerant flowing through the outdoor liquid-refrigerant pipe 34 to suppress an increase in the discharge temperature Td of the compressor 21 and feeds the branched refrigerant to the compressor 21 (in this case, the suction refrigerant pipe 31 connected to the suction side of the compressor 21). The control unit 19 controls the opening degree of the liquid-injection expansion valve 47 so that the discharge temperature Td of the compressor 21 does not exceed a predetermined discharge temperature threshold Tdx (for example, upper-limit discharge temperature). More specifically, when the discharge temperature Td has increased above the discharge temperature threshold Tdx, the control unit 19 performs control to increase the opening degree of the liquid-injection expansion valve 47 until the discharge temperature Td becomes the discharge temperature threshold Tdx or lower.

With this control, the refrigerants fed from the indoor units 3*a* and 3*b* to the outdoor unit 2 (point H in FIGS. 8 and 9) are joined to the refrigerant to be fed to the compressor 21 via the liquid injection pipe 46 and is cooled (see points H and A in FIGS. 8 and 9). Thus, an increase in the discharge temperature Td of the compressor 21 can be suppressed by that cooled amount (see point B in FIGS. 8 and 9).

—Heating Operation—

For heating operation, for example, when all the indoor units 3*a* and 3*b* perform heating operation (that is, operation in which all the indoor heat exchangers 52*a* and 52*b* function as radiators of the refrigerant and the outdoor heat exchanger 23 functions as an evaporator of the refrigerant), the switching mechanism 22 is switched to the outdoor evaporation state (the state indicated by broken lines of the switching mechanism 22 in FIG. 8), and the compressor 21, the outdoor fan 24, and the indoor fans 55*a* and 55*b* are driven.

The refrigerant at a high pressure discharged from the compressor 21 flows out from the outdoor unit 2 via the switching mechanism 22 and the gas-side shutoff valve 28.

The refrigerant flowing out from the outdoor unit 2 is branched and fed to the indoor units 3*a* and 3*b* via the gas-refrigerant connection pipe 6. The refrigerants fed to the indoor units 3*a* and 3*b* are fed to the indoor heat exchangers 52*a* and 52*b*. The refrigerants at a high pressure fed to the indoor heat exchangers 52*a* and 52*b* exchange heat with the indoor air supplied from the inside of the rooms by the indoor fans 55*a* and 55*b*, and hence are cooled and condensed in the indoor heat exchangers 52*a* and 52*b* that function as the radiators of the refrigerant. The refrigerants flow out from the indoor units 3*a* and 3*b* via the indoor expansion valves 51*a* and 51*b*. In contrast, the indoor air heated in the indoor heat exchangers 52*a* and 52*b* is fed into the rooms, and thus the rooms are heated.

The refrigerants flowing out from the indoor units 3*a* and 3*b* are joined and fed to the outdoor unit 2 via the liquid-refrigerant connection pipe 5. The refrigerant fed to the outdoor unit 2 is fed to the outdoor expansion valve 25 via the liquid-side shutoff valve 27, the liquid-pressure adjustment expansion valve 26, and the refrigerant cooler 45. The refrigerant fed to the outdoor expansion valve 25 is decompressed to a low pressure by the outdoor expansion valve 25 and then is fed to the outdoor heat exchanger 23. The refrigerant fed to the outdoor heat exchanger 23 exchanges heat with the outdoor air supplied by the outdoor fan 24, and hence is heated and evaporated. The refrigerant is sucked into the compressor 21 via the switching mechanism 22 and the accumulator 29.

In this case, the control unit 19 performs control to fix the opening degree of the liquid-pressure adjustment expansion valve 26 in a full-open state. With this control, the opening degrees of the refrigerant-return expansion valve 44 and the liquid-injection expansion valve 47 are in a full-closed state so as not to send the refrigerant to the refrigerant return pipe 41 and the liquid injection pipe 46.

—Features—

In the configuration in which the refrigerant is transported in the two-phase state by sending the refrigerant in the gas-liquid two-phase state to the liquid-refrigerant connection pipe 5 and feeding the refrigerant from the outdoor unit 2 to the indoor units 3*a* and 3*b* using the liquid-pressure adjustment expansion valve 26, as described above, the refrigerant cooler 45 is further provided that cools the refrigerant flowing through the portion of the outdoor liquid-refrigerant pipe 34 on the side of the outdoor heat exchanger 23 with respect to the liquid-pressure adjustment expansion valve 26 using the refrigerant return pipe 41 and the refrigerant flowing through the refrigerant return pipe 41.

If the liquid injection pipe 46 is not provided and the refrigerant return pipe 41 and the refrigerant cooler 45 are provided, the refrigerant flowing through the refrigerant return pipe 41 cools the refrigerant flowing through the refrigerant cooler 45 and then is fed to the compressor 21, and hence an increase in the discharge temperature Td of the compressor 21 can be suppressed. However, since the refrigerant flowing through the refrigerant return pipe 41 is fed to the compressor 21 after cooling the refrigerant flowing through the outdoor liquid-refrigerant pipe 34 in the refrigerant cooler 45, the temperature of the refrigerant (liquid-pipe temperature Tlp) flowing through the outdoor liquid-refrigerant pipe 34 after the refrigerant has passed through the refrigerant cooler 45 varies depending on the flow rate of the refrigerant flowing through the refrigerant return pipe 41. Consequently, the state of the refrigerant flowing through the liquid-refrigerant connection pipe 5 after the refrigerant has been decompressed by the liquid-pressure adjustment expansion valve 26 also varies. For example, if the flow rate of the refrigerant flowing through the refrigerant return pipe 41 excessively increases, an increase in the discharge temperature Td of the compressor 21 can be suppressed to a certain extent; however, the liquid-pipe temperature Tlp excessively decreases. Consequently, the refrigerant flowing through the liquid-refrigerant connection pipe 5 after the refrigerant has been decompressed by the liquid-pressure adjustment expansion valve 26 is in a gas-liquid two-phase state containing more liquid component.

That is, in the configuration having the liquid-pressure adjustment expansion valve 26, merely providing the refrigerant return pipe 41 and the refrigerant cooler 45 may not maintain a desirable gas-liquid two-phase state. It is difficult to properly transport the refrigerant in the two-phase state while an increase in the discharge temperature Td of the compressor 21 is suppressed.

Owing to this, the liquid injection pipe 46 is provided in addition to the refrigerant return pipe 41 and the refrigerant cooler 45. Since the liquid injection pipe 46 is provided, the refrigerant can be fed to the compressor 21 while a variation in the liquid-pipe temperature Tlp is suppressed (see point J in FIG. 9). Thus, an increase in the discharge temperature Td of the compressor 21 can be suppressed without increasing the flow rate of the refrigerant flowing through the refrigerant return pipe 41. If the flow rate of the refrigerant flowing through the refrigerant return pipe 41 is not excessively large, the liquid-pipe temperature Tlp does not excessively decrease. Consequently, the refrigerant flowing through the liquid-refrigerant connection pipe 5 after the refrigerant has been decompressed by the liquid-pressure adjustment expansion valve 26 does not become the refrigerant in the gas-liquid two-phase state containing more liquid component. Thus, the refrigerant flowing through the liquid-refrigerant connection pipe 5 can be maintained in a desirable gas-liquid two-phase state (see point D in FIG. 9) while an increase in the discharge temperature Td of the compressor 21 is suppressed (see point B in FIG. 9).

That is, in the configuration having the liquid-pressure adjustment expansion valve 26, since the liquid injection pipe 46 is provided in addition to the refrigerant return pipe 41 and the refrigerant cooler 45, the refrigerant can be properly transported in the two-phase state while an increase in the discharge temperature Td of the compressor 21 is suppressed.

In addition, the control unit 19 controls the opening degree of the liquid-pressure adjustment expansion valve 26 so that the degree of subcooling SCo of the refrigerant at the liquid-side end of the outdoor heat exchanger 23 becomes the target degree of subcooling SCot, and thus the refrigerant flowing through the liquid-refrigerant connection pipe 5 is decompressed using the liquid-pressure adjustment expansion valve 26 to be in the gas-liquid two-phase state. With such control, the holding refrigerant amount of the outdoor heat exchanger 23 can be easily maintained in a desirable state (see point C in FIG. 9), and consequently, the state of the refrigerant to be fed to the refrigerant cooler 45 can be stable.

In addition, the liquid-injection expansion valve 47 that decompresses the refrigerant branched from the outdoor liquid-refrigerant pipe 34 is provided in the liquid injection pipe 46. The refrigerant-return expansion valve 44 that decompresses the refrigerant branched from the outdoor liquid-refrigerant pipe 34 is provided in the refrigerant return pipe 41. The control unit 19 controls the opening degree of the liquid-injection expansion valve 47 so that the discharge temperature Td of the compressor 21 does not exceed the predetermined discharge temperature threshold Tdx (for example, upper-limit discharge temperature), and controls the opening degree of the refrigerant-return expansion valve 44 so that the temperature of the refrigerant (liquid-pipe temperature Tlp) in the portion of the outdoor liquid-refrigerant pipe 34 between the refrigerant cooler 45 and the liquid-pressure adjustment expansion valve 26 becomes the target liquid-pipe temperature Tlpt. Since the flow rate of the refrigerant that is fed from the outdoor liquid-refrigerant pipe 34 to the compressor 21 can be adjusted through the liquid injection pipe 46 by controlling the opening degree of the liquid-injection expansion valve 47 provided in the liquid injection pipe 46, an increase in the discharge temperature Td of the compressor 21 can be reliably suppressed (see point B in FIG. 9). In addition, since the flow rate of the refrigerant that exchanges heat with the refrigerant flowing through the outdoor liquid-refrigerant pipe 34 can be adjusted in the refrigerant cooler 45 by controlling the opening degree of the refrigerant-return expansion valve 44 provided in the refrigerant return pipe 41, the liquid-pipe temperature Tlp can be constant at the target liquid-pipe temperature Tlpt (see point J in FIG. 9). Since the liquid-pipe temperature Tlp is constant, the refrigerant flowing through the liquid-refrigerant connection pipe 5 after the refrigerant has been decompressed by the liquid-pressure adjustment expansion valve 26 can be reliably maintained in a desirable gas-liquid two-phase state (see point D in FIG. 9). When the refrigerant is transported in the two-phase state using the liquid-pressure adjustment expansion valve 26, the refrigerant return pipe 41 and the refrigerant cooler 45 are used to maintain the liquid-pipe temperature Tlp to be constant, and the liquid injection pipe 46 is used to suppress an increase in the discharge temperature Td of the compressor 21.

In addition, the liquid injection pipe 46 and the refrigerant return pipe 41 are connected to the suction refrigerant pipe 31 through which the refrigerant to be sucked into the compressor 21 flows. Thus, since the refrigerant branched from the outdoor liquid-refrigerant pipe 34 can be fed to the suction side of the compressor 21, the temperature of the refrigerant to be sucked into the compressor 21 can be decreased (see points H and A in FIG. 9). In this case, the liquid injection pipe 46 and the refrigerant return pipe 41 are connected to the portion of the suction refrigerant pipe 31 on the outlet side of the accumulator 29, and hence the refrigerant flowing through the liquid injection pipe 46 can be joined to the refrigerant to be sucked into the compressor 21 without via the accumulator 29. Thus, the effect of decreasing the temperature of the refrigerant to be sucked into the compressor 21 can be increased as compared with a case where the liquid injection pipe 46 and/or the refrigerant return pipe 41 is connected to the inlet side of the accumulator 29.

<First Modification>

In the air conditioner 1 of the above-described second embodiment (see FIG. 8), the liquid injection pipe 46 and the refrigerant return pipe 41 are connected to the portion of the suction refrigerant pipe 31 on the outlet side of the accumulator 29, and hence the effect of decreasing the temperature of the refrigerant to be sucked into the compressor 21 is increased. However, the connection positions of the liquid injection pipe 46 and the refrigerant return pipe 41 to the suction refrigerant pipe 31 are not limited thereto.

Figure 10:
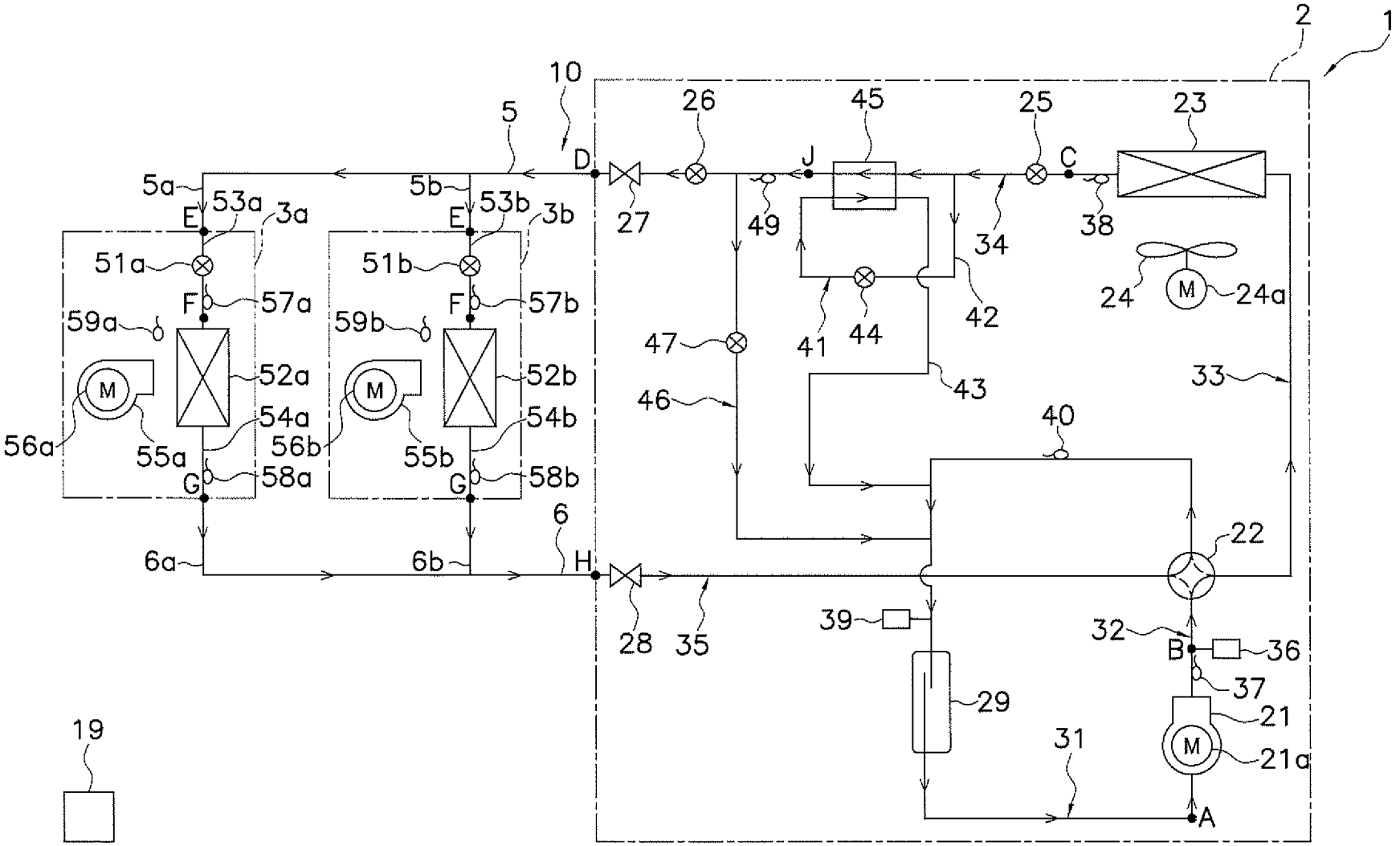
FIG. 10 is a schematic configuration diagram of an air conditioner according to a first modification of the second embodiment of the present invention.

As illustrated in FIG. 10, the liquid injection pipe 46 and the refrigerant return pipe 41 are connected to the portion of the suction refrigerant pipe 31 on the inlet side of the accumulator 29, and hence the refrigerant flowing through the liquid injection pipe 46 can be joined to the refrigerant to be sucked into the compressor 21 via the accumulator 29. Thus, for example, occurrence of liquid compression in the compressor 21 can be prevented as compared with a case where the liquid injection pipe 46 and the refrigerant return pipe 41 are connected to the outlet side of the accumulator 29. In this configuration, the return liquid pipe 31*a* that feeds the refrigerant from the bottom portion of the accumulator 29 to the portion of the suction refrigerant pipe 31 on the outlet side of the accumulator 29 may be provided, and the control unit 19 may control the return liquid valve 31*b* provided in the return liquid pipe 31*a* to return the liquid refrigerant stored in the accumulator 29 to the compressor 21.

Although not illustrated, the liquid injection pipe 46 may be connected to a portion of the suction refrigerant pipe 31 on the outlet side of the accumulator 29, and the refrigerant return pipe 41 may be connected to a portion of the suction refrigerant pipe 31 on the inlet side of the accumulator 29. Alternatively, the liquid injection pipe 46 may be connected to a portion of the suction refrigerant pipe 31 on the inlet side of the accumulator 29, and the refrigerant return pipe 41 may be connected to a portion of the suction refrigerant pipe 31 on the outlet side of the accumulator 29.

<Second Modification>

In the air conditioner 1 of the second embodiment and the first modification (see FIGS. 8 and 10), the liquid injection pipe 46 and/or the refrigerant return pipe 41 is connected to the portion of the suction refrigerant pipe 31 on the inlet side of the accumulator 29 or the portion of the suction refrigerant pipe 31 on the outlet side of the accumulator 29. However, the connection position of the liquid injection pipe 46 and/or the refrigerant return pipe 41 to the suction refrigerant pipe 31 is not limited thereto.

Figure 11:
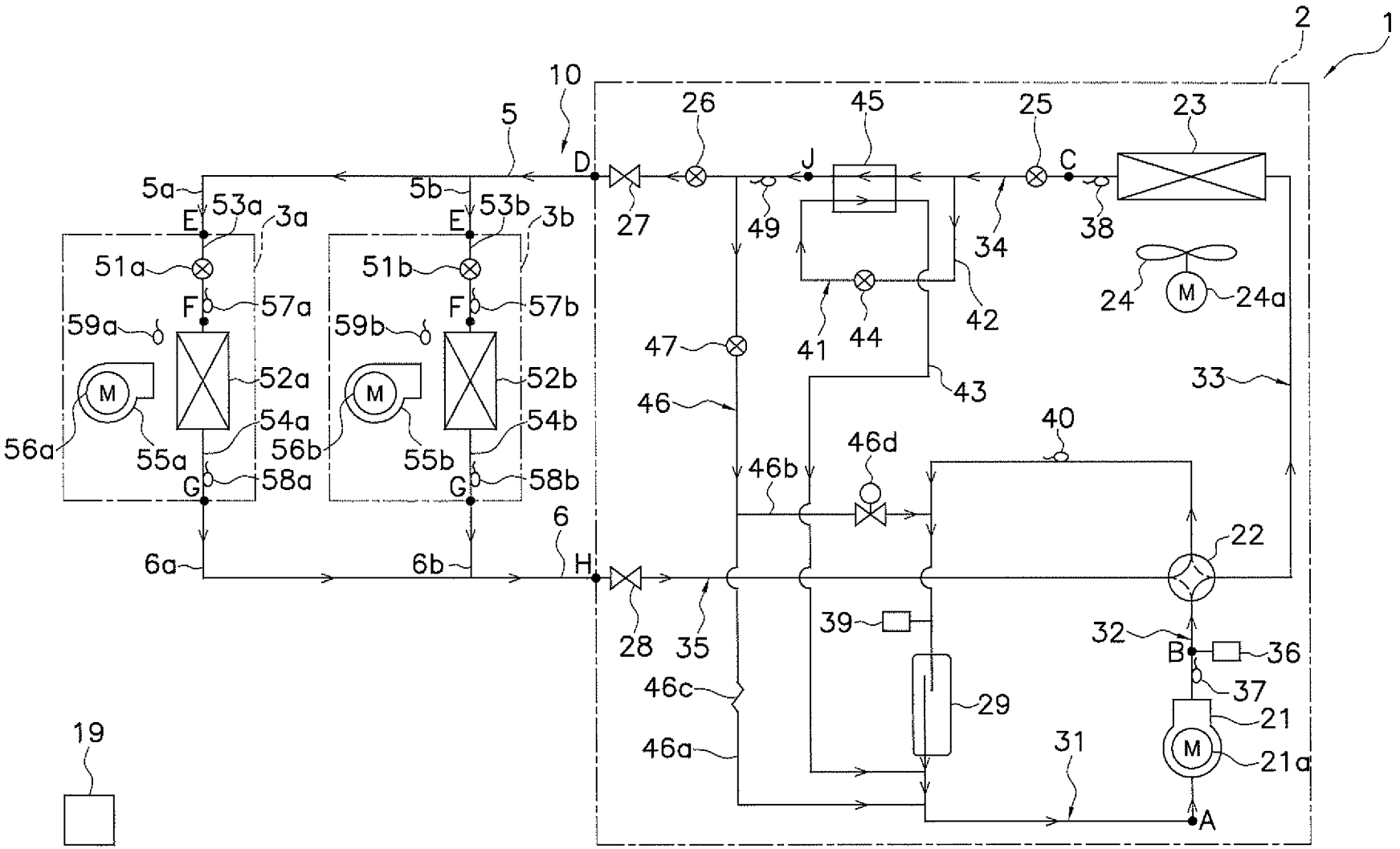
FIG. 11 is a schematic configuration diagram of the air conditioner according to a second modification of the second embodiment of the present invention.
Figure 12:
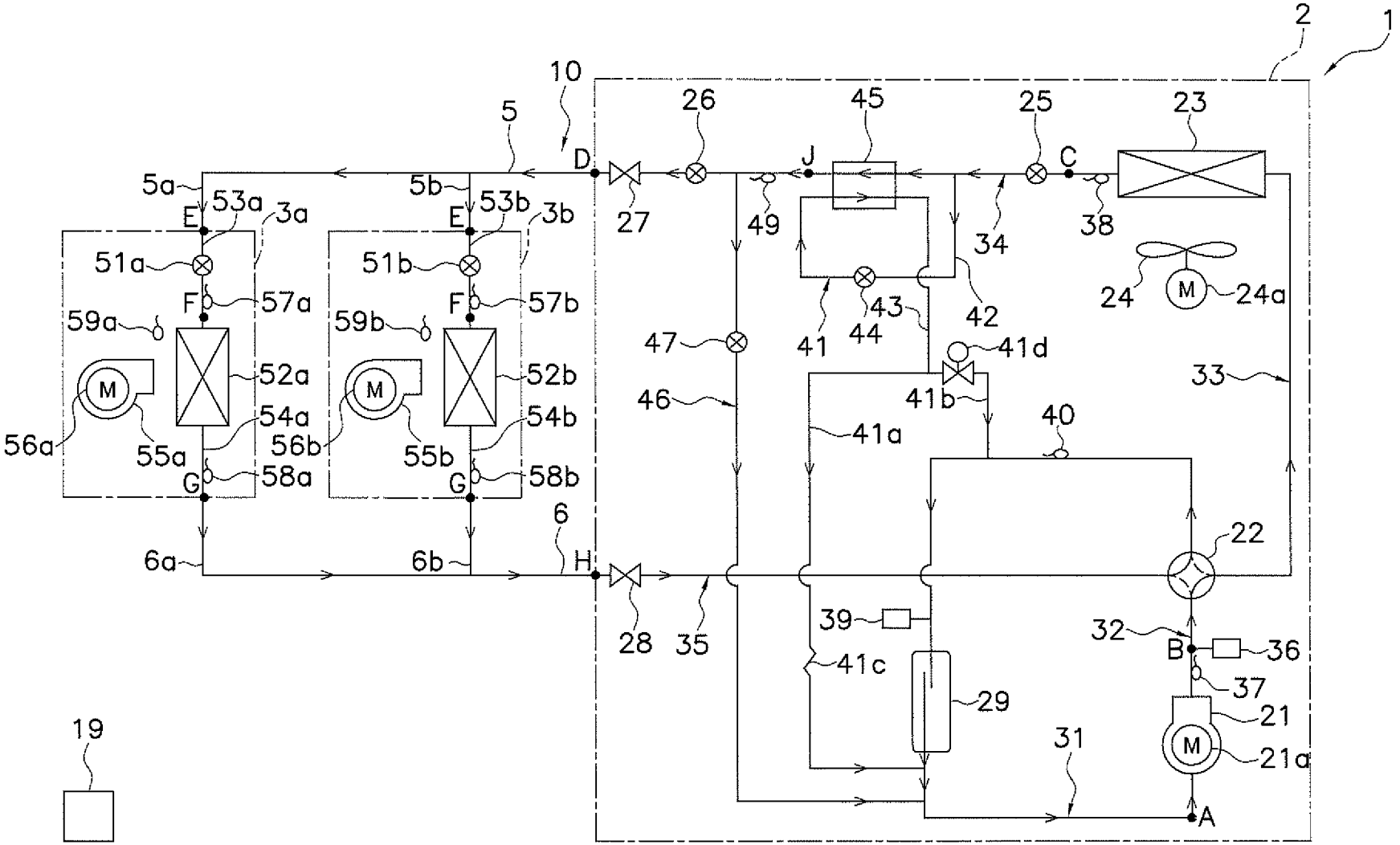
FIG. 12 is a schematic configuration diagram of the air conditioner according to the second modification of the second embodiment of the present invention.

As illustrated in FIG. 11, the liquid injection pipe 46 is bifurcated and connected to both a portion of the suction refrigerant pipe 31 on the inlet side of the accumulator 29 and a portion of the suction refrigerant pipe 31 on the outlet side of the accumulator 29. One of the branched pipes of the liquid injection pipe 46 connected to the portion on the outlet side of the accumulator 29 is referred to as the first liquid injection pipe 46*a*, and the other of the branched pipes of the liquid injection pipe 46 connected to the portion on the inlet side of the accumulator 29 is referred to as the second liquid injection pipe 46*b*. Since the liquid injection pipe 46 is connected to both the inlet side and the outlet side of the accumulator 29, the refrigerant flowing through the liquid injection pipe 46 may be fed to the outlet side of the accumulator 29 to increase the effect of decreasing the temperature of the refrigerant to be sucked into the compressor 21, and the refrigerant flowing through the liquid injection pipe 46 may be fed to the inlet side of the accumulator 29, for example, to prevent occurrence of liquid compression in the compressor 21. As illustrated in FIG. 12, the refrigerant return pipe 41 may be bifurcated and connected to both a portion of the suction refrigerant pipe 31 on the inlet side of the accumulator 29 and a portion of the suction refrigerant pipe 31 on the outlet side of the accumulator 29. One of the branched pipes of the refrigerant return pipe 41 connected to the portion on the outlet side of the accumulator 29 is referred to as the first refrigerant return pipe 41*a*, and the other of the branched pipes of the refrigerant return pipe 41 connected to the portion on the inlet side of the accumulator 29 is referred to as the second refrigerant return pipe 41*b*.

In addition, by using the configuration in which the liquid injection pipe 46 in FIG. 11 is bifurcated and connected to both the portions of the suction refrigerant pipe 31 on the inlet side of the accumulator 29 and on the outlet side of the accumulator 29, an increase in the discharge pressure Pd of the compressor 21 can be suppressed. More specifically, a liquid relief valve 46*d* is provided in the second liquid injection pipe 46*b* of the liquid injection pipe 46 connected to the portion on the inlet side of the accumulator 29. The liquid relief valve 46*d* is controlled so that the discharge pressure Pd of the compressor 21 does not exceed a predetermined discharge pressure threshold Pdx (for example, upper-limit discharge pressure). More specifically, when the discharge pressure Pd has increased above the discharge pressure threshold Pdx, the control unit 19 performs control to open the liquid relief valve 46*d* until the discharge pressure Pd becomes the discharge pressure threshold Pdx or lower. Thus, the liquid refrigerant existing in the outdoor heat exchanger 23 can be fed to and retracted in the accumulator 29 via the liquid injection pipe 46. Consequently, an increase in the discharge pressure Pd can be suppressed. Since the refrigerant can be fed from the outdoor liquid-refrigerant pipe 34 to the accumulator 29 via the liquid injection pipe 46 by controlling the liquid relief valve 46*d* provided in the second liquid injection pipe 46*b* of the liquid injection pipe 46 connected to the portion on the inlet side of the accumulator 29, an increase in the discharge pressure Pd of the compressor 21 can be suppressed. In this configuration, a capillary tube 46*c* serving as a flow resistance is provided in the first liquid injection pipe 46*a* so as to send the refrigerant to the second liquid injection pipe 46*b* more during the liquid relief control. In addition, by using the configuration in which the refrigerant return pipe 41 in FIG. 12 is bifurcated and connected to both the portions of the suction refrigerant pipe 31 on the inlet side of the accumulator 29 and on the outlet side of the accumulator 29, an increase in the discharge pressure Pd of the compressor 21 can be suppressed. More specifically, similarly to the liquid injection pipe 46, a liquid relief valve 41*d* is provided in the second refrigerant return pipe 41*b* of the refrigerant return pipe 41 connected to the portion on the inlet side of the accumulator 29. The liquid relief valve 41*d* is controlled so that the discharge pressure Pd of the compressor 21 does not exceed a predetermined discharge pressure threshold Pdx. Even in this configuration, a capillary tube 41*c* serving as a flow resistance may be provided in the first refrigerant return pipe 41*a* so as to send the refrigerant to the second refrigerant return pipe 41*b* more during the liquid relief control.

<Third Modification>

In the air conditioner 1 of the second embodiment (see FIG. 8), since the liquid injection pipe 46 and the refrigerant return pipe 41 are connected to the suction refrigerant pipe 31, the refrigerant branched from the outdoor liquid-refrigerant pipe 34 is fed to the suction side of the compressor 21 to decrease the temperature of the refrigerant to be sucked into the compressor 21 (see points H and A in FIG. 2) and thus suppress an increase in the discharge temperature Td of the compressor 21. However, the feeding destination of the refrigerant flowing through the liquid injection pipe 46 and the refrigerant return pipe 41 to the compressor 21 is not limited thereto.

Figure 13:
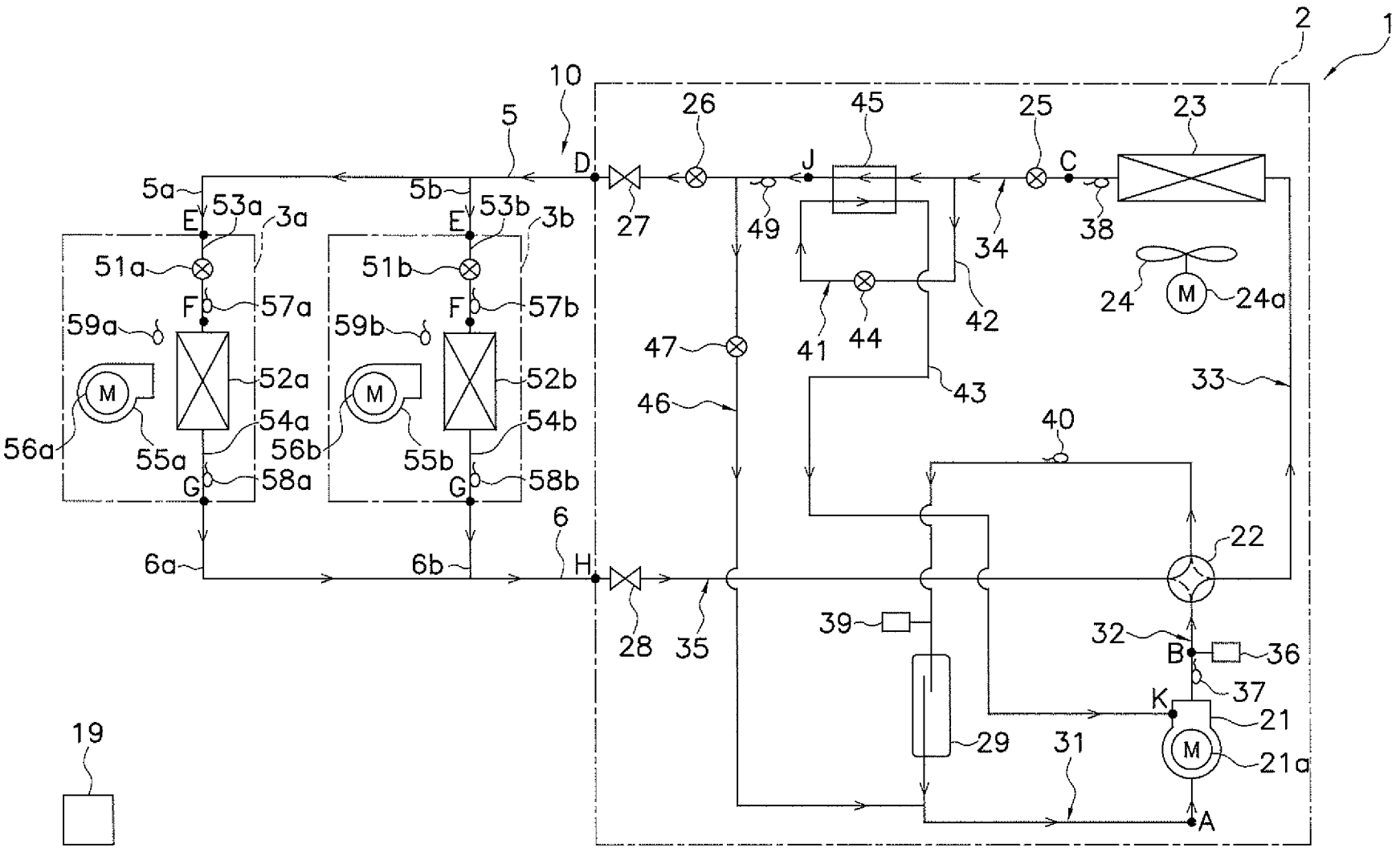
FIG. 13 is a schematic configuration diagram of the air conditioner according to a third modification of the second embodiment of the present invention.

As illustrated in FIG. 13, the refrigerant return pipe 41 may be connected to an intermediate portion of the compression stroke of the compressor 21.

Figure 14:
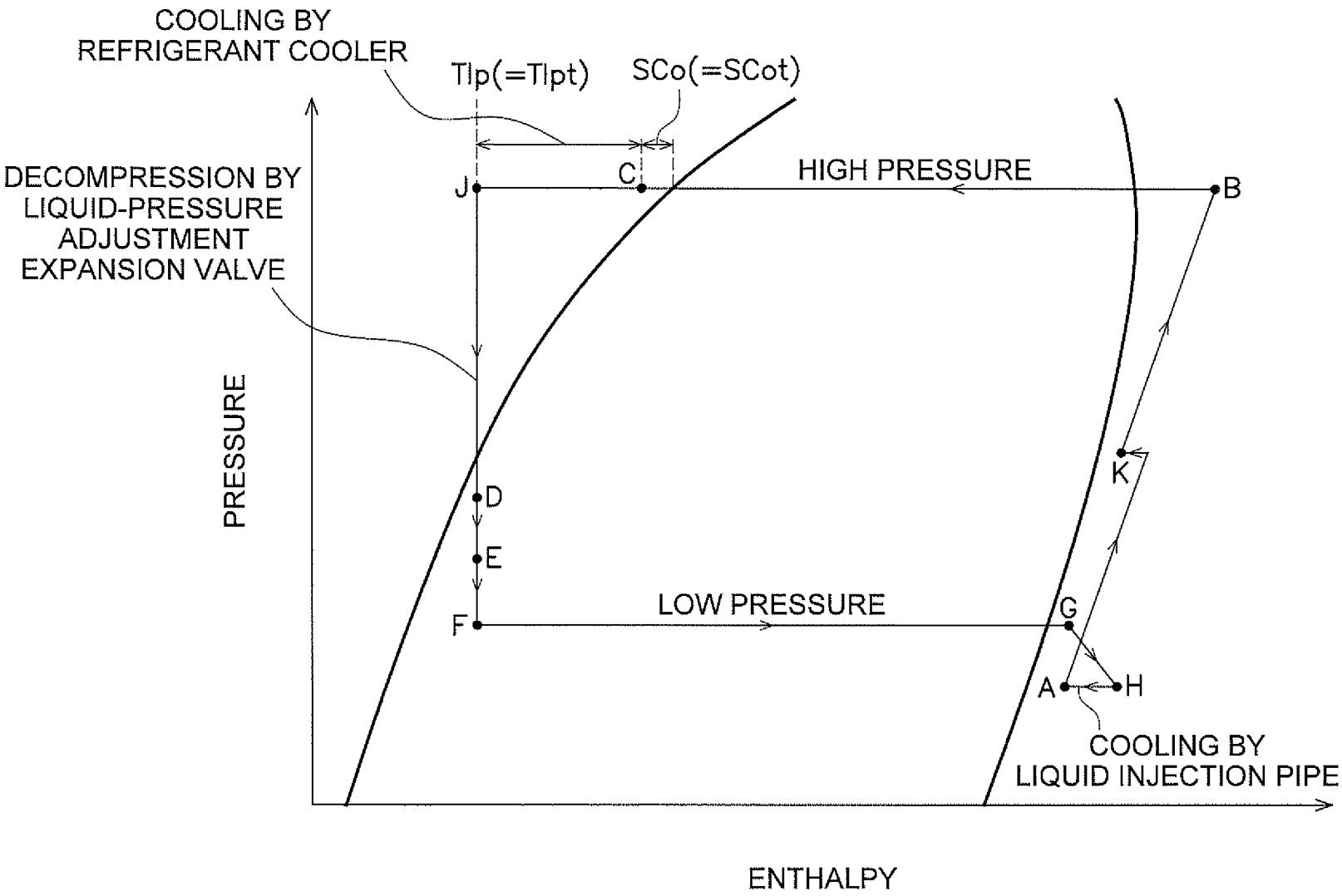
FIG. 14 is a pressure-enthalpy chart showing a refrigeration cycle during cooling operation in the air conditioner according to the third modification of the second embodiment of the present invention.

The configuration differs from the second embodiment in that, as illustrated in FIGS. 13 and 14, the refrigerant, which has been branched from the outdoor liquid-refrigerant pipe 34 to the refrigerant return pipe 41, is fed to the intermediate portion of the compression stroke of the compressor 21, and the temperature of the refrigerant, which has been compressed to the intermediate pressure in the compressor 21, is decreased (see point K in FIG. 14). Even in this case, the control and so forth on the liquid-pressure adjustment expansion valve 26 for transporting the refrigerant in the two-phase state is similar to that of the second embodiment, and hence the description is omitted here.

Figure 15:
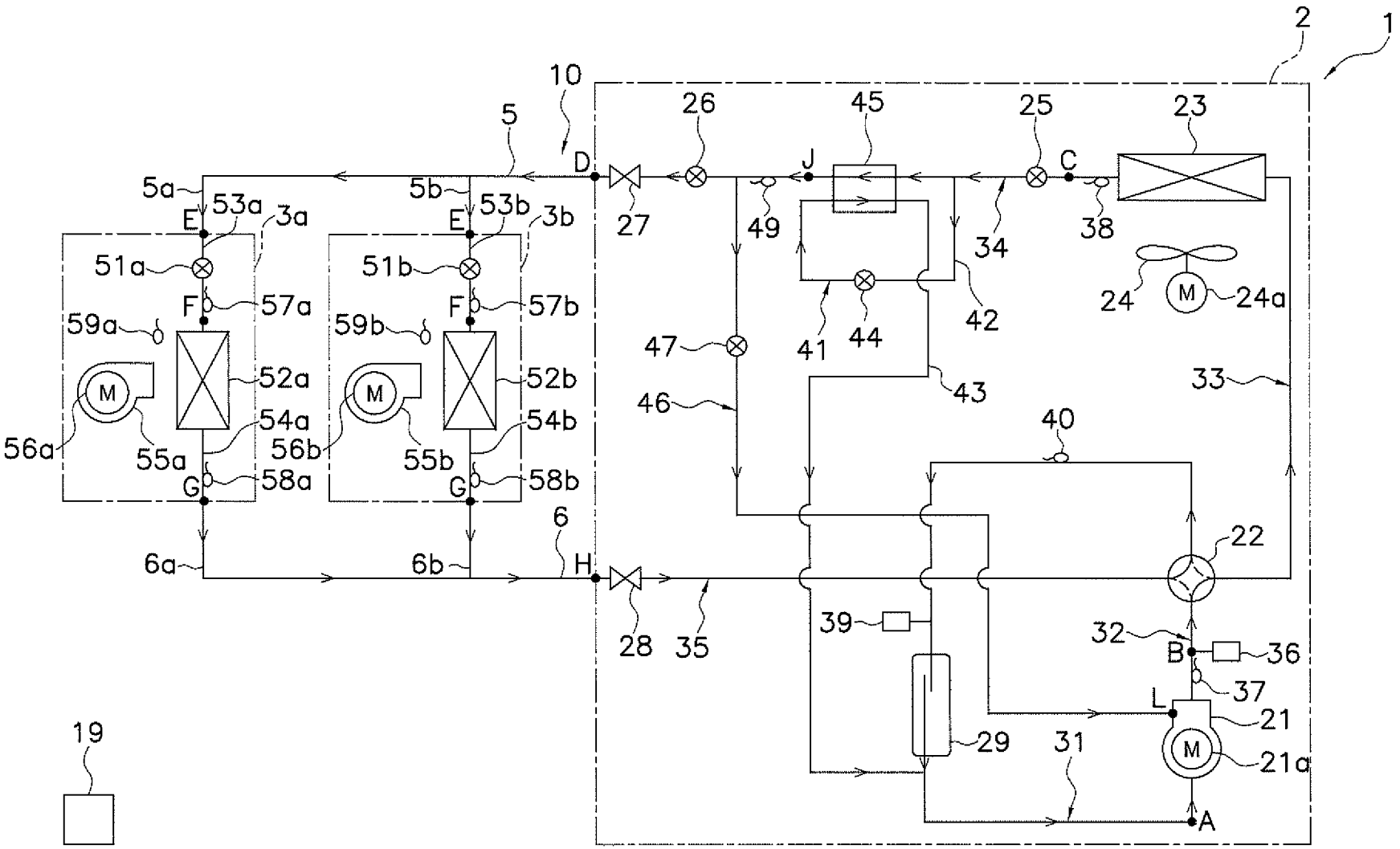
FIG. 15 is a schematic configuration diagram of the air conditioner according to the third modification of the second embodiment of the present invention.

As illustrated in FIG. 15, the liquid injection pipe 46 may be connected to an intermediate portion of a compression stroke of the compressor 21.

Figure 16:
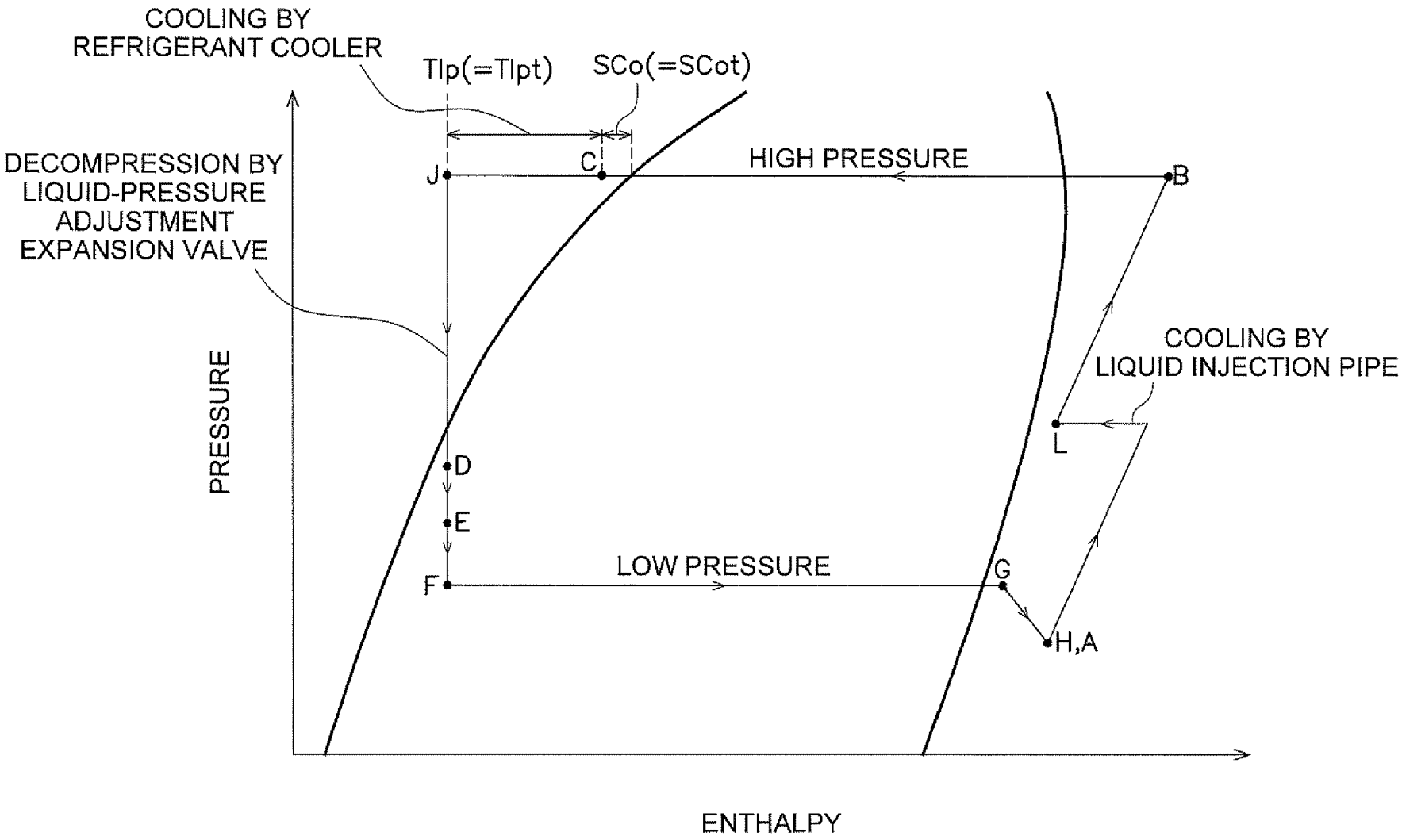
FIG. 16 is a pressure-enthalpy chart showing a refrigeration cycle during cooling operation in the air conditioner according to the third modification of the second embodiment of the present invention.

With the configuration, as illustrated in FIGS. 15 and 16, unlike the second embodiment (see points H and A in FIG. 9), an increase in the discharge temperature Td of the compressor 21 can be suppressed by feeding the refrigerant, which has been branched from the outdoor liquid-refrigerant pipe 34 to the liquid injection pipe 46, to the intermediate portion of the compression stroke of the compressor 21 and decreasing the temperature of the refrigerant, which has been compressed to an intermediate pressure in the compressor 21 (see point L in FIG. 16). Even in this case, the control and so forth on the liquid-pressure adjustment expansion valve 26 for transporting the refrigerant in the two-phase state is similar to that of the second embodiment, and hence the description is omitted here.

Furthermore, although not illustrated, the refrigerant, which has been branched from the outdoor liquid-refrigerant pipe 34 to the liquid injection pipe 46, and the refrigerant, which has been branched from the outdoor liquid-refrigerant pipe 34 to the refrigerant return pipe 41, both may be fed to the intermediate portion of the compression stroke of the compressor 21 and the temperature of the refrigerant, which has been compressed to the intermediate pressure in the compressor 21, may be decreased similarly to FIG. 16.

<Fourth Modification>

Figure 17:
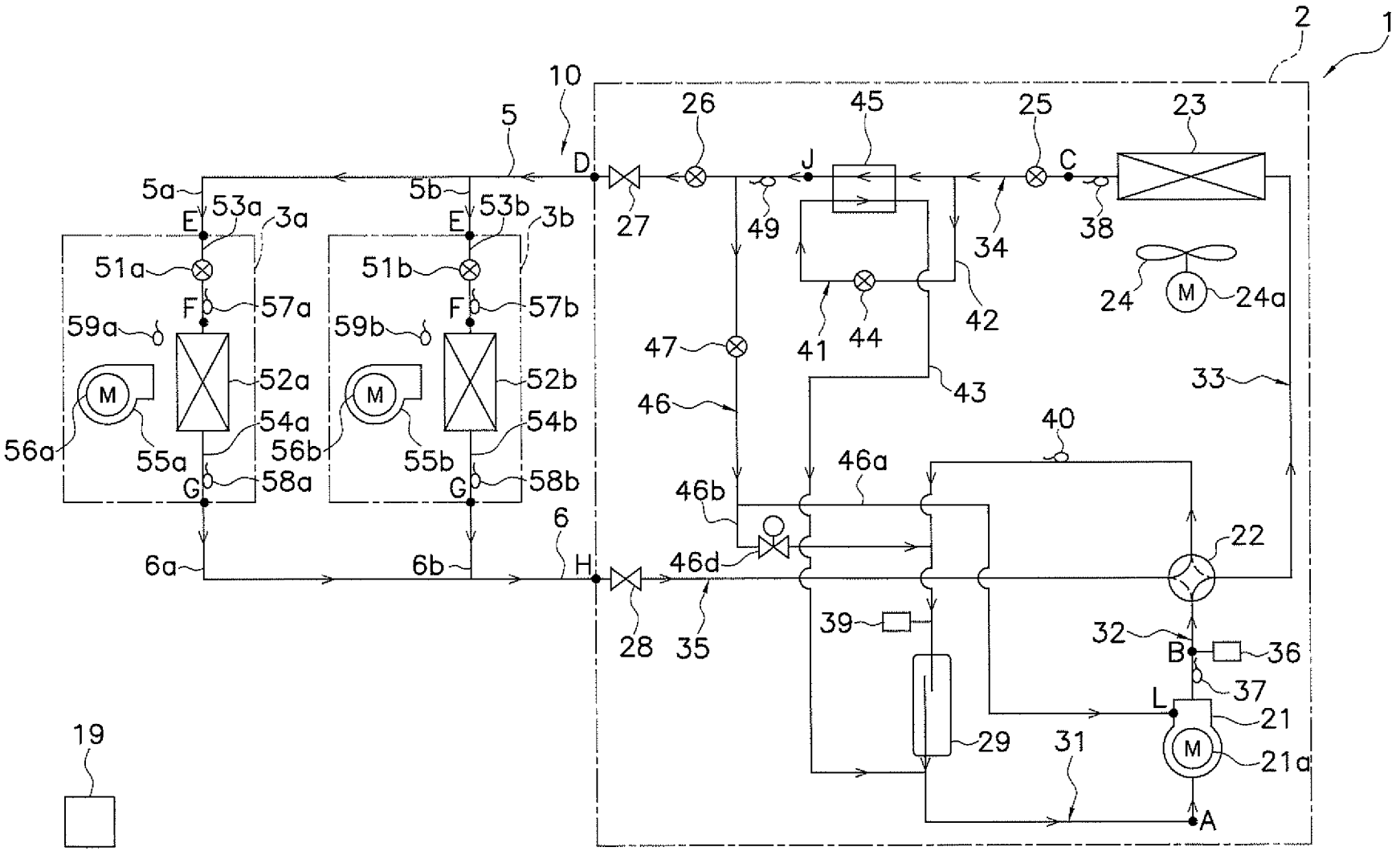
FIG. 17 is a schematic configuration diagram of an air conditioner according to a fourth modification of the second embodiment of the present invention.
Figure 18:
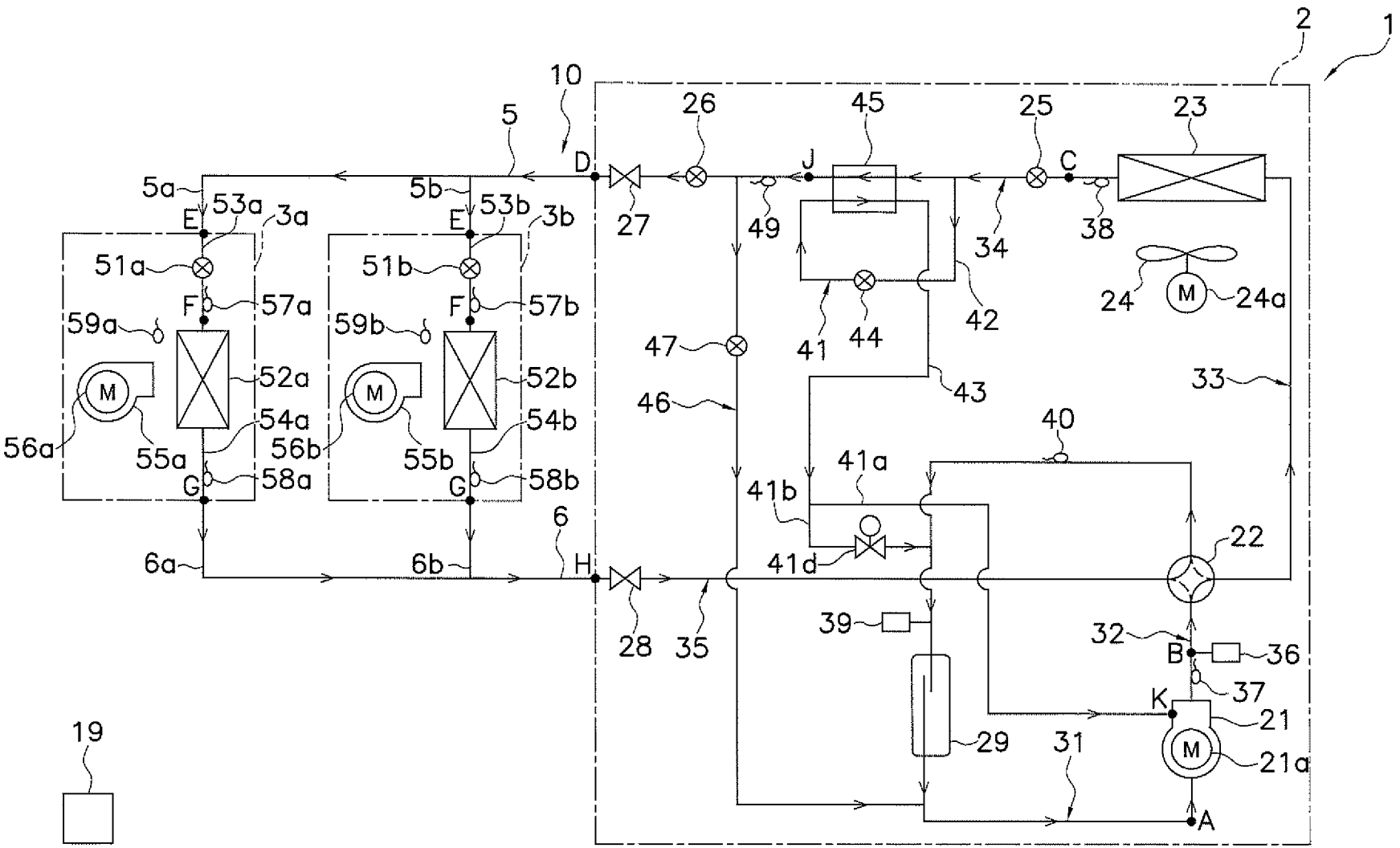
FIG. 18 is a schematic configuration diagram of the air conditioner according to the fourth modification of the second embodiment of the present invention.

Also in the air conditioner 1 of the third modification (see FIG. 13) of the second embodiment, similarly to the second modification (see FIG. 11), as illustrated in FIG. 17, the liquid injection pipe 46 may be bifurcated and connected to both a portion of the suction refrigerant pipe 31 on the inlet side of the accumulator 29 and an intermediate portion of the compression stroke of the compressor 21. One of the branched pipes of the liquid injection pipe 46 connected to the intermediate portion of the compression stroke of the compressor 21 is referred to as the first liquid injection pipe 46*a*, and the other of the branched pipes of the liquid injection pipe 46 connected to the portion on the inlet side of the accumulator 29 is referred to as the second liquid injection pipe 46*b*. Since the liquid injection pipe 46 is connected to both the portion of the suction refrigerant pipe 31 on the inlet side of the accumulator 29 and the intermediate portion of the compression stroke of the compressor 21, the refrigerant flowing through the liquid injection pipe 46 can be fed to the intermediate portion of the compression stroke of the compressor 21 to decrease the temperature of the refrigerant compressed to the intermediate pressure in the compressor 21, and the refrigerant flowing through the liquid injection pipe 46 can be fed to the inlet side of the accumulator, for example, to prevent occurrence of liquid compression in the compressor 21. In addition, as illustrated in FIG. 18, the refrigerant return pipe 41 may be bifurcated and connected to both a portion of the suction refrigerant pipe 31 on the inlet side of the accumulator 29 and an intermediate portion of the compression stroke of the compressor 21. One of the branched pipes of the refrigerant return pipe 41 connected to the portion on the outlet side of the accumulator 29 is referred to as the first refrigerant return pipe 41*a*, and the other of the branched pipes of the refrigerant return pipe 41 connected to the portion on the inlet side of the accumulator 29 is referred to as the second refrigerant return pipe 41*b*.

In addition, by using the configuration in which the liquid injection pipe 46 in FIG. 17 is bifurcated and connected to both the portions of the suction refrigerant pipe 31 on the inlet side of the accumulator 29 and the intermediate portion of the compression stroke of the compressor 21, an increase in the discharge pressure Pd of the compressor 21 can be suppressed. More specifically, a liquid relief valve 46*d* is provided in the second liquid injection pipe 46*b* of the liquid injection pipe 46 connected to the portion on the inlet side of the accumulator 29. The liquid relief valve 46*d* is controlled so that the discharge pressure Pd of the compressor 21 does not exceed a predetermined discharge pressure threshold Pdx (for example, upper-limit discharge pressure). More specifically, when the discharge pressure Pd has increased above the discharge pressure threshold Pdx, the control unit 19 performs control to open the liquid relief valve 46*d* until the discharge pressure Pd becomes the discharge pressure threshold Pdx or lower. Thus, the liquid refrigerant existing in the outdoor heat exchanger 23 can be fed to and retracted in the accumulator 29 via the liquid injection pipe 46. Consequently, an increase in the discharge pressure Pd can be suppressed. Since the refrigerant can be fed from the outdoor liquid-refrigerant pipe 34 to the accumulator 29 via the liquid injection pipe 46 by controlling the liquid relief valve 46*d* provided in the second liquid injection pipe 46*b* of the liquid injection pipe 46 connected to the portion on the inlet side of the accumulator 29, an increase in the discharge pressure Pd of the compressor 21 can be suppressed. In addition, by using the configuration in which the refrigerant return pipe 41 in FIG. 18 is bifurcated and connected to both the portion of the suction refrigerant pipe 31 on the inlet side of the accumulator 29 and the intermediate portion of the compression stroke of the compressor 21, an increase in the discharge pressure Pd of the compressor 21 may be suppressed. More specifically, similarly to the liquid injection pipe 46, a liquid relief valve 41*d* is provided in the second refrigerant return pipe 41*b* of the refrigerant return pipe 41 connected to the portion on the inlet side of the accumulator 29. The liquid relief valve 41*d* is controlled so that the discharge pressure Pd of the compressor 21 does not exceed a predetermined discharge pressure threshold Pdx.

(3) Third Embodiment

<Configuration>

Figure 19:
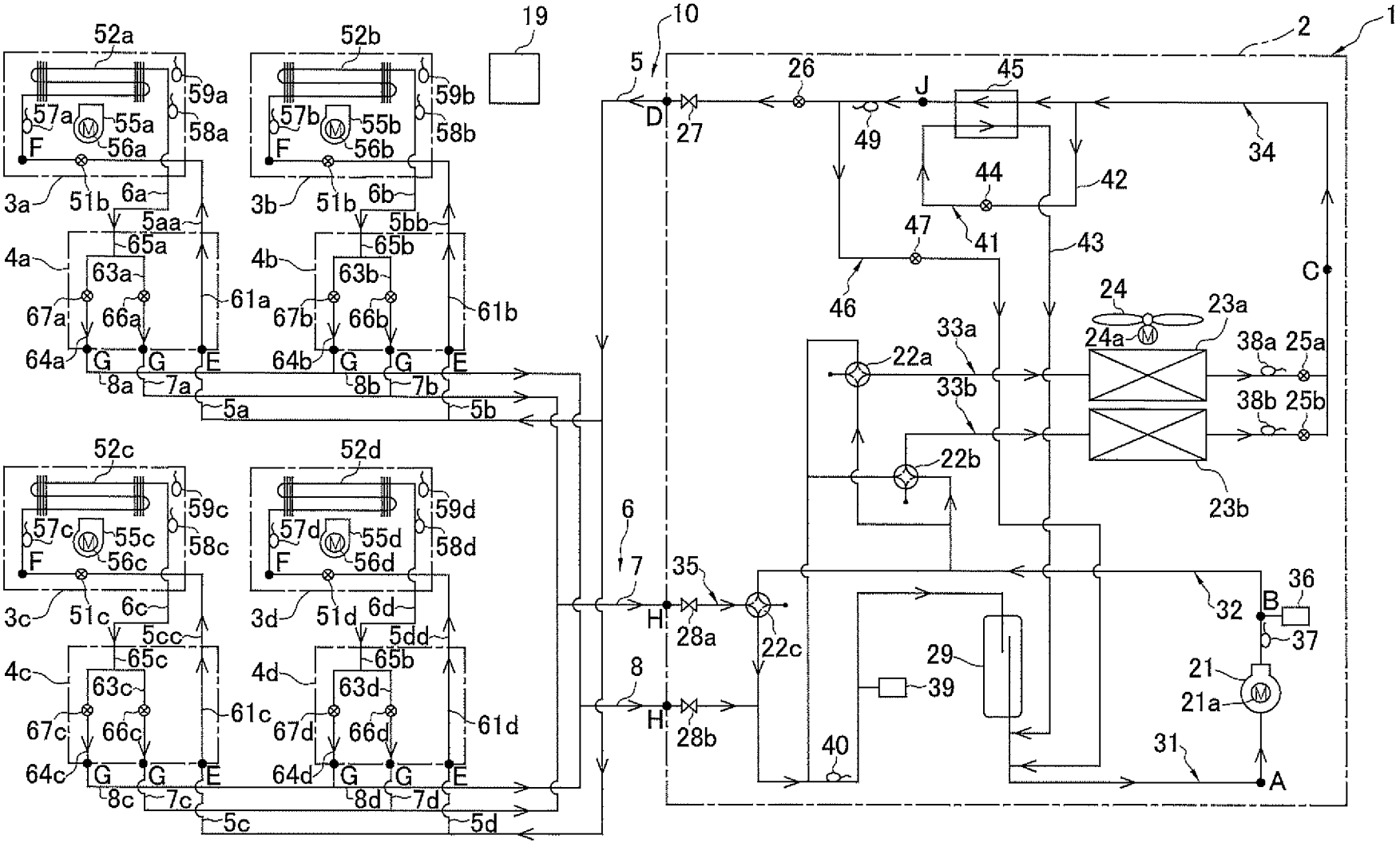
FIG. 19 is a schematic configuration diagram of an air conditioner according to a third embodiment of the present invention.

FIG. 19 is a schematic configuration diagram of an air conditioner 1 according to a third embodiment of the present invention. The air conditioner 1 is an apparatus that performs cooling and heating in a room of a building or the like through a vapor compression refrigeration cycle. The air conditioner 1 mainly includes an outdoor unit 2, a plurality of (in this case, four) indoor units 3*a*, 3*b*, 3*c*, and 3*d* that are mutually connected in parallel, relay units 4*a*, 4*b*, 4*c*, and 4*d* that are connected to the indoor units 3*a*, 3*b*, 3*c*, and 3*d*, respectively, refrigerant connection pipes 5 and 6 that connect the outdoor unit 2 to the indoor units 3*a*, 3*b*, 3*c*, and 3*d* via the relay units 4*a*, 4*b*, 4*c*, and 4*d*, and a control unit 19 that controls components of the outdoor unit 2, the indoor units 3*a*, 3*b*, 3*c*, and 3*d*, and the relay units 4*a*, 4*b*, 4*c*, and 4*d*. A vapor compression refrigerant circuit 10 of the air conditioner 1 is defined by connecting the outdoor unit 2, the indoor units 3*a*, 3*b*, 3*c*, and 3*d*, the relay units 4*a*, 4*b*, 4*c*, and 4*d*, and the refrigerant connection pipes 5 and 6 to one another. The refrigerant circuit 10 is filled with a refrigerant such as R32. The air conditioner 1 allows the indoor units 3*a*, 3*b*, 3*c*, and 3*d* to individually perform cooling operation or heating operation via the relay units 4*a*, 4*b*, 4*c*, and 4*d*. By feeding the refrigerant from the indoor unit that performs heating operation to the indoor unit that performs cooling operation, heat can be recovered among the indoor units (in this case, cooling operation and heating operation can be simultaneously performed, i.e., cooling and heating simultaneous operation can be performed).

—Connection Pipes—

The liquid-refrigerant connection pipe 5 mainly includes a joint pipe portion extending from the outdoor unit 2, first branch pipe portions 5*a*, 5*b*, 5*c*, and 5*d* that are a plurality of (in this case, four) branched pipe portions branched before the relay units 4*a*, 4*b*, 4*c*, and 4*d*, and second branch pipe portions 5*aa*, 5*bb*, 5*cc*, and 5*dd* that connect the relay units 4*a*, 4*b*, 4*c*, and 4*d* to the indoor units 3*a*, 3*b*, 3*c*, and 3*d*. The gas-refrigerant connection pipe 6 mainly includes a high-and-low-pressure gas-refrigerant connection pipe 7, a low-pressure gas-refrigerant connection pipe 8, and branch pipe portions 6*a*, 6*b*, 6*c*, and 6*d* that connect the relay units 4*a*, 4*b*, 4*c*, and 4*d* to the indoor units 3*a*, 3*b*, 3*c*, and 3*d*. The high-and-low-pressure gas-refrigerant connection pipe 7 includes a joint pipe portion extending from the outdoor unit 2 and branch pipe portions 7*a*, 7*b*, 7*c*, and 7*d* that are a plurality of (in this case, four) branched pipe portions branched before the relay units 4*a*, 4*b*, 4*c*, and 4*d*. The low-pressure gas-refrigerant connection pipe 8 includes a joint pipe portion extending from the outdoor unit 2 and branch pipe portions 8*a*, 8*b*, 8*c*, and 8*d* that are a plurality of (in this case, four) branched pipe portions branched before the relay units 4*a*, 4*b*, 4*c*, and 4*d*.

—Indoor Units—

The indoor units 3*a*, 3*b*, 3*c*, and 3*d* are installed in rooms of the building or the like. The indoor units 3*a*, 3*b*, 3*c*, and 3*d* are connected to the outdoor unit 2 via the liquid-refrigerant connection pipe 5, the gas-refrigerant connection pipe 6 (the high-and-low-pressure gas-refrigerant connection pipe 7, the low-pressure gas-refrigerant connection pipe 8, and the branch pipe portions 6*a*, 6*b*, 6*c*, and 6*d*), and the relay units 4*a*, 4*b*, 4*c*, and 4*d*; and constitute part of the refrigerant circuit 10 as described above.

The configurations of the indoor units 3*a*, 3*b*, 3*c*, and 3*d* are similar to the configurations of the indoor units 3*a* and 3*b* of the first and second embodiments, and the description is omitted here.

—Relay Units—

The relay units 4*a*, 4*b*, 4*c*, and 4*d* are installed in the rooms of the building or the like together with the indoor units 3*a*, 3*b*, 3*c*, and 3*d*. The relay units 4*a*, 4*b*, 4*c*, and 4*d*, together with the liquid-refrigerant connection pipe 5 and the gas-refrigerant connection pipe 6 (the high-and-low-pressure gas-refrigerant connection pipe 7, the low-pressure gas-refrigerant connection pipe 8, and the branch pipe portions 6*a*, 6*b*, 6*c*, and 6*d*), are arranged between the indoor units 3*a*, 3*b*, 3*c*, and 3*d* and the outdoor unit 2; and constitute part of the refrigerant circuit 10.

Configurations of the relay units 4*a*, 4*b*, 4*c*, and 4*d* are described next. Since the configuration of the relay units 4*a* is similar to the configurations of the relay units 4*b*, 4*c*, and 4*d*, only the configuration of the relay unit 4*a* is described here. For each of the configurations of the relay units 4*b*, 4*c*, and 4*d*, a letter "b", "c", or "d" is applied to each component of the relay unit 4*b*, 4*c*, or 4*d* instead of a letter "a" indicative of each component of the relay unit 4*a*, and the description of each component of the relay unit 4*b*, 4*c*, or 4*d* is omitted.

The relay unit 4*a* mainly includes a liquid connection pipe 61*a* and a gas connection pipe 62*a*.

The liquid connection pipe 61*a* has one end that is connected to the first branch pipe portion 5*a* of the liquid-refrigerant connection pipe 5, and the other end that is connected to the second branch pipe portion 5*aa* of the liquid-refrigerant connection pipe 5.

The gas connection pipe 62*a* includes a high-pressure gas connection pipe 63*a* that is connected to the branch pipe portion 7*a* of the high-and-low-pressure gas-refrigerant connection pipe 7, a low-pressure gas connection pipe 64*a* that is connected to the branch pipe portion 8*a* of the low-pressure gas-refrigerant connection pipe 8, and a joint gas connection pipe 65*a* that joins the high-pressure gas connection pipe 63*a* and the low-pressure gas connection pipe 64*a* to each other. The joint gas connection pipe 65*a* is connected to the branch pipe portion 6*a* of the gas-refrigerant connection pipe 6. The high-pressure gas connection pipe 63*a* is provided with a high-pressure gas valve 66*a*. The low-pressure gas connection pipe 64*a* is provided with a low-pressure gas valve 67*a*. The high-pressure gas valve 66*a* and the low-pressure gas valve 67*a* are electrically powered expansion valves.

When the indoor unit 3*a* performs cooling operation, the relay unit 4*a* can function to open the low-pressure gas valve 67*a*, thereby allowing the refrigerant to flow into the liquid connection pipe 61*a* via the first branch pipe portion 5*a* of the liquid-refrigerant connection pipe 5, to feed the flowing-in refrigerant to the indoor unit 3*a* via the second branch pipe portion 5*aa* of the liquid-refrigerant connection pipe 5, and then to return the refrigerant evaporated through heat exchange with the indoor air in the indoor heat exchanger 52*a* to the branch pipe portion 8*a* of the low-pressure gas-refrigerant connection pipe 8 via the branch pipe portion 6*a* of the gas-refrigerant connection pipe 6, the joint gas connection pipe 65*a*, and the low-pressure gas connection pipe 64*a*. When the indoor unit 3*a* performs heating operation, the relay unit 4*a* can function to close the low-pressure gas valve 67*a* and open the high-pressure gas valve 66*a*, thereby allowing the refrigerant to flow into the high-pressure gas connection pipe 63*a* and the joint gas connection pipe 65*a* via the branch pipe portion 7*a* of the high-and-low-pressure gas-refrigerant connection pipe 7, to feed the flowing-in refrigerant to the indoor unit 3*a* via the branch pipe portion 6*a* of the gas-refrigerant connection pipe 6, and then to return the refrigerant radiated through heat exchange with the indoor air in the indoor heat exchanger 52*a* to the first branch pipe portion 5*a* of the liquid-refrigerant connection pipe 5 via the second branch pipe portion 5*aa* of the liquid-refrigerant connection pipe 5, and the liquid connection pipe 61*a*. The functions of the relay units 4*a*, 4*b*, and 4*c* are similar to the function of the relay unit 4*a*. The relay units 4*a*, 4*b*, 4*c*, and 4*d* can individually switch the indoor heat exchangers 52*a*, 52*b*, 52*c*, and 52*d* between evaporators or radiators of the refrigerant.

—Outdoor Unit—

The outdoor unit 2 is installed outside the rooms of the building or the like. The outdoor unit 2 is connected to the indoor units 3*a*, 3*b*, 3*c*, and 3*d* via the liquid-refrigerant connection pipe 5, the gas-refrigerant connection pipe 6 (the high-and-low-pressure gas-refrigerant connection pipe 7, the low-pressure gas-refrigerant connection pipe 8, and the branch pipe portions 6*a*, 6*b*, 6*c*, and 6*d*), and the relay units 4*a*, 4*b*, 4*c*, and 4*d*; and constitutes part of the refrigerant circuit 10 as described above.

The outdoor unit 2 mainly includes a compressor 21 and a plurality of (in this case, two) outdoor heat exchangers 23*a* and 23*b*. The outdoor unit 2 also includes switching mechanisms 22*a* and 22*b* that each switch between a radiation operation state in which each of the outdoor heat exchangers 23*a* and 23*b* functions as a radiator of the refrigerant and an evaporation operation state in which each of the outdoor heat exchangers 23*a* and 23*b* functions as an evaporator of the refrigerant. The switching mechanisms 22*a* and 22*b* and a suction side of the compressor 21 are connected by a suction refrigerant pipe 31. The suction refrigerant pipe 31 is provided with an accumulator 29 that temporarily stores the refrigerant to be sucked into the compressor 21. A discharge side of the compressor 21 and the switching mechanisms 22*a* and 22*b* are connected by a discharge refrigerant pipe 32. The switching mechanism 22*a* and gas-side ends of the outdoor heat exchangers 23*a* and 23*b* are connected by first outdoor gas-refrigerant pipes 33*a* and 33*b*. Liquid-side ends of the outdoor heat exchangers 23*a* and 23*b* and the liquid-refrigerant connection pipe 5 are connected by an outdoor liquid-refrigerant pipe 34. A liquid-side shutoff valve 27 is provided at a connection portion between the outdoor liquid-refrigerant pipe 34 and the liquid-refrigerant connection pipe 5. In addition, the outdoor unit 2 includes a third switching mechanism 22*c* that switches between a refrigerant outflow state in which the refrigerant, which has been discharged from the compressor 21, to the high-and-low-pressure gas-refrigerant connection pipe 7, and a refrigerant inflow state in which the refrigerant flowing through the high-and-low-pressure gas-refrigerant connection pipe 7 to the suction refrigerant pipe 31. The third switching mechanism 22*c* and the high-and-low-pressure gas-refrigerant connection pipe 7 are connected by a second outdoor gas-refrigerant pipe 35. The third switching mechanism 22*c* and the suction side of the compressor 21 are connected by the suction refrigerant pipe 31. The discharge side of the compressor 21 and the third switching mechanism 22*c* are connected by the discharge refrigerant pipe 32. A high-and-low-pressure gas-side shutoff valve 28*a* is provided at a connection portion between the second outdoor gas-refrigerant pipe 35 and the high-and-low-pressure gas-refrigerant connection pipe 7. The suction refrigerant pipe 31 is connected to the low-pressure gas-refrigerant connection pipe 8. A low-pressure gas-side shutoff valve 28*b* is provided at a connection portion between the suction refrigerant pipe 31 and the low-pressure gas-refrigerant connection pipe 8. The liquid-side shutoff valve 27 and the gas-side shutoff valves 28*a* and 28*b* are valves that are manually opened and closed.

The compressor 21 is a device that compresses a refrigerant. For example, a hermetic compressor in which a rotary or scroll positive-displacement compression element (not illustrated) is rotationally driven by a compressor motor 21*a* is used.

The first switching mechanism 22*a* is a device capable of switching the flow of the refrigerant in the refrigerant circuit 10 to connect the discharge side of the compressor 21 and the gas side of the first outdoor heat exchanger 23*a* (see solid lines of the first switching mechanism 22*a* in FIG. 19) when the first outdoor heat exchanger 23*a* functions as a radiator of the refrigerant (referred to as "outdoor radiation state" hereinafter) and to connect the suction side of the compressor 21 and the gas side of the first outdoor heat exchanger 23*a* (see broken lines of the first switching mechanism 22*a* in FIG. 19) when the first outdoor heat exchanger 23*a* functions as an evaporator of the refrigerant (referred to as "outdoor evaporation state" hereinafter). The first switching mechanism 22*a* is, for example, a four-way switching valve. The second switching mechanism 22*b* is a device capable of switching the flow of the refrigerant in the refrigerant circuit 10 to connect the discharge side of the compressor 21 and the gas side of the second outdoor heat exchanger 23*b* (see solid lines of the second switching mechanism 22*b* in FIG. 19) when the second outdoor heat exchanger 23*b* functions as a radiator of the refrigerant (referred to as "outdoor radiation state" hereinafter) and to connect the suction side of the compressor 21 and the gas side of the second outdoor heat exchanger 23*b* (see broken lines of the second switching mechanism 22*b* in FIG. 19) when the second outdoor heat exchanger 23*b* functions as an evaporator of the refrigerant (referred to as "outdoor evaporation state" hereinafter). The second switching mechanism 22*b* is, for example, a four-way switching valve. By changing the switching states of the switching mechanisms 22*a* and 22*b*, the functions of the outdoor heat exchangers 23*a* and 23*b* can be individually switched between evaporators or radiators of the refrigerant.

The first outdoor heat exchanger 23*a* is a heat exchanger that functions as a radiator of the refrigerant or an evaporator of the refrigerant. The second outdoor heat exchanger 23*b* is a heat exchanger that functions as a radiator of the refrigerant or an evaporator of the refrigerant. The outdoor unit 2 includes an outdoor fan 24 that sucks the outdoor air into the outdoor unit 2, that allows the outdoor air to exchange heat with the refrigerant in the outdoor heat exchangers 23*a* and 23*b*, and then that discharges the outdoor air to the outside. That is, the outdoor unit 2 includes the outdoor fan 24 as a fan that supplies the outdoor air, which serves as a cooling source or a heating source of the refrigerant flowing in the outdoor heat exchangers 23*a* and 23*b*, to the outdoor heat exchangers 23*a* and 23*b*. The outdoor fan 24 is driven by an outdoor fan motor 24*a*.

The third switching mechanism 22*c* is a device capable of switching the flow of the refrigerant in the refrigerant circuit 10 to connect the discharge side of the compressor 21 and the high-and-low-pressure gas-refrigerant connection pipe 7 (see broken lines of the third switching mechanism 22*c* in FIG. 19) when the refrigerant discharged from the compressor 21 is fed to the high-and-low-pressure gas-refrigerant connection pipe 7 (referred to as "refrigerant outflow state" hereinafter) and to connect the suction side of the compressor 21 and the high-and-low-pressure gas-refrigerant connection pipe 7 (see solid lines of the third switching mechanism 22*c* in FIG. 19) when the refrigerant flowing through the high-and-low-pressure gas-refrigerant connection pipe 7 is fed to the suction refrigerant pipe 31 (referred to as "refrigerant inflow state" hereinafter). The third switching mechanism 22*c* is, for example, a four-way switching valve.

Focusing only on the compressor 21, the outdoor heat exchangers 23*a* and 23*b*, the liquid-refrigerant connection pipe 5, and the indoor heat exchangers 52*a*, 52*b*, 52*c*, and 52*d*, the air conditioner 1 performs an operation (cooling only operation and cooling main operation) of sending the refrigerant, which has been discharged from the compressor 21, to the outdoor heat exchangers 23*a* and 23*b*, the liquid-refrigerant connection pipe 5, and the indoor heat exchangers 52*a*, 52*b*, 52*c*, and 52*d* in that order. In this case, cooling only operation represents an operation state in which only an indoor heat exchanger that functions as an evaporator of the refrigerant exists, and cooling main operation represents a state in which both an indoor heat exchanger that functions as an evaporator of the refrigerant and an indoor heat exchanger that functions as a radiator of the refrigerant exist; however, a load on the evaporation side is relatively large as a whole. Focusing only on the compressor 21, the gas-refrigerant connection pipe 6, the indoor heat exchangers 52*a*, 52*b*, 52*c*, and 52*d*, the liquid-refrigerant connection pipe 5, and the outdoor heat exchangers 23*a* and 23*b*, the air conditioner 1 performs an operation (heating only operation and heating main operation) of sending the refrigerant, which has been discharged from the compressor 21, to the gas-refrigerant connection pipe 6, the indoor heat exchangers 52*a*, 52*b*, 52*c*, and 52*d*, the liquid-refrigerant connection pipe 5, and the outdoor heat exchangers 23*a* and 23*b* in that order. In this case, heating only operation represents an operation state in which only an indoor heat exchanger that functions as a radiator of the refrigerant exists, and heating main operation represents a state in which both an indoor heat exchanger that functions as an evaporator of the refrigerant and an indoor heat exchanger that functions as a radiator of the refrigerant exist; however, a load on the radiation side is relatively large as a whole. During cooling only operation and cooling main operation, at least one of the switching mechanisms 22*a* and 22*b* is switched to the outdoor radiation state and the outdoor heat exchangers 23*a* and 23*b* function as a radiator of the refrigerant as a whole. In this state, the refrigerant flows from the outdoor unit 2 to the indoor units 3*a*, 3*b*, 3*c*, and 3*d* via the liquid-refrigerant connection pipe 5. During heating only operation and heating main operation, at least one of the switching mechanisms 22*a* and 22*b* is switched to the outdoor evaporation state, the third switching mechanism 22*c* is switched to the refrigerant outflow state, and the outdoor heat exchangers 23*a* and 23*b* function as an evaporator of the refrigerant as a whole. In this state, the refrigerant flows from the indoor units 3*a*, 3*b*, 3*c*, and 3*d* to the outdoor unit 2 via the liquid-refrigerant connection pipe 5.

In addition, a liquid-pressure adjustment expansion valve 26, a liquid injection pipe 46, a refrigerant return pipe 41, and a refrigerant cooler 45 are provided in the outdoor liquid-refrigerant pipe 34 similarly to the outdoor unit 2 of the second embodiment. The configurations of the liquid-pressure adjustment expansion valve 26, the liquid injection pipe 46, the refrigerant return pipe 41, and the refrigerant cooler 45 are similar to those of the second embodiment, and the description is omitted here.

—Control Unit—

The control unit 19 is connected to control boards or the like (not illustrated) that are provided in the outdoor unit 2, the indoor units 3*a*, 3*b*, 3*c*, and 3*d*, and the relay units 4*a*, 4*b*, 4*c*, and 4*d* for communication. In FIG. 19, the control unit 19 is illustrated at a position separated from the outdoor unit 2, the indoor units 3*a*, 3*b*, 3*c* and 3*d*, and the relay units 4*a*, 4*b*, 4*c*, and 4*d* for the convenience of illustration. The control unit 19 controls the various components 21, 22*a* to 22*c*, 24, 25*a*, 25*b*, 26, 41, 47, 51*a* to 51*d*, 55*a* to 55*d*, 66*a* to 66*d*, and 67*a* to 67*d* of the air conditioner 1 (in this case, the outdoor unit 2, the indoor units 3*a*, 3*b*, 3*c*, and 3*d*, and the relay units 4*a*, 4*b*, 4*c*, and 4*d*) on the basis of detection signals or the like of the above-described various sensors 36, 37, 38, 39, 40, 49, 57*a* to 57*d*, 58*a* to 58*d*, and 59*a* to 59*d*. That is, the control unit 19 controls the entire operation of the air conditioner 1.

<Operations and Features of Air Conditioner>

Operations and features of the air conditioner 1 are described next with reference to FIGS. 19 and 9.

The air conditioner 1 performs cooling only operation, cooling main operation, heating only operation, and heating main operation as described above. During cooling only operation and cooling main operation, similarly to the first and second embodiments, the refrigerant is transported in the two-phase state by sending the refrigerant in the gas-liquid two-phase state to the liquid-refrigerant connection pipe 5 and feeding the refrigerant from the outdoor unit 2 to the indoor units 3*a*, 3*b*, 3*c*, and 3*d* using the liquid-pressure adjustment expansion valve 26 provided in the outdoor liquid-refrigerant pipe 34. Furthermore, during cooling only operation and cooling main operation, an operation is performed to cool the refrigerant in a portion of the outdoor liquid-refrigerant pipe 34 between the refrigerant cooler 45 and the liquid-pressure adjustment expansion valve 26 using the refrigerant return pipe 41 that branches part of the refrigerant flowing through the outdoor liquid-refrigerant pipe 34 and feeds the branched refrigerant to the compressor 21, and the refrigerant cooler 45 that cools the refrigerant flowing through a portion of the outdoor liquid-refrigerant pipe 34 on the side of the outdoor heat exchanger 23 with respect to the liquid-pressure adjustment expansion valve 26 with the refrigerant flowing through the refrigerant return pipe 41. Further, during cooling only operation and cooling main operation, an operation is performed to feed the refrigerant to the compressor 21 while suppressing a variation in the temperature (liquid-pipe temperature Tlp) of the refrigerant flowing through the outdoor liquid-refrigerant pipe 34 using the liquid injection pipe 46 that branches part of the refrigerant flowing through the outdoor liquid-refrigerant pipe 34 from the portion of the outdoor liquid-refrigerant pipe 34 on the side of the outdoor heat exchanger 23 with respect to the liquid-pressure adjustment expansion valve 26 and feeds the branched refrigerant to the compressor 21. Note that the control unit 19 that controls the components of the air conditioner 1 performs the operations of the air conditioner 1. Moreover, cooling only operation is representatively described below for an operation accompanied by the control on the liquid-pressure adjustment expansion valve 26 and so forth, and the description of cooling main operation is omitted.

For cooling only operation, for example, when all the indoor units 3*a*, 3*b*, 3*c*, and 3*d* perform cooling operation (that is, operation in which all the indoor heat exchangers 52*a*, 52*b*, 52*c*, and 52*d* function as evaporators of the refrigerant and the outdoor heat exchangers 23*a* and 23*b* function as radiators of the refrigerant), the switching mechanisms 22*a* and 22*b* are switched to the outdoor radiation states (the states indicated by solid lines of the switching mechanisms 22*a* and 22*b* in FIG. 19), and the compressor 21, the outdoor fan 24, and the indoor fans 55*a* and 55*b* are driven. In addition, the third switching mechanism 22*c* is switched to the refrigerant inflow state (the state indicated by solid lines of the switching mechanism 22*c* in FIG. 19), and the high-pressure gas valves 66*a*, 66*b*, 66*c*, and 66*d* and the low-pressure gas valves 67*a*, 67*b*, 67*c*, and 67*d* of the relay units 4*a*, 4*b*, 4*c*, and 4*d* are opened.

Then, the refrigerant at a high pressure discharged from the compressor 21 is fed to the outdoor heat exchangers 23*a* and 23*b* via the switching mechanisms 22*a* and 22*b* (see point B in FIGS. 19 and 9). The refrigerant fed to the outdoor heat exchangers 23*a* and 23*b* exchanges heat with the outdoor air supplied by the outdoor fan 24, and hence is cooled and condensed in the outdoor heat exchangers 23*a* and 23*b* that function as the radiators of the refrigerant (see point C in FIGS. 19 and 9). The refrigerant flows out from the outdoor unit 2 via the outdoor expansion valves 25*a* and 25*b*, the refrigerant cooler 45, the liquid-pressure adjustment expansion valve 26, and the liquid-side shutoff valve 27 (see point D in FIGS. 19 and 9).

The refrigerant flowing out from the outdoor unit 2 is branched and fed to the indoor units 3*a*, 3*b*, 3*c*, and 3*d* via the liquid-refrigerant connection pipe 5 and the relay units 4*a*, 4*b*, 4*c*, and 4*d* (see point E in FIGS. 19 and 9). The refrigerants fed to the indoor units 3*a*, 3*b*, 3*c*, and 3*d* are decompressed to a low pressure by the indoor expansion valves 51*a*, 51*b*, 51*c*, and 51*d* and then are fed to the indoor heat exchangers 52*a*, 52*b*, 52*c*, and 52*d* (see point F in FIGS. 19 and 9). The refrigerants fed to the indoor heat exchangers 52*a*, 52*b*, 52*c*, and 52*d* exchange heat with the indoor air supplied from the inside of the rooms by the indoor fans 55*a* and 55*b*, and hence are heated and evaporated in the indoor heat exchangers 52*a*, 52*b*, 52*c*, and 52*d* that function as the evaporators of the refrigerant (see point Gin FIGS. 19 and 9). The refrigerants flow out from the indoor units 3*a*, 3*b*, 3*c*, and 3*d*. In contrast, the indoor air cooled in the indoor heat exchangers 52*a*, 52*b*, 52*c*, and 52*d* is fed into the rooms, and thus the rooms are cooled.

The refrigerants flowing out from the indoor units 3*a*, 3*b*, 3*c*, and 3*d* are joined and fed to the outdoor unit 2 via the gas-refrigerant connection pipe 6 and the relay units 4*a*, 4*b*, 4*c*, and 4*d* (see point H in FIGS. 19 and 9). The refrigerant fed to the outdoor unit 2 is sucked into the compressor 21 via the gas-side shutoff valve 28 and the accumulator 29 (see point A in FIGS. 19 and 9).

During the above-described cooling only operation, the refrigerant is transported in the two-phase state by sending the refrigerant in the gas-liquid two-phase state to the liquid-refrigerant connection pipe 5 and feeding the refrigerant from the outdoor unit 2 to the indoor units 3*a*, 3*b*, 3*c*, and 3*d* using the liquid-pressure adjustment expansion valve 26 similarly to cooling operation of the first and second embodiments. In addition, when the refrigerant is to be transported in the two-phase state, similarly to cooling operation of the second embodiment, the refrigerant flowing through the outdoor liquid-refrigerant pipe 34 is cooled using the refrigerant return pipe 41 and the refrigerant cooler 45, and the refrigerant is properly transported in the two-phase state while suppressing an increase in the discharge temperature Td of the compressor 21 using the liquid injection pipe 46. The details of the operation are similar to the operation and control relating to the transport of the refrigerant in the two-phase state in cooling operation of the second embodiment, and hence the description is omitted here. The operation and control relating to the transport of the refrigerant in the two-phase state in cooling main operation are similar to those of cooling only operation.

<Modifications>

In the air conditioner 1 of the above-described third embodiment (see FIG. 19), while the liquid injection pipe 46 and the refrigerant return pipe 41 are connected to the portion of the suction refrigerant pipe 31 on the outlet side of the accumulator 29, the connection positions are not limited thereto. The connection positions of the liquid injection pipe 46 and the refrigerant return pipe 41 may be changed similarly to the second embodiment and the first to fourth modifications.

In the air conditioner 1 of the above-described third embodiment (see FIG. 19), while the refrigerant return pipe 41 and the refrigerant cooler 45 are provided, it is not limited thereto. The refrigerant return pipe 41 and the refrigerant cooler 45 may be omitted similarly to the first embodiment and the first to fourth modifications.

(4) Other Embodiments

<A>

In the air conditioner 1 of the second and third embodiments and the modifications, while the liquid injection pipe 46 is connected to the portion of the outdoor liquid-refrigerant pipe 34 between the refrigerant cooler 45 and the liquid-pressure adjustment expansion valve 26, it is not limited thereto.

Figure 21:
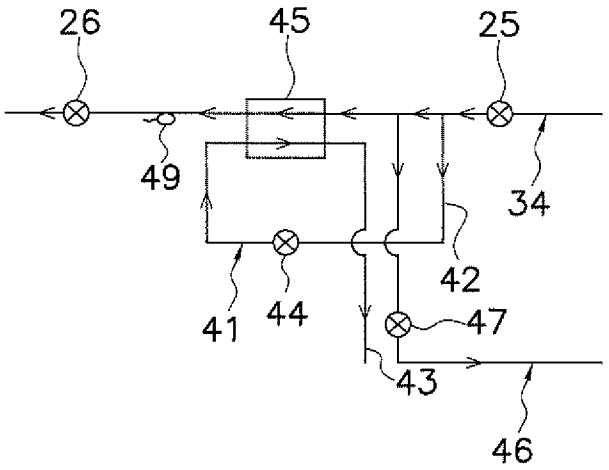
FIG. 21 is a schematic configuration diagram (only for the periphery of an outdoor liquid-refrigerant pipe) of an air conditioner according to still another embodiment of the present invention.
Figure 20:
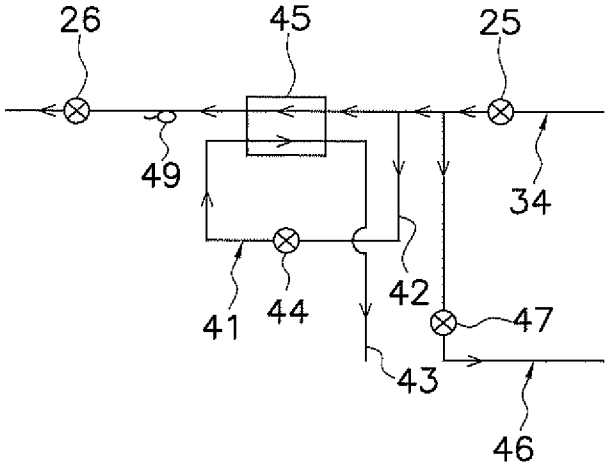
FIG. 20 is a schematic configuration diagram (only for the periphery of an outdoor liquid-refrigerant pipe) of an air conditioner according to another embodiment of the present invention.

For example, as illustrated in FIG. 20, the liquid injection pipe 46 may be connected to a position in the outdoor liquid-refrigerant pipe 34 close to the outdoor heat exchanger 23 with respect to the branch position of the refrigerant return pipe 41. Alternatively, as illustrated in FIG. 21, the liquid injection pipe 46 may be connected to a position in the outdoor liquid-refrigerant pipe 34 between the branch position of the refrigerant return pipe 41 and the refrigerant cooler 45.

<B>

In the air conditioner 1 of the second and third embodiments and the modifications, during cooling operation (including cooling only operation and cooling main operation), the refrigerant cooler 45 is a heat exchanger of a type in which the refrigerant flowing through the refrigerant return pipe 41 and the refrigerant flowing through the outdoor liquid-refrigerant pipe 34 form counter-current flows, and the refrigerant return pipe 41 is branched from the outdoor liquid-refrigerant pipe 34 at the position located upstream of the refrigerant cooler 45. However, it is not limited thereto.

Figure 23:
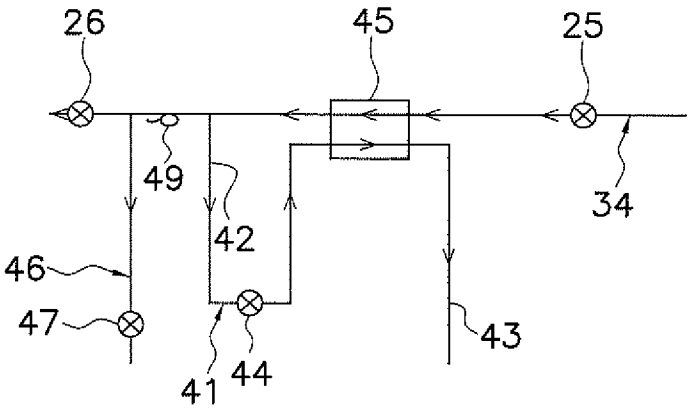
FIG. 23 is a schematic configuration diagram (only for the periphery of an outdoor liquid-refrigerant pipe) of an air conditioner according to a further embodiment of the present invention.
Figure 22:
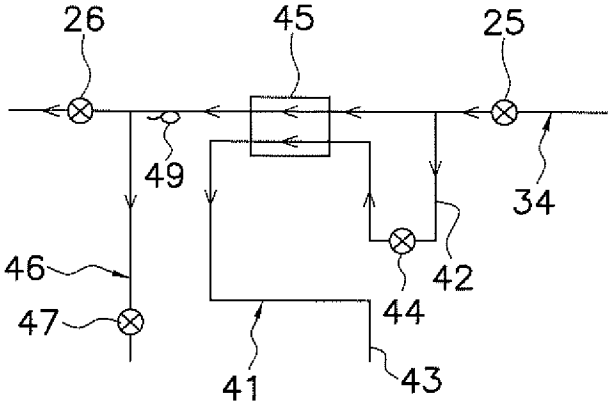
FIG. 22 is a schematic configuration diagram (only for the periphery of an outdoor liquid-refrigerant pipe) of an air conditioner according to yet another embodiment of the present invention.
Figure 24:
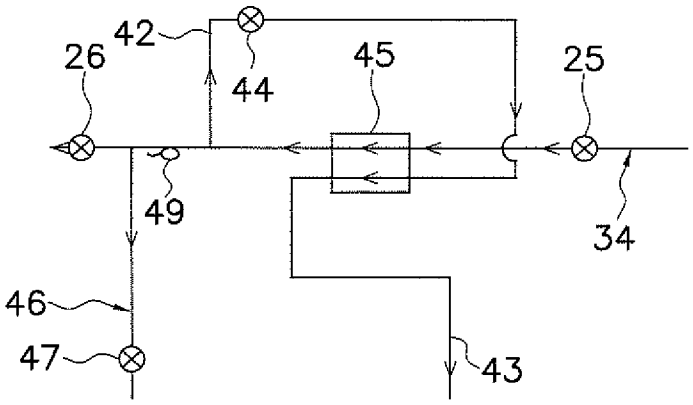
FIG. 24 is a schematic configuration diagram (only for the periphery of an outdoor liquid-refrigerant pipe) of an air conditioner according to a still further embodiment of the present invention.

For example, as illustrated in FIG. 22, during cooling operation (including cooling only operation and cooling main operation), the refrigerant cooler 45 may be a heat exchanger of a type in which the refrigerant flowing through the refrigerant return pipe 41 and the refrigerant flowing through the outdoor liquid-refrigerant pipe 34 form parallel-current (co-current) flows, and the refrigerant return pipe 41 may be branched from the outdoor liquid-refrigerant pipe 34 at a position located upstream of the refrigerant cooler 45. Alternatively, for example, as illustrated in FIG. 23, during cooling operation (including cooling only operation and cooling main operation), the refrigerant cooler 45 may be a heat exchanger of a type in which the refrigerant flowing through the refrigerant return pipe 41 and the refrigerant flowing through the outdoor liquid-refrigerant pipe 34 form counter-current flows, and the refrigerant return pipe 41 may be branched from the outdoor liquid-refrigerant pipe 34 at a position located downstream of the refrigerant cooler 45. Still alternatively, for example, as illustrated in FIG. 24, during cooling operation (including cooling only operation and cooling main operation), the refrigerant cooler 45 may be a heat exchanger of a type in which the refrigerant flowing through the refrigerant return pipe 41 and the refrigerant flowing through the outdoor liquid-refrigerant pipe 34 form parallel-current (co-current) flows, and the refrigerant return pipe 41 may be branched from the outdoor liquid-refrigerant pipe 34 at a position located downstream of the refrigerant cooler 45.

<C>

The air conditioner 1 of the first and second embodiments and the modifications can switch between cooling operation and heating operation; however, it is not limited thereto. An air conditioner dedicated for cooling that can perform only cooling operation may be provided.

INDUSTRIAL APPLICABILITY

The present invention is widely applicable to air conditioners each including an outdoor unit having a compressor and an outdoor heat exchanger, a plurality of indoor units having an indoor heat exchanger, and a liquid-refrigerant connection pipe that connects the outdoor unit to the plurality of indoor units, in which a liquid-pressure adjustment expansion valve that decompresses a refrigerant so that the refrigerant flowing through the liquid-refrigerant connection pipe is in a gas-liquid two-phase state is provided in an outdoor liquid-refrigerant pipe that connects a liquid-side end of the outdoor heat exchanger to the liquid-refrigerant connection pipe.

REFERENCE SIGNS LIST

1 air conditioner
2 outdoor unit
3*a*, 3*b*, 3*c*, 3*d* indoor unit
5 liquid-refrigerant connection pipe
19 control unit
21 compressor
23, 23*a*, 23*b* outdoor heat exchanger
26 liquid-pressure adjustment expansion valve
29 accumulator
31 suction refrigerant pipe
34 outdoor liquid-refrigerant pipe
41 refrigerant return pipe
41*d* liquid relief valve

44 refrigerant-return expansion valve
45 refrigerant cooler
46 liquid injection pipe
46*d* liquid relief valve
47 liquid-injection expansion valve
52*a*, 52*b*, 52*c*, 52*d* indoor heat exchanger

CITATION LIST

Patent Literature

PTL 1: International Publication No. 2015/029160

The invention claimed is:

1. An air conditioner including an outdoor unit having a compressor and an outdoor heat exchanger, a plurality of indoor units having an indoor heat exchanger, and a liquid-refrigerant connection pipe that connects the outdoor unit to the plurality of indoor units, the air conditioner being configured to perform an operation of sending a refrigerant, which has been discharged from the compressor, to the outdoor heat exchanger, the liquid-refrigerant connection pipe, and the indoor heat exchanger in that order, wherein a liquid-pressure adjustment expansion valve that decompresses the refrigerant so that the refrigerant flowing through the liquid-refrigerant connection pipe is in a gas-liquid two-phase state is provided in an outdoor liquid-refrigerant pipe that connects a liquid-side end of the outdoor heat exchanger to the liquid-refrigerant connection pipe, an outdoor expansion valve is provided in the outdoor liquid-refrigerant pipe between the liquid-pressure adjustment expansion valve and the outdoor heat exchanger, and a liquid injection pipe is provided in the outdoor liquid-refrigerant pipe between the outdoor expansion valve and the liquid-pressure adjustment expansion valve, and is connected to a portion of the outdoor liquid-refrigerant pipe on a side of the outdoor heat exchanger with respect to the liquid-pressure adjustment expansion valve, wherein the liquid injection pipe branches part of the refrigerant flowing through the outdoor liquid-refrigerant pipe and feeds the branched refrigerant to the compressor.

2. The air conditioner according to claim 1, wherein the liquid injection pipe is connected to a suction refrigerant pipe through which the refrigerant to be sucked into the compressor flows.

3. The air conditioner according to claim 2, wherein an accumulator that temporarily stores the refrigerant is provided in the suction refrigerant pipe, and the liquid injection pipe is connected to a portion of the suction refrigerant pipe on an outlet side of the accumulator.

4. The air conditioner according to claim 3, wherein a liquid-injection expansion valve that decompresses the refrigerant branched from the outdoor liquid-refrigerant pipe is provided in the liquid injection pipe, and a controller that controls a component of the outdoor unit and the indoor units controls an opening degree of the liquid-injection expansion valve so that a temperature of the refrigerant discharged from the compressor does not exceed a predetermined discharge temperature threshold.

5. The air conditioner according to claim 2, wherein the liquid injection pipe is bifurcated, and the liquid injection pipe is connected to both a portion of the suction refrigerant pipe on an inlet side of an accumulator and a portion of the suction refrigerant pipe on an outlet side of the accumulator.

6. The air conditioner according to claim 5, wherein a liquid relief valve that feeds the refrigerant branched from the outdoor liquid-refrigerant pipe to the accumulator is provided in a portion of the liquid injection pipe that is connected to the portion of the suction refrigerant pipe on the inlet side of the accumulator, and the controller that controls a component of the outdoor unit and the indoor units controls the liquid relief valve so that a pressure of the refrigerant discharged from the compressor does not exceed a predetermined discharge pressure threshold.

7. The air conditioner according to claim 2, wherein a liquid-injection expansion valve that decompresses the refrigerant branched from the outdoor liquid-refrigerant pipe is provided in the liquid injection pipe, and a controller that controls a component of the outdoor unit and the indoor units controls an opening degree of the liquid-injection expansion valve so that a temperature of the refrigerant discharged from the compressor does not exceed a predetermined discharge temperature threshold.

8. The air conditioner according to claim 1, wherein the liquid injection pipe is connected to an intermediate portion of a compression stroke of the compressor.

9. The air conditioner according to claim 8, wherein an accumulator that temporarily stores the refrigerant is provided in the suction refrigerant pipe through which the refrigerant to be sucked into the compressor flows, the liquid injection pipe is bifurcated, and the liquid injection pipe is connected to both a portion of the suction refrigerant pipe on an inlet side of the accumulator and the intermediate portion of the compression stroke of the compressor.

10. The air conditioner according to claim 1, wherein a refrigerant return pipe that branches part of the refrigerant flowing through the outdoor liquid-refrigerant pipe and feeds the branched refrigerant to the compressor is connected to the outdoor liquid-refrigerant pipe, and a refrigerant cooler that cools the refrigerant flowing through a portion of the outdoor liquid-refrigerant pipe on the side of the outdoor heat exchanger with respect to the liquid-pressure adjustment expansion valve using the refrigerant flowing through the refrigerant return pipe is provided in the outdoor liquid-refrigerant pipe.

11. The air conditioner according to claim 10, wherein at least one of the liquid injection pipe and the refrigerant return pipe is connected to a suction refrigerant pipe through which the refrigerant to be sucked into the compressor flows.

12. The air conditioner according to claim 11, wherein an accumulator that temporarily stores the refrigerant is provided in the suction refrigerant pipe, and at least one of the liquid injection pipe and the refrigerant return pipe is connected to a portion of the suction refrigerant pipe on an outlet side of the accumulator.

13. The air conditioner according to claim 11, wherein at least one of the liquid injection pipe and the refrigerant return pipe is connected to a portion of the suction refrigerant pipe on an inlet side of an accumulator.

14. The air conditioner according to claim 11, wherein the liquid injection pipe or the refrigerant return pipe is bifurcated, and the liquid injection pipe or the refrigerant return pipe is connected to both a portion of the suction refrigerant pipe on an inlet side of an accumulator and a portion of the suction refrigerant pipe on an outlet side of the accumulator.

15. The air conditioner according to claim 14, wherein a liquid relief valve that feeds the refrigerant branched from the outdoor liquid-refrigerant pipe to the accumulator is provided in a portion of the liquid injection pipe or the refrigerant return pipe that is connected to the portion of the suction refrigerant pipe on the inlet side of the accumulator, and the controller that controls a component of the outdoor unit and the indoor units controls the liquid relief valve so that a pressure of the refrigerant discharged from the compressor does not exceed a predetermined discharge pressure threshold.

16. The air conditioner according to claim 10, wherein at least one of the liquid injection pipe and the refrigerant return pipe is connected to an intermediate portion of a compression stroke of the compressor.

17. The air conditioner according to claim 16, wherein an accumulator that temporarily stores the refrigerant is provided in a suction refrigerant pipe through which the refrigerant to be sucked into the compressor flows, the liquid injection pipe or the refrigerant return pipe is bifurcated, and the liquid injection pipe or the refrigerant return pipe is connected to both a portion of the suction refrigerant pipe on an inlet side of the accumulator and the intermediate portion of the compression stroke of the compressor.

18. The air conditioner according to claim 10, wherein a liquid-injection expansion valve that decompresses the refrigerant branched from the outdoor liquid-refrigerant pipe is provided in the liquid injection pipe, a refrigerant-return expansion valve that decompresses the refrigerant branched from the outdoor liquid-refrigerant pipe is provided in the refrigerant return pipe, and a controller that controls a component of the outdoor unit and the indoor units controls an opening degree of the liquid-injection expansion valve so that a temperature of the refrigerant discharged from the compressor does not exceed a predetermined discharge temperature threshold and controls an opening degree of the refrigerant-return expansion valve so that a temperature of the refrigerant in a portion of the outdoor liquid-refrigerant pipe between the refrigerant cooler and the liquid-pressure adjustment expansion valve becomes a target liquid-pipe temperature.

19. The air conditioner according to claim 1, wherein a liquid-injection expansion valve that decompresses the refrigerant branched from the outdoor liquid-refrigerant pipe is provided in the liquid injection pipe, and a controller that controls a component of the outdoor unit and the indoor units controls an opening degree of the liquid-injection expansion valve so that a temperature of the refrigerant discharged from the compressor does not exceed a predetermined discharge temperature threshold.

20. The air conditioner according to claim 1, wherein the controller controls an opening degree of the liquid-pressure adjustment expansion valve so that a degree of subcooling of the refrigerant at the liquid-side end of the outdoor heat exchanger becomes a target degree of subcooling, to cause the liquid-pressure adjustment expansion valve to decompress the refrigerant flowing through the liquid-refrigerant connection pipe to be in the gas-liquid two-phase state.

21. The air conditioner according to claim 1, wherein a liquid-injection expansion valve that decompresses the refrigerant branched from the outdoor liquid-refrigerant pipe is provided in the liquid injection pipe, and a controller controls an opening degree of the liquid-injection expansion valve so that a temperature of the refrigerant discharged from the compressor does not exceed a predetermined discharge temperature threshold, wherein if the temperature of the refrigerant discharged from the compressor exceeds the predetermined discharge temperature threshold, the controller increases the opening degree of the liquid-injection expansion valve until the temperature of the refrigerant discharged from the compressor reaches the predetermined discharge temperature threshold or lower.

22. The air conditioner according to claim 1, wherein the branched refrigerant flows from the liquid injection pipe to the compressor during a cooling operation.

* * * * *